US008029110B2

(12) United States Patent
Matsuo et al.

(10) Patent No.: US 8,029,110 B2
(45) Date of Patent: Oct. 4, 2011

(54) DROPLET EJECTION HEAD AND DROPLET EJECTION APPARATUS

(75) Inventors: Yasuhide Matsuo, Suwa (JP); Kenji Otsuka, Suwa (JP); Kazuo Higuchi, Suwa (JP); Kosuke Wakamatsu, Fujimi (JP)

(73) Assignee: Seiko Epson Corporation, Tokyo (JP)

( * ) Notice: Subject to any disclaimer, the term of this patent is extended or adjusted under 35 U.S.C. 154(b) by 536 days.

(21) Appl. No.: 12/264,657

(22) Filed: Nov. 4, 2008

(65) Prior Publication Data

US 2009/0115823 A1 May 7, 2009

(30) Foreign Application Priority Data

Nov. 5, 2007 (JP) ..... 2007-287909
Jun. 30, 2008 (JP) ..... 2008-171851

(51) Int. Cl.
*B41J 2/045* (2006.01)

(52) U.S. Cl. ..... 347/71

(58) Field of Classification Search ..... 347/71, 347/68–69, 70, 72; 156/60, 272.2, 273.3; 428/446, 447

See application file for complete search history.

(56) References Cited

U.S. PATENT DOCUMENTS

| | | | | |
|---|---|---|---|---|
| 5,517,225 | A | 5/1996 | Miyazawa et al. | |
| 5,630,274 | A | 5/1997 | Miyazawa et al. | |
| 5,764,257 | A | 6/1998 | Miyazawa et al. | |
| 6,286,942 | B1 | 9/2001 | Miyazawa et al. | |
| 2004/0211511 | A1 | 10/2004 | Suzuki | |
| 2006/0132549 | A1 * | 6/2006 | Ito | 347/70 |

FOREIGN PATENT DOCUMENTS

| | | |
|---|---|---|
| EP | 1 291 084 | 3/2003 |
| JP | 5-293961 | 11/1993 |
| JP | 08-048949 | 2/1996 |
| JP | 2001-192639 | 7/2001 |
| JP | 2002-052723 | 2/2002 |
| JP | 2002-067311 | 3/2002 |
| JP | 2003-072071 | 3/2003 |
| JP | 2003-147145 | 5/2003 |
| JP | 2004-325158 | 11/2004 |
| JP | 2005-238789 | 9/2005 |
| JP | 2008-105334 | 5/2008 |

* cited by examiner

*Primary Examiner* — K. Feggins

(57) ABSTRACT

A droplet ejection head comprises: a substrate having first through-holes forming reservoir chambers, a second through-hole forming a supply chamber, and a bonding film on one surface; a nozzle plate having nozzles for ejecting ejection liquid and a second bonding film on one surface, the first and second films being bonded together to cover the first through-holes and the second through-hole; a sealing plate on another surface of the substrate covering the first through-holes, one surface of the sealing plate contacting the substrate's another surface; and piezoelectric means on another surface of the sealing plate for driving the droplet ejection head. The bonding films contain an Si-skeleton of constituent atoms containing silicon atoms, with siloxane (Si—O) bonds and elimination groups bonded to the silicon atoms, the constituent atoms being randomly bonded together, and the elimination groups existing near a surface of the bonding films.

35 Claims, 14 Drawing Sheets

DROPLET EJECTION HEAD AND DROPLET EJECTION APPARATUS

CROSS-REFERENCE TO RELATED APPLICATION

This application claims priorities to Japanese Patent Applications No. 2007-287909 filed on Nov. 5, 2007 and No. 2008-171851 filed on Jun. 30, 2008, which are hereby expressly incorporated by reference herein in their entireties.

TECHNICAL FIELD

The present invention relates to a droplet ejection head and a droplet ejection apparatus, more particularly, to a droplet ejection head and a droplet ejection apparatus provided with such a droplet ejection head.

RELATED ART

In a droplet ejection apparatus such as an ink jet printer, a droplet ejection head is provided for an ejecting droplet. It is known to public that such a droplet ejection head is provided with ink chambers (cavities) which store an ink therein and are communicated with nozzles for ejecting the ink as droplets, and piezoelectric elements which deform wall surfaces of the ink chambers.

In such a droplet ejection head, a part of the ink chambers (vibration plate) is deformed by expanding and contracting the piezoelectric elements for driving. By doing so, volumes of the ink chambers are changed, so that the droplets of the ink are ejected from the nozzles.

In the meantime, such a droplet ejection head is produced by bonding between a nozzle plate in which nozzles are formed and a substrate in which ink chambers are formed with a photosensitive adhesive agent or an elastic adhesive agent. JP-A-5-155017 is an example of the related art.

However, when an adhesive agent is supplied between a nozzle plate and a substrate, it is difficult to strictly control a supply amount of the adhesive agent. Therefore, it is impossible to uniform the supply amount of the adhesive agent, thereby forming an uneven distance between the nozzle plate and the substrate. This makes it possible to form ink chambers each having an ununiformity volume in a droplet ejection head.

Further, a distance between the nozzle plate of the droplet ejection head and a print medium such as a print sheet becomes uneven. Furthermore, there is a possibility that the adhesive agent is run out from a bonded part (between the nozzle plate and the substrate). These problems make it possible to reduce dimensional accuracy of the droplet ejection heard and quality of prints printed by the ink jet printer.

Additionally, the adhesive agent is exposed to an ink stored in the ink chambers for a long period of time. By exposing the adhesive agent to the ink for a long period of time, the adhesive agent changes properties thereof and is altered or deteriorated by organic components contained in the ink. For these reasons, there are possibilities that liquid-tight property of the ink chambers is lowered and components contained in the adhesive agent are dissolved in the ink.

On the other hand, it is known that respective parts constituting a droplet ejection head are bonded by a solid bonding method. The solid bonding method is a method in which these parts are directly bonded to each other without use of an adhesive layer constituted of an adhesive agent or the like.

Examples of such a solid bonding method include a direct bonding method with silicon, a bonding method by using a cathode and the like.

However, the solid bonding method has the following problems: (A) constituent materials to be bonded are limited to specific kinds, (B) a heat treatment using a high temperature (e.g., about 700 to 800° C.) must be carried out in a bonding process, (C) an atmosphere in the bonding process is limited to a reduced atmosphere, (D) a part of regions between the parts of the droplet ejection head can not be partially bonded, and the like.

Accordingly, it is an object of the present invention to provide a droplet ejection head having superior dimensional accuracy, superior chemical resistance and high reliability and being capable of printing in high quality for a long period of time. Further, it is also an object of the present invention to provide a droplet ejection apparatus provided with such a droplet ejection head and therefore being capable of providing high reliability.

SUMMARY

These objects are achieved by the present invention described below.

In a first aspect of the present invention, there is provided a droplet ejection head which comprises a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof; a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate; a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid.

Each of the first bonding film and the second bonding film contains an Si-skeleton constituted of constituent atoms containing silicon atoms, and the Si-skeleton has siloxane (Si—O) bonds and elimination groups bonded to the silicon atoms, wherein the constituent atoms are randomly bonded to each other, and the elimination groups exist in the vicinity of a surface of each of the first bonding film and the second bonding film.

The nozzle plate is bonded to the substrate together through the first bonding film and the second bonding film since the elimination groups are eliminated from the silicon atoms contained in the constituent atoms constituting the Si-skeleton in each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

This makes it possible to obtain a droplet ejection head having superior dimensional accuracy, superior chemical resistance and high reliability and being capable of printing in high quality for a long period of time.

In the above droplet ejection head, it is preferred that the constituent atoms have hydrogen atoms and oxygen atoms, a sum of a content of the silicon atoms and a content of the oxygen atoms in the constituent atoms other than the hydrogen atoms is in the range of 10 to 90 atom % in at least one of the first bonding film and the second bonding film.

The first bonding film and the second bonding film make it possible to form a firm network by silicon atoms and oxygen atoms, so that the bonded films become hard in itself. Therefore, the first bonding film and the second bonding film (the bonded films) make it possible to have high bonding strength with respect to the substrate and the nozzle plate.

In the above droplet ejection head, it is also preferred that an abundance ratio of the silicon atoms and the oxygen atoms is in the range of 3:7 to 7:3 in at least one of the first bonding film and the second bonding film.

This makes it possible for the first bonding film and the second bonding film to have high stability, and thus they can be firmly bonded to the substrate and the nozzle plate, respectively.

In the above droplet ejection head, it is also preferred that a crystallinity degree of the Si-skeleton is equal to or lower than 45%.

This makes it possible to obtain a Si-skeleton in which the constituent atoms are sufficiently randomly bonded. Therefore, characteristics of the Si-skeleton are conspicuously exhibited, and thus it is possible to obtain superior dimensional accuracy and superior bonding property of each of the first bonding film and the second bonding film.

In the above droplet ejection head, it is also preferred that the Si-skeleton of at least one of the first bonding film and the second bonding film contains Si—H bonds.

Since it is considered that the Si—H bonds prevent the siloxane (Si—O) bond from being regularly produced, the siloxane bond is formed so as to avoid the Si—H bonds. The constituent atoms constituting the Si-skeleton are bonded to each other in low regularity. That is, the constituent atoms are randomly bonded. In this way, inclusion of the Si—H bonds to the first bonding film and the second bonding film makes it possible to efficiently form the Si-skeleton having a low crystallinity degree.

In the above droplet ejection head, it is also preferred that in the case where the at least one of the first bonding film and the second bonding film containing the Si-skeleton containing the Si—H bonds is subjected to an infrared absorption measurement by an infrared adsorption measurement apparatus to obtain an infrared absorption spectrum having peaks, when an intensity of the peak derived from the siloxane bond in the infrared absorption spectrum is defined as "1", an intensity of the peak derived from the Si—H bond in the infrared absorption spectrum is in the range of 0.001 to 0.2.

This makes it possible to obtain a first bonding film and a second bonding film each having a structure in which the constituent atoms are most randomly bonded relatively. Therefore, it is possible to obtain the first bonding film and the second bonding film each having superior bonding strength, chemical resistance and dimensional accuracy.

In the above droplet ejection head, it is also preferred that the elimination groups are constituted of at least one selected from a group consisting of a hydrogen atom, a boron atom, a carbon atom, a nitrogen atom, an oxygen atom, a phosphorus atom, a sulfur atom, a halogen-based atom and an atom group which is arranged so that these atoms are bonded to the Si-skeleton.

These elimination groups have relatively superior selectivity in bonding and eliminating to and from the silicon atoms by imparting energy thereto. Therefore, such elimination groups can improve bonding property of the first bonding film and the second bonding film.

In the above droplet ejection head, it is also preferred the elimination groups are an alkyl group containing a methyl group.

Since the alkyl group has high chemical stability, the first bonding film and the second bonding film containing the alkyl group as the elimination group have superior weather resistance and chemical resistance.

In the above droplet ejection head, it is also preferred that in the case where at least one of the first bonding film and the second bonding film containing the Si-skeleton having the methyl groups as the elimination groups is subjected to an infrared absorption measurement by an infrared absorption measurement apparatus to obtain an infrared absorption spectrum having peaks, when an intensity of the peak derived from the siloxane bond in the infrared absorption spectrum is defined as "1", an intensity of the peak derived from the methyl group in the infrared absorption spectrum is in the range of 0.05 to 0.45.

This makes it possible to optimize a content of the methyl group as the elimination groups, thereby preventing the methyl group from end-capping the oxygen atoms of the siloxane bonds over a necessary degree. Therefore, since necessary and sufficient active hands exist in the first bonding film and the second bonding film, sufficient bonding property is developed in the first bonding film and the second bonding film. Further, the first bonding film and the second bonding film can have sufficient weather resistance and chemical resistance which are derived from the methyl group.

In the above droplet ejection head, it is also preferred that at least one of the first bonding film and the second bonding film is formed by using a plasma polymerization method.

This makes it possible to obtain compact and homogenous first bonding film and second bonding film, thereby enabling to firmly bond the substrate and the nozzle plate together. Further, in the first bonding film and the second bonding film produced by the plasma polymerization method, a state that the first bonding film and the second bonding film are activated by imparting energy is maintained for a relatively long period of time. Therefore, it is possible to simplify and streamline the manufacturing process of the droplet ejection head.

In the above droplet ejection head, it is also preferred that the at least one of the first bonding film and the second bonding film is constituted of polyorganosiloxane as a main component thereof.

This makes it possible to obtain a first bonding film and a second bonding film having superior mechanical property. Further, it is also possible to obtain the first bonding film and the second bonding film having superior bonding property with respect to various materials. Therefore, it is possible to firmly bond the substrate and the nozzle plate by the first bonding film and the second bonding film.

Further, the first bonding film and the second bonding film can easily and reliably control a degree of bonding property thereof. Furthermore, since the first bonding film and the second bonding film have superior liquid repellency, it is possible to obtain a droplet ejection head having superior endurance and high reliability.

In the above droplet ejection head, it is also preferred that the polyorganosiloxane is constituted of a polymer of octamethyltrisiloxane as a main component thereof.

This makes it possible to obtain the first bonding film and the second bonding film each having superior bonding property.

In the above droplet ejection head, it is also preferred that the plasma polymerization method includes a high frequency applying process and a plasma generation process, a power density of the high frequency during the plasma generation process is in the range of 0.01 to 100 W/cm$^2$.

This makes it possible to prevent excessive plasma energy from being imparted to a raw gas due to too high output density of high frequency. Further, it is also possible to reliably form the Si-skeleton in which the constituent atoms are randomly bonded.

In the above droplet ejection head, it is also preferred that an average thickness of at least one of the first bonding film and the second bonding film is in the range of 1 to 1000 nm.

This makes it possible to firmly bond the substrate and the nozzle plate while preventing dimensional accuracy between the substrate and the nozzle plate from being conspicuously lowered.

In the above droplet ejection head, it is also preferred that at least one of the first bonding film and the second bonding film is a solid-state film having no fluidity.

This makes it possible to obtain a droplet ejection head having higher dimensional accuracy as compared to a conventional droplet ejection head. Further, since no time for curing the adhesive agent is needed, it is possible to firmly bond the substrate and the nozzle plate in short time.

In the above droplet ejection head, it is also preferred that the substrate is constituted of a silicon material or a stainless steel as a main component thereof.

These materials have superior chemical resistance. Therefore, even if the first bonding film and the second bonding film are exposed to the ejection liquid for a long period of time, it is possible to reliably prevent the substrate or the nozzle plate from being alterated or deteriorated.

Further, since these materials have superior workability, it is possible to obtain the substrate having high dimensional accuracy. Therefore, volumes of the obtained reservoir chambers for the ejection liquid become uniform in the droplet ejection head, thereby obtaining the droplet ejection head which can make prints of high quality.

In the above droplet ejection head, it is also preferred that the nozzle plate is constituted of a silicon material or a stainless steel as a main component thereof.

These materials have superior chemical resistance. Therefore, even if the nozzle plate is exposed to the ejection liquid for a long period of time, it is possible to reliably prevent the nozzle plate from being alterated or deteriorated. Further, since these materials also have superior workability, it is possible to obtain the nozzle plate having high dimensional accuracy.

In the above droplet ejection head, it is also preferred that the one surface of the substrate is preliminarily subjected to a surface treatment for obtaining high bonding property to the first bonding film.

This makes it possible to obtain high bonding strength between the substrate and the first bonding film as well as high bonding strength between the substrate and the nozzle plate.

In the above droplet ejection head, it is also preferred that the one surface of the nozzle plate is preliminarily subjected to a surface treatment for obtaining high bonding property to the second bonding film.

This makes it possible to obtain high bonding strength between the nozzle plate and the second bonding film as well as high bonding strength between the substrate and the nozzle plate.

In the above droplet ejection head, it is also preferred that the surface treatment includes a plasma treatment.

This makes it possible to optimize the one surface of the substrate or the one surface of the nozzle plate, on which the first bonding film or the second bonding film is to be formed.

In the above droplet ejection head, it is also preferred that the droplet ejection head further comprises a first intermediate layer formed between the one surface of the substrate and the first bonding film.

This makes it possible to obtain high bonding strength between the substrate and the first bonding film, thereby obtaining the droplet ejection head having high reliability.

In the above droplet ejection head, it is also preferred that the droplet ejection head further comprises a second intermediate layer formed between the one surface of the nozzle plate and the second bonding film.

This makes it possible to obtain high bonding strength between the nozzle plate and the second bonding film, thereby obtaining the droplet ejection head having high reliability.

In the above droplet ejection head, it is also preferred that the first intermediate layer is constituted of an oxide-based material as a main component thereof.

This makes it possible to obtain high bonding strength between the substrate and the first bonding film as well as high bonding strength between the nozzle plate and the second bonding film.

In the above droplet ejection head, it is also preferred that the energy is imparted by using at least one method of a method of irradiating an energy beam on the surface of the first bonding film and the surface of the second bonding film, a method of heating the first bonding film and the second bonding film and a method of applying a compressive force to the first bonding film and the second bonding film.

This makes it possible to relatively easily and efficiently impart energy to the first bonding film and the second bonding film.

In the above droplet ejection head, it is also preferred that a wavelength of the energy beam is in the range of 150 to 300 nm.

Since an amount of the imparted energy is optimized due to the ultraviolet ray having such a wavelength, it is possible to selectively cut bonds between the silicon atoms of the Si-skeleton and the elimination groups while preventing the Si-skeletons contained in the first bonding film and the second bonding film from being destroyed more than necessary.

This makes it possible to develop bonding property in the first bonding film and the second bonding film while preventing characteristics (mechanical characteristics and chemical characteristics) of the first bonding film and the second bonding film from being lowered.

In the above droplet ejection head, it is also preferred that a temperature of the heating is in the range of 25 to 100° C.

This makes it possible to reliably prevent the substrate or the nozzle plate from being alterated or deteriorated by heat. Further, it is also possible to reliably activate the first bonding film and the second bonding film.

In the above droplet ejection head, it is also preferred that the compressive force is in the range of 0.2 to 10 MPa.

This makes it possible to reliably prevent damage or the like from occurring to the substrate or the nozzle plate. Further, it is also possible to develop sufficient bonding properties in the first bonding film and the second bonding film by only compressing.

In a second aspect of the present invention, there is provided a droplet ejection head which comprises a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof; a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate; a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid.

Each of the first bonding film and the second bonding film is constituted of constituent atoms containing metal atoms and oxygen atoms bonded to the metal atoms, and has elimination groups bonded to at least one of the metal atoms and the oxygen atoms, wherein the elimination groups exist in the vicinity of a surface of each of the first bonding film and the second bonding film.

The nozzle plate is bonded to the substrate together through the first bonding film and the second bonding film since the elimination groups are eliminated from the at least one of the metal atoms and the oxygen atoms contained in the constituent atoms of each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

This makes it possible to obtain a first bonding film and a second bonding film in which the elimination groups are bonded to the metal oxide, thereby obtaining a firm film which is difficultly deformed. As a result, it is possible to obtain a droplet ejection head having superior dimensional accuracy, superior chemical resistance and high reliability and being capable of printing in high quality for a long period of time.

In a third aspect of the present invention, there is provided a droplet ejection head which comprises a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof; a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate; a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid.

Each of the first bonding film and the second bonding film contains metal atoms and elimination groups constituted of an organic component, and the elimination groups exist in the vicinity of a surface of each of the first bonding film and the second bonding film.

The nozzle plate is bonded to the substrate together through the first bonding film and the second bonding film since the elimination groups are eliminated from the vicinity of the surface of each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

This makes it possible to obtain a first bonding film and a second bonding film which contain the elimination groups constituted of the metal atoms and the organic component, thereby obtaining a firm film which is difficultly to be deformed. As a result, it is possible to obtain a droplet ejection head having superior dimensional accuracy, superior chemical resistance and high reliability and being capable of printing in high quality for a long period of time.

In the above droplet ejection head, it is preferred that the droplet ejection head further comprises a third bonding film between the sealing plate and the other surface of the substrate, wherein the third bonding film includes one bonding film constituted in the same manner as the first bonding film and the other bonding film constituted of the same manner as the second bonding film, and the sealing plate is bonded to the other surface of the substrate through the other bonding film and the one bonding film.

This makes it possible to obtain high bonding property between the substrate and the sealing plate, thereby obtaining the reservoir chambers having high liquid-tight property.

In the above droplet ejection head, it is also preferred that the sealing plate is constituted from a laminated body formed by laminating layers, wherein the laminated layers include a sealing sheet being in contact with the third bonding film, at least one bonding film constituted in the same manner as the first bonding film, at least the other bonding film constituted in the same manner as the second bonding film and a vibration plate being in contact with the other bonding film, and the one bonding film being in contact with the sealing sheet, wherein the sealing sheet and the vibration plate are bonded to each other through the one bonding film and the other bonding film.

This makes it possible to obtain high bonding property between the layers of the laminated body and high propagation capability of deformation or strain of the layers of the laminated body. Therefore, it is possible to reliably convert deformation or strain by the piezoelectric means to pressure change in the reservoir chambers. In other words, it is possible to displace the sealing plate in high response.

In the above droplet ejection head, it is also preferred that the droplet ejection head further comprises a fourth bonding film between the other surface of the sealing plate and the piezoelectric means, wherein the fourth bonding film includes one bonding film constituted in the same manner as the first bonding film and the other bonding film constituted in the same manner as the second bonding film, and the piezoelectric means is bonded to the sealing plate through the other bonding film and the one bonding film.

This makes it possible to obtain high bonding property and high propagation capability of deformation or strain between the piezoelectric means and the sealing plate. As a result, it is possible to reliably convert deformation or strain by the piezoelectric means to pressure change in the reservoir chambers.

In the above droplet ejection head, it is also preferred that the piezoelectric means is composed from piezoelectric elements.

This makes it possible to easily control deflection generated in the sealing plate, thereby enabling to easily control a size of droplets of the ink.

In the above droplet ejection head, it is also preferred that the droplet ejection head further comprises a case head provided on the other surface of the sealing plate so as to cover the piezoelectric means, wherein the fourth bonding film includes one bonding film constituted in the same manner as the first bonding film and the other bonding film constituted in the same manner as the second bonding film, and the case head is bonded to the sealing plate through the other bonding film and the one bonding film.

This makes it possible to obtain high bonding property between the sealing plate and the case head. As a result, the sealing plate is reliably supported by the case head, therefore it is possible to reliably prevent disalignment and warpage of the sealing plate, the substrate, the vibration plate and the nozzle plate from being generated.

In a fourth aspect of the present invention, there is provided a droplet ejection apparatus provided with the droplet ejection head as described above.

This makes it possible to obtain a droplet ejection apparatus having high reliability.

DESCRIPTION OF EXEMPLARY EMBODIMENTS

Hereinbelow, a droplet ejection head and a droplet ejection apparatus according to the present invention will be described in detail with reference to preferred embodiments shown in the accompanying drawings.

Ink Jet Type Recording Head

First Embodiment

First, a description will be made on an embodiment of the case where the droplet ejection head according to the present invention is applied to an ink jet type recording head.

Figure 1:
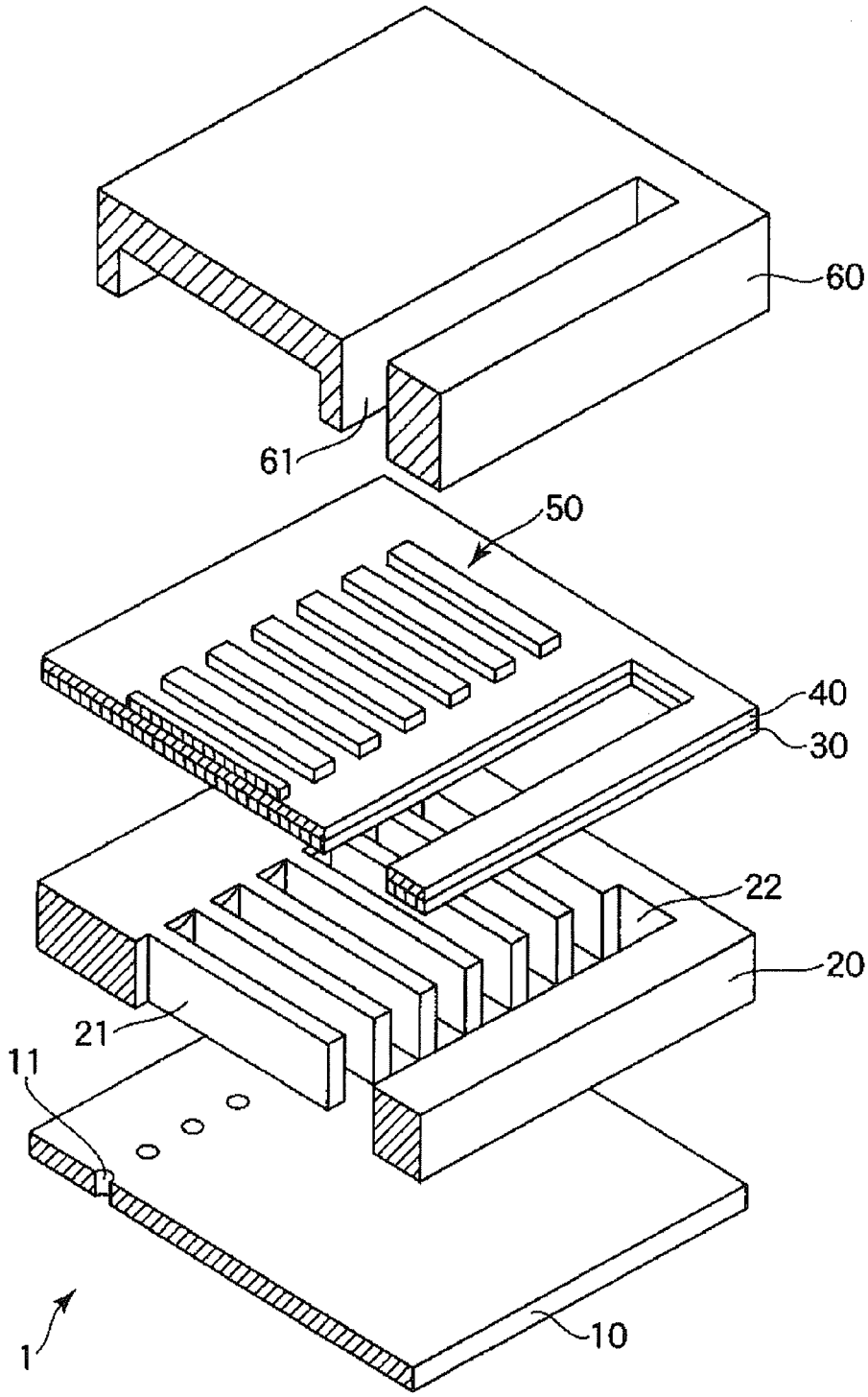
FIG. 1 is an exploded perspective view showing a droplet ejection head of a first embodiment according to the present invention, wherein the droplet ejection head is configured as an ink jet type recording head.
Figure 2:
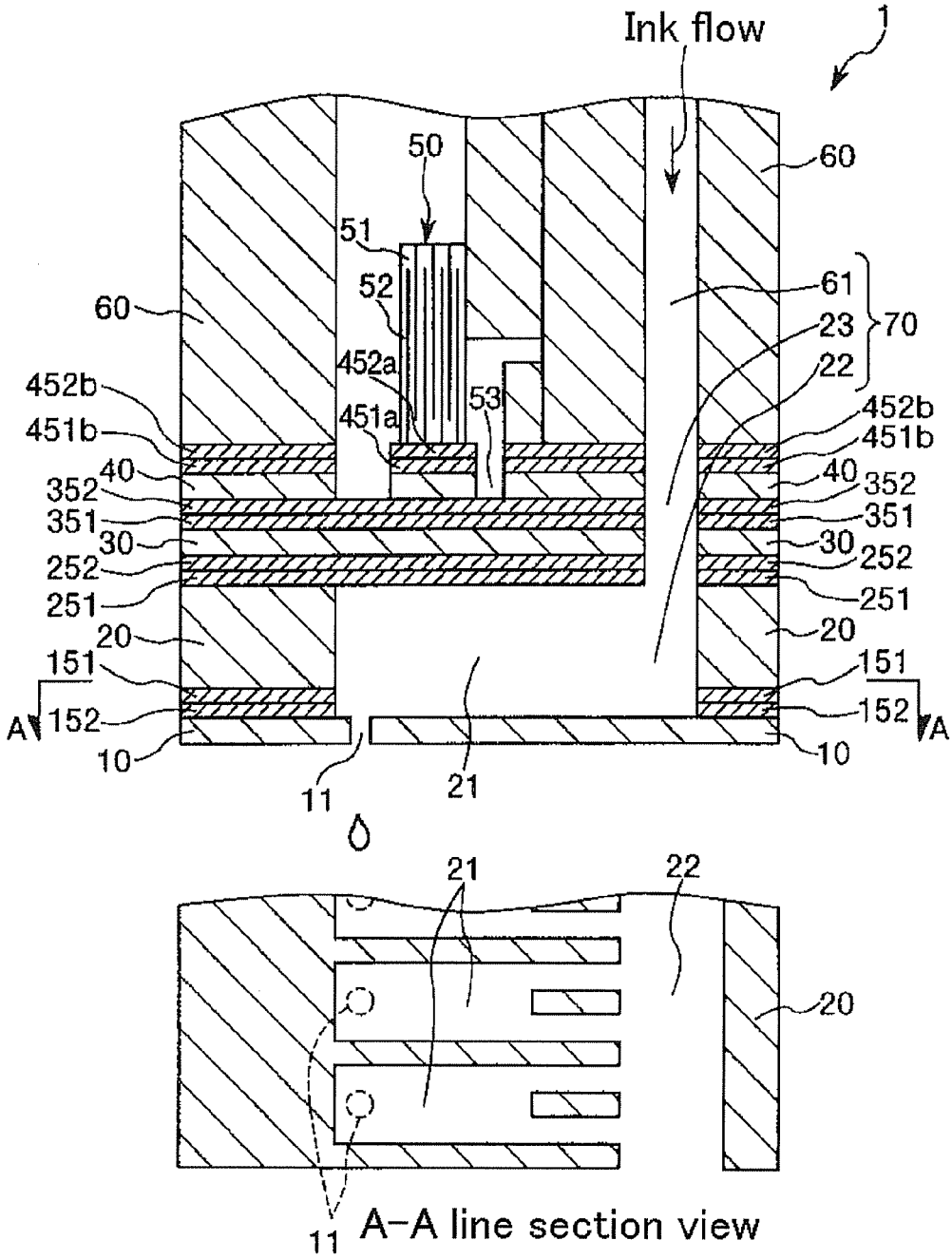
FIG. 2 is a section view of the ink jet type recording head shown in FIG. 1.

FIG. 1 is an exploded perspective view showing a droplet ejection head of a first embodiment according to the present invention, wherein the droplet ejection head is configured as an ink jet type recording head. FIG. 2 is a section view of the ink jet type recording head shown in FIG. 1.

Figure 3:
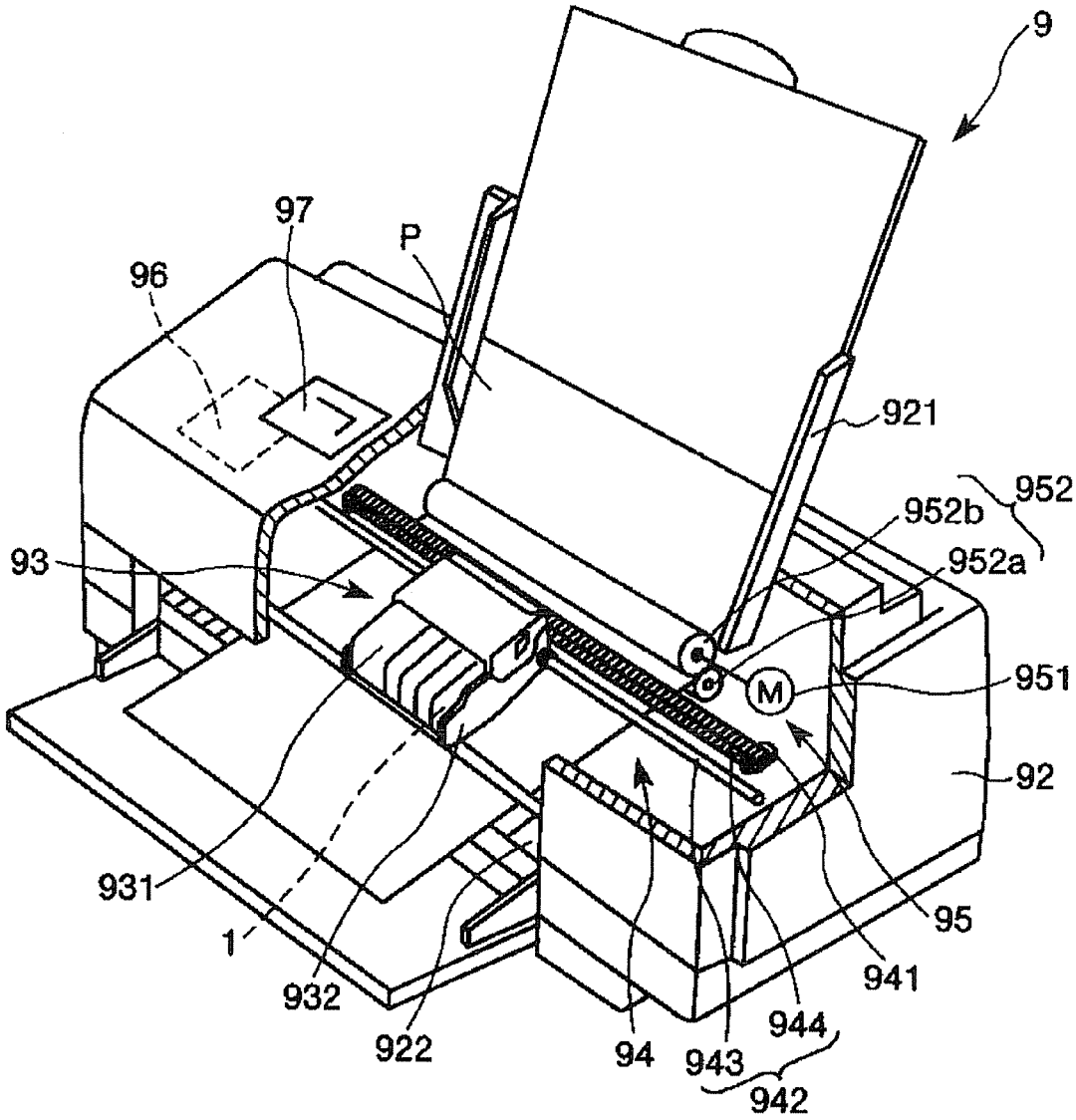
FIG. 3 is a schematic view showing one embodiment of an ink jet printer provided with the ink jet type recording head shown in FIG. 1.

FIG. 3 is a schematic view showing one embodiment of an ink jet printer provided with the ink jet type recording head shown in FIG. 1. In the following description, the upper side in FIGS. 1 and 2 will be referred to as "upper" and the lower side thereof will be referred to as "lower" for convenience of explanation.

The ink jet type recording head 1 (hereinafter, simply referred to as "head 1") shown in FIG. 1 is mounted to an ink jet printer 9 shown in FIG. 3.

The ink jet printer 9 shown in FIG. 3 includes a printer body 92, a tray 921 provided in an upper rear portion of the printer body 92 for holding recording paper sheets P, a paper discharging port 922 provided in a lower front portion of the printer body 92 for discharging the recording paper sheets P therethrough, and an operation panel 97 provided on the upper surface of the printer body 92.

The operation panel 97 is formed from, e.g., a liquid crystal display, an organic EL display, an LED lamp or the like. The operation panel 97 includes a display portion (not shown) for displaying an error message and the like and an operation portion (not shown) formed from various kinds of switches.

Within the printer body 92, there are provided a printing device (a printing means) 94 having a reciprocating head unit 93, a paper sheet feeding device (a paper sheet feeding means) 95 for feeding the recording paper sheets P into the printing device 94 one by one and a control unit (a control means) 96 for controlling the printing device 94 and the paper sheet feeding device 95.

Under the control of the control unit 96, the paper sheet feeding device 95 feeds the recording paper sheets P one by one in an intermittent manner. The recording paper sheets P pass near the lower portion of the head unit 93. At this time, the head unit 93 makes reciprocating movement in a direction generally perpendicular to the feeding direction of the recording paper sheets P, thereby printing the recording paper sheets P.

In other words, an ink jet type printing operation is performed, during which time the reciprocating movement of the head unit 93 and the intermittent feeding of the recording paper sheets P act as primary scanning and secondary scanning, respectively.

The printing device 94 includes a head unit 93, a carriage motor 941 serving as a driving power source of the head unit 93 and a reciprocating mechanism 942 for reciprocating the head unit 93 by rotations of the carriage motor 941.

The head unit 93 includes the head 1 having a plurality of nozzles 11 formed in a lower portion thereof, an ink cartridge 931 for supplying an ink to the head 1 and a carriage 932 carrying the head 1 and the ink cartridge 931.

Full color printing becomes available by using a cartridge of the type filled with the ink of each of four colors, i.e., yellow, cyan, magenta and black as the ink cartridge 931.

The reciprocating mechanism 942 includes a carriage guide shaft 943 whose opposite ends are supported on a frame (not shown) and a timing belt 944 extending parallel to the carriage guide shaft 943.

The carriage 932 is reciprocatingly supported by the carriage guide shaft 943 and fixedly secured to a portion of the timing belt 944.

If the timing belt 944 wound around a pulley is caused to run in forward and reverse directions by operating the carriage motor 941, the head unit 93 makes reciprocating movement along the carriage guide shaft 943. During this reciprocating movement, appropriate an amount of an ink is ejected from the head 1 to print the recording paper sheets P.

The paper sheet feeding device 95 includes a paper sheet feeding motor 951 serving as a driving power source thereof and a pair of paper sheet feeding rollers 952 rotated by means of the paper sheet feeding motor 951.

The paper sheet feeding rollers 952 include a driven roller 952*a* and a driving roller 952*b*, both of which face toward each other in a vertical direction, with a paper sheet feeding path (the recording paper sheets P) remained therebetween. The driving roller 952*b* is connected to the paper sheet feeding motor 951.

Thus, the paper sheet feeding rollers 952 are able to feed the plurality of recording paper sheets P, which are held in the tray 921, toward the printing device 94 one by one. In place of the tray 921, it may be possible to employ a construction that can removably hold a paper sheet feeding cassette containing the recording paper sheets P.

The control unit 96 is designed to perform printing by controlling the printing device 94 and the paper sheet feeding device 95 based on printing data inputted from a host computer, e.g., a personal computer or a digital camera.

Although not shown in the drawings, the control unit 96 is mainly comprised of a memory that stores a control program for controlling the respective parts and the like, a driving circuit for driving the printing device 94 (the carriage motor 941), a driving circuit for driving the paper sheet feeding device 95 (the paper sheet feeding motor 951), a communication circuit for receiving the printing data from a host computer, and a CPU electrically connected to these parts for performing various kinds of control with respect to the respective parts.

Electrically connected to the CPU are a variety of sensors capable of detecting, e.g., a remaining amount of an ink contained in the ink cartridge 931 and a position of the head unit 93.

The control unit 96 receives printing data through the communication circuit and then stores them in the memory. The CPU processes these printing data and outputs driving signals to the respective driving circuits, based on the data thus processed and the data inputted from the variety of sensors. Responsive to these signals, the printing device 94 and the paper sheet feeding device 95 come into operation, thereby printing the recording paper sheets P.

Hereinafter, the head 1 will be described in detail with reference to FIGS. 1 and 2.

As shown in FIGS. 1 and 2, the head 1 includes a nozzle plate 10, a substrate 20 for forming reservoir chambers of an ejection liquid (ink) (hereinafter simply referred to as "substrate 20"), which is provided on the nozzle plate 10 through a first bonding film 151 and a second bonding film 152, and a sealing sheet 30 provided on the substrate 20 through a first bonding film 251 and a second bonding film 252 (third bonding film).

Further, the head 1 also includes a vibration plate 40 provided on the sealing sheet 30 through a first bonding film 351 and a second bonding film 352, the piezoelectric elements (vibration or piezoelectric means) 50 provided on a part of a surface of the vibration plate 40 through a first bonding film 451*a* and a second bonding film 452*a* (fourth bonding film) and a case head 60 provided on the vibration plate 40 through a first bonding film 451*b* and a second bonding film 452*b* so as to cover the piezoelectric elements 50.

In this regard, it is to be noted that a sealing plate is formed from a laminated body formed from the sealing sheet 30 and the vibration plate 40 in the present embodiment. The head 1 configures a piezo-jet type head.

Through-holes that serve as a plurality of reservoir chambers (pressure chambers) 21 of the ejection liquid for reserving the ink (hereinafter simply referred to as "reservoir chambers 21") and a through-hole that serves as a supply chamber 22 of the ejection liquid for supplying the ink to the reservoir chambers 21 (hereinafter simply referred to as "supply chamber 22"), which is communicated with the plurality of reservoir chambers 21, are formed in the substrate 20.

That is to say, the reservoir chambers 21 are formed from the through-holes, the nozzle plate 10 and the first bonding film 251 (sealing sheet 30), and the supply chamber 22 is formed from the through-hole and the nozzle plate 10.

As shown in FIGS. 1 and 2, the reservoir chambers 21 and the supply chamber 22 are in a substantially rectangular shape in a plane view, respectively. In the plane view of the substrate 20, the width (short side) of each reservoir chamber 21 is smaller than that of the supply chamber 22.

Further, in a plane view of the substrate 20, the reservoir chambers 21 are arranged in a perpendicular direction with respect to a length direction (long side) of the supply chamber 22. The reservoir chambers 21 are formed in a comb-like shape as an entirely in the plane view of the substrate 20.

In this regard, the supply chamber 22 may be a trapezoidal shape, a triangular shape and a bale-like shape (capsule shape) in addition to the rectangular shape like the present invention in the plane view of the substrate 20.

Examples of a constituent material of the substrate 20 include: a silicon material such as single crystal silicon, polycrystal silicon and amorphous silicon; a metal material such as stainless steel, titanium and aluminum; a glass material such as quartz glass, glass silicate, alkali glass silicate, soda-lime glass, potash-lime glass, lead (alkali) glass, barium glass and borosilicate glass; a ceramic material such as alumina, zirconia, ferrite, silicon nitride, aluminium nitride, boron nitride, titanium nitride, silicon carbide, boron carbide, titanium carbide and tungsten carbide; a carbon material such as graphite; a resin-based material such as polyolefin (e.g., polyethylene, polypropylene, an ethylene-propylene copolymer, an ethylene-vinyl acetate copolymer (EVA)), cyclic polyolefin, denatured polyolefin, polyvinyl chloride, polyvinylidene chloride, polystyrene, polyamide, polyimide, polyamide-imide, polycarbonate, poly-(4-methylpentene-1), an ionomer, acrylic resin, polymethyl methacrylate, an acrylonitrile-butadiene-styrene copolymer (ABS resin), an acrylonitrile-styrene copolymer (AS resin), a butadiene-styrene copolymer, polyoxymethylene, polyvinyl alcohol (PVA), an ethylene-vinyl alcohol copolymer (EVOH), polyester (e.g., polyethylene terephthalate (PET), polyethylene naphthalate, polybutylene terephthalate (PBT), polycyclohexane terephthalate (PCT)), polyether, polyether ketone (PEK), polyether ether ketone (PEEK), polyether imide, polyacetal (POM), polyphenylene oxide, denatured polyphenylene oxide, a denatured polyohenylene ether resin (PBO), polysulfone, polyether sulfone, polyphenylene sulfide (PPS), polyarylate, a liquid crystal polymer (e.g., aromatic polyester), a fluoro resin (e.g., polytetrafluoroethylene, polyfluorovinylidene), a thermoplastic elastomer (e.g., a styrene-based elastomer, a polyolefin-based elastomer, a polyvinylchloride-based elastomer, a polyurethane-based elastomer, a polyester-based elastomer, a polyamide-based elastomer, a polybutadiene-based elastomer, a trans-polyisoprene-based elastomer, a fluororubber-based elastomer, a chlorinated polyethylene-based elastomer), an epoxy resin, a phenolic resin, an urea resin, a melamine resin, an aramid resin, an unsaturated polyester, a silicone resin, polyurethane, or a copolymer, a blended body and a polymer alloy each having at least one of these materials as a major component thereof; a complex material containing any one kind of the above materials or two or more kinds of the above materials; and the like.

Further, the constituent material of the substrate 20 may be a material obtained by subjecting the above materials to a treatment such as an oxidation treatment (oxide film formation treatment), a plating treatment, a passivation treatment and a nitriding treatment.

Among these materials mentioned above, the constituent material of the substrate 20 is preferably the silicon material or the stainless steel. Such materials have superior chemical resistance. Therefore, even if these materials are exposed to the ink for a long period of time, it is possible to reliably prevent the substrate 20 from being alterated or deteriorated.

Further, since these materials also have superior workability, it is also possible to obtain the substrate 20 having high dimensional accuracy. For these reasons, volumes of the reservoir chambers 21 and the supply chamber 22 become uniform, respectively. Consequently, it is possible to obtain a head 1 which is capable of printing in high quality.

Further, the supply chamber 22 serves as a part of a reservoir 70 which functions as a common ink chamber for supplying the ink to the reservoir chambers 21. The reservoir 70 is communicated with a supply path of the ejection liquid which is provided in the case head 60 described later.

Furthermore, inner surfaces of the reservoir chambers 21 and the supply chamber 22 (substrate 20) may be preliminarily subjected to a hydrophilic treatment. This makes it possible to prevent bubbles from remaining in the reservoir chambers 21 and the supply chamber 22 during reserve of the ink.

As shown in FIG. 2, an upper surface of the nozzle plate 10 is bonded to a lower surface (opposite surface to the sealing sheet 30) of the substrate 20 through two bonding films 151 and 152. That is to say, the substrate 20 is bonded to the nozzle plate 10 through a first bonding film 151 provided on the lower surface of the substrate 20 and a second bonding film 152 provided on the upper surface of the nozzle plate 10.

The droplet ejection head 1 according to the present invention is characterized in that the substrate 20 is bonded to the nozzle plate 10 through the first bonding film 151 and the second bonding film 152.

Each of the first bonding film 151 and the second bonding film 152 contains an Si-skeleton 301 having siloxane bonds (Si—O) 302, of which constituent atoms are randomly bonded to each other, and elimination groups 303 bonding to silicon atoms of the Si-skeleton 301.

In each of the first bonding film 151 and the second bonding film 152, the elimination groups 303 are eliminated from the silicon atoms of the Si-skeleton 301 by imparting energy thereto. As a result, bonding property is developed in the lower surface of the first bonding film 151 and the upper surface of the second bonding film 152 in FIG. 2, thereby bonding the substrate 20 and the nozzle plate 10. In this regard, it is to be noted that the first bonding film 151 and the second bonding film 152 will be described later.

Nozzles 11 are formed in the nozzle plate 10 so as to correspond to positions of the reservoir chambers 21, respectively. The ink can be ejected from the nozzles 11 as droplets by pushing the ink reserved in the reservoir chambers 21. The upper surface of the nozzle plate 10 serves as the lower surface of inside surfaces of the reservoir chambers 21 and the supply chamber 22.

In other words, the reservoir chambers 21 are partitioned by the upper surface of the nozzle plate 10, the inner surface of the substrate 20 and a lower surface of first bonding film 251 which is bonded to the sealing sheet 30 through the second bonding film 252. Further, the supply chamber 22 is partitioned by the upper surface of the nozzle plate 10.

Examples of a constituent material of such a nozzle plate 10 include a silicon material, a metal material, a glass material, a ceramic material, a carbon material, a resin material, a complex material containing any one kind of the above materials or two or more kinds of the above materials; and the like as described above.

Among these materials mentioned above, the constituent material of the nozzle plate 10 is preferably the silicon material or the stainless steel. Such materials have superior chemical resistance. Therefore, even if these materials are exposed to the ink for a long period of time, it is possible to reliably prevent the nozzle plate 10 from being alterated or deteriorated.

Further, since these materials also have superior workability, it is also possible to obtain the nozzle plate 10 having high dimensional accuracy. For these reasons, it is possible to obtain a head 1 having high reliability.

A coefficient of linear expansion of the constituent material of the nozzle plate 10 is preferably in the range of about 2.5 to 4.5($\times 10^{-6}$/° C.) at a temperature of 300° C. or lower. Further, a thickness of the nozzle plate 10 is not particularly limited but is preferably in the range of about 0.01 to 1 mm.

A liquid repellency film (not shown) is provided on the lower surface of the nozzle plate 10, if needed. This makes it possible to prevent droplets of the ink to be ejected from the nozzles from being ejected to unintended directions.

Examples of a constituent material of such a liquid repellency film include a coupling agent having functional groups having liquid repellency, a resin material having liquid repellency and the like.

Examples of such a coupling agent to be used in the constituent material of the liquid repellency film include a silane-type coupling agent, a titanium-type coupling agent, an aluminum-type coupling agent, a zirconium-type coupling agent, an organophosphate-type coupling agent, a silyl-peroxide-type coupling agent and the like.

Examples of the functional groups having liquid repellency include a fluoroalkyl group, an alkyl group, a vinyl group, an epoxy group, a styryl group, a methacryloxy group and the like.

Examples of the resin material having liquid repellency to be used in the constituent material of the liquid repellency film include a fluoro-type resin such as polytetrafluoroethylene (PTFE), a tetrafluoroethylene-perfluoroalkylvinylether co-polymer (PFA), an ethylene-tetrafluoroethylene co-polymer (ETFE), a perfluoroethylene-propene co-polymer (FEP), an ethylene-chlorotrifluoroethylene co-polymer (ECTFE) and the like.

The sealing sheet 30 is bonded to the upper surface of the substrate 20 through two bonding films. That is to say, a lower surface of the sealing sheet 30 is bonded to the upper surface of the substrate 20 through a first bonding film 251 provided to the upper surface of the substrate 20 and a second bonding film 252 provided to the lower surface of the sealing sheet 30.

A part of the lower surface of the first bonding film 251 serves as an upper surface of the reservoir chambers 21. In other words, the reservoir chambers 21 are partitioned by the upper surface of the nozzle plate 10, the inner surface of the substrate 20 and the lower surface of the first bonding film 251. By reliably bonding the sealing sheet 30 and the substrate 20, liquid-tight properties of the reservoir chambers 21 and the supply chamber 22 are ensured.

Examples of a constituent material of the sealing sheet 30 include a silicon material, a metal material, a glass material, a ceramic material, a carbon material, a resin material, a complex material containing any one kind of the above materials or two or more kinds of the above materials, and the like as described above.

Among these materials mentioned above, the constituent material of the sealing sheet 30 is preferably the resin material such as polyphenylenesulfide (PPS) and an aramid resin, the silicon material or the stainless steel. Such materials have superior chemical resistance. Therefore, even if these materials are exposed to the ink for a long period of time, it is possible to reliably prevent the sealing sheet 30 from being alterated or deteriorated. For these reasons, it is possible to reserve the ink in the reservoir chambers 21 and the supply chamber 22 for a long period of time.

Such a first bonding film 251 and a second bonding film 252 bonding together the sealing sheet 30 and the substrate 20 may be of any kind of constituent material as long as the substrate 20 can be bonded to the sealing sheet 30. Examples of the constituent material of the first bonding film 251 and the second bonding film 252 include: an adhesive agent such as an epoxy-type adhesive agent, a silicone-type adhesive agent, an urethane-type adhesive agent; a solder; a brazing filler metal; and the like, which are appropriately selected depending on the constituent material of each of the substrate 20 and the sealing sheet 30.

The first bonding film 251 and the second bonding film 252 are not necessarily provided between the substrate 20 and the sealing sheet 30, and may be omitted. In this case, the substrate 20 is bonded to the sealing sheet 30 by a fusion (weld) method or a direct bonding method such as a silicon direct-bonding method and a solid bonding method (e.g. an anode bonding method).

In the embodiment, bonding functions (bonding properties) of the first bonding film 251 and the second bonding film 252 are the same as those of the first bonding film 151 and the second bonding film 152. That is to say, the first bonding film 251 and the second bonding film 252 contain a Si-skeleton 301 having siloxane bonds (Si—O) 302, of which constituent atoms are randomly bonded to each other, and elimination groups 303 bonding to silicon atoms of the Si-skeleton 301.

In each of the first bonding film 251 and the second bonding film 252, the elimination groups 303 are eliminated from the silicon atoms of the Si-skeleton 301 by imparting energy thereto. As a result, bonding property is developed in an upper surface of the first bonding film 251 and a lower surface of the second bonding film 252 in FIG. 2, thereby bonding the substrate 20 and the sealing sheet 30.

In this regard, it is to be noted that the first bonding film 251 and the second bonding film 252 will be described later in more detail together with the first bonding film 151 and the second bonding film 152.

A vibration plate 40 is bonded to an upper surface of the sealing sheet 30 through a first bonding film 351 and a second film 352. In other words, a lower surface of the vibration plate 40 is bonded to the upper surface of the sealing sheet 30 through the first bonding film 351 and the second film 352.

Examples of a constituent material of the vibration plate 40 include a silicon material, a metal material, a glass material, a ceramic material, a carbon material, a resin material, a complex material containing any one kind of the above materials or two or more kinds of the above materials, and the like as described above.

By reliably bonding the vibration plate 40 and the sealing sheet 30, deformation or strain occurring to piezoelectric elements 50 are reliably converted to displacement of the sealing sheet 30, namely volume change of each of the reservoir chambers 21.

Among these materials mentioned above, the constituent material of the vibration plate 40 is preferably the silicon material or the stainless steel. Such materials are capable of being elastically deformed at a high speed. As a result, the ink can be ejected from the nozzles 11 in high accuracy.

Such a first bonding film 351 and a second bonding film 352 bonding together the sealing sheet 30 and the vibration plate 40 may be of any kind of constituent material as long as the vibration plate 40 can be bonded to the sealing sheet 30.

Examples of the constituent materials of the first bonding film 351 and the second bonding film 352 include: an adhesive agent such as an epoxy-type adhesive agent, a silicone-type adhesive agent, an urethane-type adhesive agent; a solder; a brazing filler metal; and the like, which are appropriately selected depending on the constituent material of each of the vibration plate 40 and the sealing sheet 30.

The first bonding film 351 and the second bonding film 352 are not necessarily provided between the vibration plate 40 and the sealing sheet 30, and may be omitted. In this case, the vibration plate 40 can be bonded to the sealing sheet 30 by a fusion (weld) method or a direct bonding method such as a silicon direct-bonding method and a solid bonding method (e.g. an anode bonding method).

In the embodiment, bonding functions (bonding properties) of the first bonding film 351 and the second bonding film 352 are the same as those of the first bonding film 151 and the second bonding film 152.

That is to say, the first bonding film 351 and the second bonding film 352 contain a Si-skeleton 301 having siloxane bonds (Si—O) 302, of which constituent atoms are randomly bonded to each other, and elimination groups 303 bonding to silicon atoms of the Si-skeleton 301.

In each of the first bonding film 351 and the second bonding film 352, the elimination groups 303 are eliminated from the silicon atoms of the Si-skeleton 301 by imparting energy thereto. As a result, bonding property is developed in an upper surface of the first bonding film 351 and a lower surface of the second bonding film 352, thereby bonding the vibration plate 40 and the sealing sheet 30 together.

In this regard, it is to be noted that the first bonding film 351 and the second bonding film 352 will be described later in more detail together with the first bonding film 151 and the second bonding film 152.

Further, in the embodiment, a sealing plate is constituted from a laminated body formed by laminating the vibration plate 40 to the sealing sheet 30. The sealing plate may be constituted from a single layer or a laminated body which is formed by laminating three or more layers.

In the case where the sealing plate is constituted from the laminated body which is formed by laminating three or more layers, if at least adjacent two layers among the layers of the laminated body are bonded to each other by the first bonding film 351 and the second bonding film 352, the laminated body has high dimensional accuracy. As a result, the head 1 has high dimensional accuracy.

Piezoelectric elements (vibration means) 50 are bonded to a part of an upper surface of the vibration plate 40 (near a center portion of the upper surface of the vibration plate 40 in FIG. 2) through a first bonding film 451*a* and a second bonding film 452*a*.

The piezoelectric elements 50 are composed from piezoelectric layers 51 constituted of a piezoelectric material and electric films 52 for applying a voltage to the piezoelectric layers 51. In such piezoelectric elements 50, deformation or strain depending on the voltage occur to the piezoelectric layers 51 by applying the voltage between the electric films 52 (inverse piezoelectric effect). The deformation or strain gives deflection (vibration) to the vibration plate 40 and the sealing sheet 30, thereby changing the volumes of the reservoir chambers 21.

By reliably bonding the piezoelectric elements 50 and the vibration plate 40, the deformation or strain occurring to piezoelectric elements 50 (piezoelectric layers 51) is reliably converted to displacements of the sealing sheet 30 and the vibration plate 40, which cause volume change of each of the reservoir chambers 21.

A direction of laminating the piezoelectric layers 51 and the electric films 52 is not particularly limited but may be a parallel direction or a perpendicular direction to the vibration plate 40. In the case where the direction of laminating the piezoelectric layers 51 and the electric films 52 is the perpendicular direction to the vibration plate 40, the piezoelectric elements 50 formed by laminating the piezoelectric layers 51 and the electric films 52 in such a direction are referred to as "MLP (Multi Layer Piezo)".

If the piezoelectric elements 50 are MLP, the vibration plate 40 can be deflected in a large manner. Therefore, the MLP has an advantage that a large range of an adjusting amount of the ejected ink is obtained.

In the piezoelectric elements 50, an adjacent (contact) surface to the second bonding film 452*a* is a surface in which the piezoelectric layers 51 are exposed (side surfaces of the piezoelectric layers 51), a surface in which the electric films 52 are exposed (side surfaces of the electric films 52), or a surface in which both the piezoelectric layers 51 and the electric films 52 are exposed (both the side surfaces), though it is different by arrangement of the piezoelectric elements 50.

Examples of a constituent material of the piezoelectric layers 51 included in the piezoelectric elements 50 include barium titanate, lead zirconate, lead titanate zirconate, zinc oxide, aluminum nitride, lithium tantalite, lithium niobate, crystal and the like.

Examples of a constituent material of the electric films 52 included in the piezoelectric elements 50 include various kinds of metal materials such as Fe, Ni, Co, Zn, Pt, Au, Ag, Cu, Pd, Al, W, Ti, Mo and an alloy containing these materials, and the like.

Such a first bonding film 451*a* and a second bonding film 452*a* bonding together the vibration plate 40 and the piezoelectric elements 50 may be of any kind of constituent material as long as the vibration plate 40 can be bonded to the piezoelectric elements 50.

Examples of the constituent material of the first bonding film 451*a* and the second bonding film 452*a* include: an adhesive agent such as an epoxy-type adhesive agent, a silicone-type adhesive agent, an urethane-type adhesive agent; a solder; a brazing filler metal; and the like, which are appropriately selected depending on the constituent material of each of the vibration plate 40 and the piezoelectric elements 50.

The first bonding film 451*a* and the second bonding film 452*a* are not necessarily provided between the vibration plate 40 and the piezoelectric elements 50, and may be omitted. In this case, the piezoelectric elements 50 are bonded to the vibration plate 40 by a fusion (weld) method or a direct bonding method such as a silicon direct-bonding method and a solid bonding method (e.g. an anode bonding method).

In the embodiment, bonding functions (bonding properties) of the first bonding film 451*a* and the second bonding film 452*a* are the same as those of the first bonding film 151 and the second bonding film 152.

That is to say, the first bonding film 451*a* and the second bonding film 452*a* contain a Si-skeleton 301 having siloxane bonds (Si—O) 302, of which constituent atoms are randomly bonded to each other, and elimination groups 303 bonding to silicon atoms of the Si-skeleton 301.

In each of the first bonding film 451*a* and the second bonding film 452*a*, the elimination groups are eliminated from the silicon atoms of the Si-skeleton 301 by imparting energy thereto. As a result, bonding property is developed in an upper surface of the first bonding film 451*a* and a lower surface of the second bonding film 452*a* in FIG. 2, thereby bonding the vibration plate 40 and the piezoelectric elements 50 together.

In this regard, it is to be noted that the first bonding film 451*a* and the second bonding film 452*a* will be described later in more detail together with the first bonding film 151 and the second bonding film 152.

The vibration plate 40 described above has a concave portion 53 formed in an annular shape so as to surround a region where the piezoelectric elements 50 are bonded (laminated). That is to say, in the region where the piezoelectric elements 50 are bonded, a part of the vibration plate 40 is isolated in an island shape from the other part of the vibration plate 40 through the annular-shaped concave portion 53.

In this regard, it is to be noted that the first bonding film 451*a* and the second bonding film 452*a* are provided (laminated) on the vibration plate 40 in the inside of the annular-shaped concave portion 53. Further, the electric films 52 included in the piezoelectric elements 50 are electrically connected to a driving IC (not shown). The driving IC makes it possible to control a movement of the piezoelectric elements 50.

Furthermore, a case head 60 is bonded to a region of an upper surface of the vibration plate 40 through a first bonding film 451*b* and a second bonding film 452*b*. By reliably bonding the vibration plate 40 and the case head 60, reinforcement is made to a so-called cavity part composed from a laminated body which is formed by laminating the nozzle plate 10, the substrate 20, the sealing sheet 30 and the vibration plate 40.

As a result, it is possible to reliably prevent deformation or strain or warpage of the cavity part from occurring.

Examples of a constituent material of the case head 60 include a silicon material, a metal material, a glass material, a ceramic material, a carbon material, a resin material, a complex material containing any one kind of the above materials or two or more kinds of the above materials, and the like as described above.

Among these materials mentioned above, the constituent material of the case head 60 is preferably polyphenylene sulfide (PPS), a denatured polyphenylene ether resin, e.g. "xyron" (which is a registered mark) or the stainless steel. This is because these materials have sufficient rigidity. Therefore, these materials can be preferably used as the constituent material of the case head 60 which supports the cavity part.

Such a first bonding film 451*b* and a second bonding film 452*b* bonding together the vibration plate 40 and the case head 60 may be constituted of any kind of constituent material as long as the vibration plate 40 can be bonded to the case head 60. Examples of the constituent material of the first bonding film 451*b* and the second bonding film 452*b* include: an adhesive agent such as an epoxy-type adhesive agent, a silicone-type adhesive agent, an urethane-type adhesive agent; a solder; a brazing filler metal; and the like, which are appropriately selected depending on the constituent material of each of the vibration plate 40 and the case head 60.

The first bonding film 451*b* and the second bonding film 452*b* are not necessarily provided between the vibration plate 40 and the case head 60, and may be omitted. In this case, the vibration plate 40 can be bonded to the case head 60 by a fusion (weld) method or a direct bonding method such as a silicon direct-bonding method and a solid bonding method (e.g. an anode bonding method).

In the embodiment, bonding functions (bonding properties) of the first bonding film 451*b* and the second bonding film 452*b* are the same as those of the first bonding film 151 and the second bonding film 152.

That is to say, the first bonding film 451*b* and the second bonding film 452*b* contain a Si-skeleton 301 having siloxane bonds (Si—O) 302, of which constituent atoms are randomly bonded to each other, and elimination groups 303 bonding to silicon atoms of the Si-skeleton 301.

In each of the first bonding film 451*b* and the second bonding film 452*b*, the elimination groups 303 are eliminated from the silicon atoms of the Si-skeleton 301 by imparting energy thereto. As a result, bonding property is developed in an upper surface of the first bonding film 451*b* and a lower surface of the second bonding film 452*b* in FIG. 2, thereby bonding the vibration plate 40 and the case head 60 together.

In this regard, it is to be noted that the first bonding film 451*b* and the second bonding film 452*b* will be described later in more detail together with the first bonding film 151 and the second bonding film 152.

Each of the first bonding film 251, the second bonding film 252, the sealing sheet 30, the first bonding film 351, the second bonding film 352, the vibration plate 40, the first bonding film 451*b* and the second bonding film 452*b* has a through-hole 23 at a region which corresponds to a region of the supply chamber 22 (through-hole) in the substrate 20, respectively. A supply path 61 of the ejection liquid (ink) provided in the case head 60 is communicated with the supply chamber 22 through the through-hole 23.

In this regard, it is to be noted that a part of reservoir 70 is composed from the supply path 61, the through-hole 23 and the supply chamber 22. The reservoir 70 serves as a common ink chamber from which the ink is supplied to the reservoir chambers 21.

In such a head 1, after the nozzles 11, the reservoir chambers 21 and the reservoir 70 are filled with the ink which has been supplied from outside supply means of the ejection liquid (not shown), the piezoelectric elements 50 corresponding to the reservoir chambers 21, respectively, are moved by a recording signal sent from the driving IC. By doing so, deflection (vibration) occurs to the vibration plate 40 and the sealing sheet 30 due to the inverse piezoelectric effect of the piezoelectric elements 50.

As a result, if the reservoir chambers 21 are constricted, namely volumes of the reservoir chambers 21 are reduced, pressures within the reservoir chambers 21 instantaneously become high, thereby the ink contained in the reservoir chambers 21 is pushed (ejected) from the nozzles 11 as droplets.

In the head 1, by applying a voltage to the piezoelectric elements 50 lying in target printing positions through the driving IC, namely by sequentially inputting ejection signals from the driving IC to the piezoelectric elements 50 lying in the target printing positions, it is possible to print an arbitrary (desired) letter, figure or the like.

In this regard, the head 1 is not limited to the configuration as described above, and it may be a head (thermal type) which uses a heater instead of the piezoelectric elements 50 as a vibration means. In such a head 1, the ink is heated and boiled by the heater, thereby increasing pressure within the reservoir chambers 21. As a result, the head 1 ejects the ink as droplets from the nozzles 11.

Alternative examples of the vibration means include a static actuator and the like. In the case where the vibration means is composed from the piezoelectric elements 50 like this embodiment, it is possible to easily control a degree of deflection which occurs to the vibration plate 40 and the sealing sheet 30. As a result, it is possible to easily control sizes of the droplets of the ink.

Next, a description will be made on the first bonding film 151, the second bonding film 152, the first bonding film 251, the second bonding film 252, the first bonding film 351, the second bonding film 352, the first bonding film 451*a*, the second bonding film 452*a*, the first bonding film 451*b*, and the second bonding film 452*b*. Hereinafter, the description will be made on, as a representative, the first bonding film 151 formed on the lower surface of the substrate 20.

Figure 4:
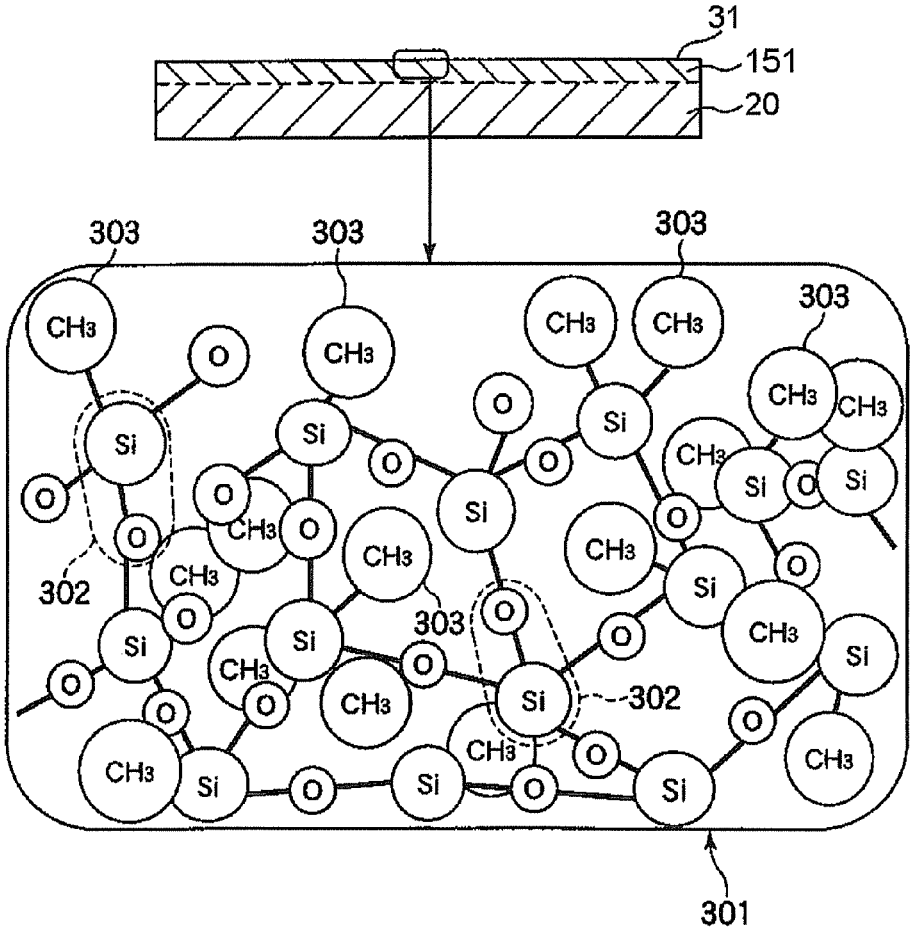
FIG. 4 is a partially enlarged view showing a state before energy is imparted to the first bonding film and a second bonding film which are provided in the ink jet type recording head according to the first embodiment.

As shown in FIG. 4, the first bonding film 151 to which no energy is imparted contains an Si-skeleton 301 having siloxane bonds (Si—O) 302, of which constituent atoms are randomly bonded to each other, and elimination groups 303 bonding to silicon atoms of the Si-skeleton 301.

Figure 5:
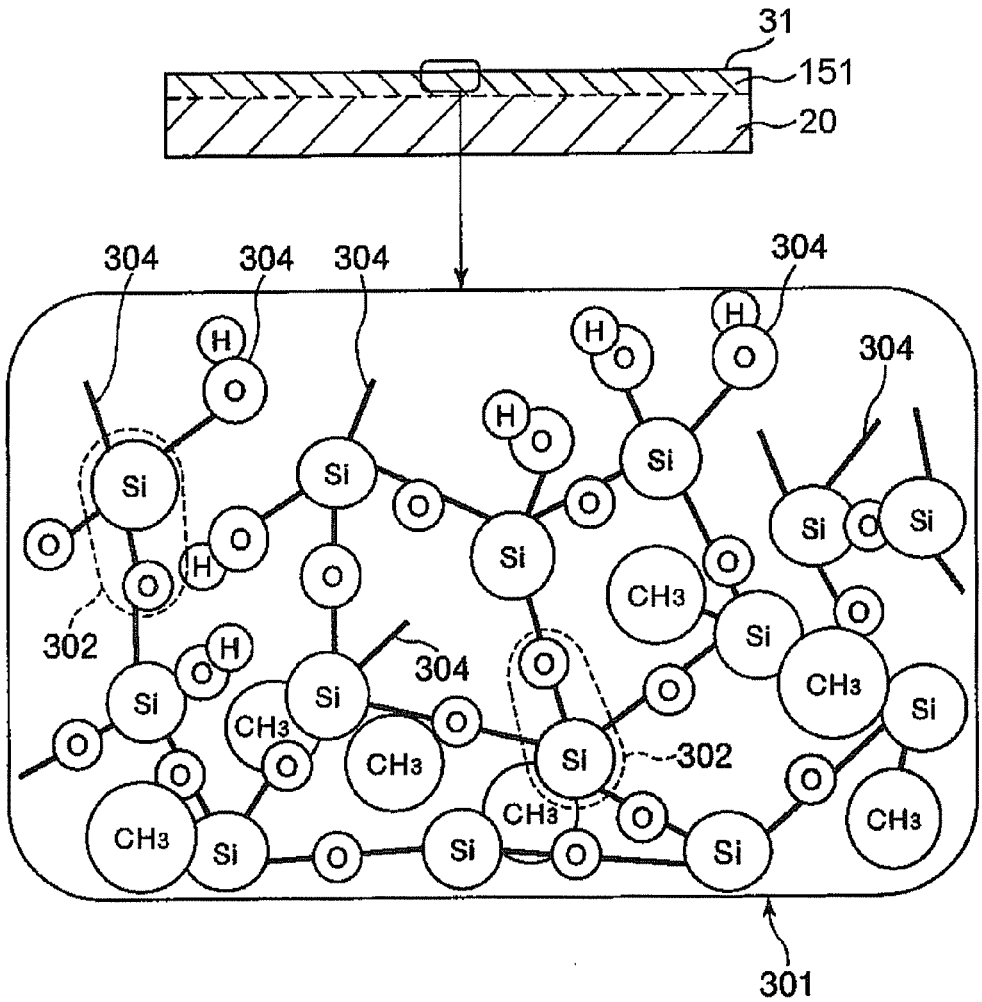
FIG. 5 is a partially enlarged view showing a state after energy is imparted to the first bonding film and the second bonding film which are provided in the ink jet type recording head according to the first embodiment.

As shown in FIG. 5, when energy is imparted to the first bonding film 151, a part of the elimination groups 303 is eliminated from the silicon atoms of the Si-skeleton 301, and as a result thereof active hands 304 are generated at such parts. In this way, bonding property is developed in the upper surface 31 of the bonding film 151 due to the active hands 304 as shown in FIG. 5. Therefore, the substrate 20 is bonded to the nozzle plate 10 through the first bonding film 151 and the second bonding film 152 due to such a bonding property.

Such a first bonding film 151 is a firm film which is difficult to be deformed due to the Si-skeleton 301 having siloxane bonds (Si—O) 302, of which constituent atoms are randomly bonded to each other. Therefore, a constant distance between the substrate 20 and the nozzle plate 10 is obtained in high dimensional accuracy, thereby volumes of the reservoir chambers 21 and the supply chamber 22 can be strictly controlled.

As a result, uniform volumes of the reservoir chambers 21 provided in the head 1 can be obtained. Consequently, it is possible to uniform sizes of the droplets of the ink which is ejected from the nozzles 11.

Further, since a fixed angle of the nozzle plate 10 can be strictly controlled, it is possible to maintain a constant ejecting direction of the droplets of the ink. For these reasons, prints of high quality are accomplished by an ink jet printer 9.

Furthermore, in the case where a plurality of heads 1 are manufactured, variations of qualities of prints that may be generated by using these heads 1 can be prevented. Therefore, it is possible to prevent variations of qualities of the prints made by the ink jet printers 9 provided with the heads 1 from occurring.

Heretofore, in the case where a substrate and a nozzle plate are bonded together by using an adhesive agent, there was a problem in that the adhesive agent is run out from a bonded part between the nozzle plate and the substrate. However, in the present invention, since the substrate 20 and the nozzle plate 10 are bonded together by using the first bonding film 151 and the second bonding film 152, such a problem does not occur.

Therefore, it is possible to prevent the adhesive agent run out from the bonded part from clogging ink paths formed in the head 1. Further, the present invention has an advantage in that a step for removing the adhesive agent can be omitted.

The first bonding film 151 has superior chemical resistance due to the firm Si-skeleton 301 described above. Therefore, even if the first bonding film 151 is exposed to the ink for a long period of time, it is possible to prevent the first bonding film 151 from being alterated and deteriorated.

As a result, it is ensured that the substrate 20 and the nozzle plate 10 are bonded to each other for a long period of time. According to the present invention, since liquid-tight property is sufficiently ensured in the head 1, it is possible to provide a head 1 having high reliability.

Further, the first bonding film 151 also has superior heat resistance due to the chemically stable Si-skeleton 301 described above. Therefore, even if the first bonding film 151 is exposed under a high temperature, it is also possible to reliably prevent the first bonding film 151 from being alterated and deteriorated.

Furthermore, such a first bonding film 151 is a solid-state film having no fluidity. For this reason, a thickness and a shape of the first bonding film 151 are hardly changed as compared to a conventional adhesive agent having fluidity in a liquid or viscous form. Therefore, the head 1 produced by using the first bonding film 151 has higher dimensional accuracy than that of a conventional head. Additionally, it is possible to firmly bond the substrate 20 and the nozzle plate 10 in a short time due to no time for curing the adhesive agent.

A sum of a content of silicon atoms and a content of oxygen atoms in the whole atoms (constituent atoms) constituting such a first bonding film 151 other than the hydrogen atoms is preferably in the range of about 10 to 90 atom % and more preferably in the range of about 20 to 80 atom %.

Such a sum of the contents makes it possible to form a firm network bond between the silicon atoms and the oxygen atoms, thereby enabling to obtain the firm first bonding film 151 in itself. Further, it is possible to obtain a first bonding film 151 having high bonding strength with respect to the substrate 20 and the nozzle plate 10.

An abundance ratio of the silicon atoms and the oxygen atoms contained in the first bonding film 151 is preferably in the range of about 3:7 to 7:3 and more preferably in the range of about 4:6 to 6:4. By setting the abundance ratio of the silicon atoms and the oxygen atoms to a value within the above range, the first bonding film 151 has high stability and can firmly bond the substrate 20 and the nozzle plate 10.

A crystallinity degree of the Si-skeleton 301 contained in the first bonding film 151 is preferably 45% or lower and more preferably 40% or lower. This makes it possible to randomly bond constituent atoms of the Si-skeleton 301. Therefore, characteristics of the Si-skeleton 301 described above are conspicuously exhibited, and therefore the first bonding film 151 has superior dimensional accuracy and bonding property.

It is preferred that the first bonding film 151 contains Si—H bonds in a chemical structure thereof. The Si—H bonds are formed in polymers obtained by polymerizing silane by a plasma polymerization. At this time, it is considered that the Si—H bonds prevent siloxane bonds from being regularly formed.

Therefore, the siloxane bonds are formed so as to avoid the Si—H bonds, which reduce regularity of the constituent atoms of the Si-skeleton 301. According to such a plasma polymerization, it is possible to efficiently form the Si-skeleton 301 having a low crystallinity degree.

The larger an amount of the Si—H bonds contained in the first bonding film 151 is, the smaller a low crystallinity degree of the Si-skeleton 301 is not. The first bonding film 151 is subjected to an infrared absorption measurement by an infrared absorption measurement apparatus to obtain an infrared absorption spectrum.

Then, when an intensity of a peak derived from a siloxane bond in the infrared absorption spectrum is defined as "1", an intensity of a peak derived from a Si—H bond in the infrared absorption spectrum is preferably in the range of about 0.001 to 0.2, more preferably in the range of about 0.002 to 0.05 and even more preferably in the range of about 0.005 to 0.02.

By setting the intensity of the peak derived from the Si—H bond with respect to the intensity derived from the siloxane bond to a value within the above range, the constituent atoms of the Si-skeleton 301 contained in the first bonding film 151 are more randomly bonded in comparison.

If the intensity of the peak derived from the Si—H bond with respect to the intensity derived from the siloxane bond falls within the above range, the first bonding film 151 has superior bonding strength, chemical resistance and dimensional accuracy.

As described above, the elimination groups 303 bonded to silicon atoms contained in the Si-skeleton 301 are eliminated from the silicon atoms contained in the Si-skeleton 301 so that the active hands 304 are generated at portions of the Si-skeleton 301 where the elimination groups 303 were existed.

In this way, the elimination groups 303 are relatively easily and uniformly eliminated from the silicon atoms by imparting energy. On the other hand, the elimination groups 303 are reliably bonded to the silicon atoms contained in the Si-skeleton 301 so as not to be eliminated therefrom when no energy is imparted.

From this viewpoint, the elimination groups 303 are preferably constituted of at least one selected from a group consisting of a hydrogen atom, a boron atom, a carbon atom, a nitrogen atom, an oxygen atom, a phosphorus atom, a sulfur atom, a halogen-based atom and an atom group in which these atoms are bonded to the constituent atoms of the Si-skeleton 301.

Such elimination groups 303 have relatively superior selectivity in bonding and eliminating to and from the silicon atoms by imparting energy. Therefore, the elimination groups 303 satisfy the needs as described above so that the first bonding film 151 has high bonding property.

Examples of the atom group in which the atoms described above are bonded to the constituent atoms of the Si-skeleton 301 include an alkyl group such as a methyl group and an ethyl group, an alkenyl group such as a vinyl group and an allyl group, an aldehyde group, a ketone group, a carboxyl group, an amino group, an amide group, a nitro group, a halogenated alkyl group, a mercapt group, a sulfone group, a cyano group, an isocyanate group and the like.

Among these groups mentioned above, the elimination groups 303 are preferably the alkyl group. Since an alkyl group has chemically high stability, the first bonding film 151 containing the alkyl group as the elimination groups 303 exhibits superior weather resistance and chemical resistance.

In the case where the elimination groups 303 are a methyl group (—$CH_3$), an amount of the methyl group is obtained from an intensity of a peak derived from the methyl group in an infrared absorption spectrum which is obtained by subjecting the first bonding film 151 to an infrared absorption measurement by an infrared absorption measurement apparatus as follows.

In the infrared absorption spectrum of the first bonding film 151, when an intensity of a peak derived from a siloxane bond is defined as "1", the intensity of the peak derived from the methyl group is preferably in the range of about 0.05 to 0.45, more preferably in the range of about 0.1 to 0.4 and even more preferably in the range of about 0.2 to 0.3. By setting the intensity of the peak derived from the methyl group with respect to the peak derived from the siloxane bond to a value within the above range, it is possible to appropriately form the siloxane bonds.

Further, since a necessary and sufficient number of the active hands 304 are formed in silicon atoms of the Si-skeleton 301 contained in the first bonding film 151, bonding property is developed in the first bonding film 151. Furthermore, sufficient weather property and chemical property are given to the first bonding film 151 due to bonding of the methyl group to the silicon atoms.

Examples of a constitute material of the first bonding film 151 having such features include a polymer containing siloxane bonds such as polyorganosiloxane and the like. In the case where the first bonding film 151 is constituted of polyorganosiloxane, the first bonding film 151 has superior mechanical property in itself.

Further, the first bonding film 151 also has superior bonding property to various materials. Therefore, the first bonding film 151 constituted of polyorganosiloxane can firmly bond the substrate 20 and the nozzle plate 10.

Polyorganosiloxane normally has repellency (non-bonding property). However, organic groups contained in polyorganosiloxane can be easily eliminated by imparting energy to polyorganosiloxane, so that polyorganosiloxane has hydrophilic property and develops bonding property. As a result, use of polyorganosiloxane makes it possible to easily and reliably control non-bonding property and bonding property.

In this regard, it is to be noted that the repellency (non-bonding property) is an effect due to alkyl groups contained in polyorganosiloxane. Therefore, the first bonding film 151 constituted of polyorganosiloxane has bonding property in regions of a surface thereof to which energy is imparted.

On the other hand, the first bonding film 151 constituted of polyorganosiloxane still has superior liquid repellency due to the alkyl groups described above in regions of the surface thereof to which no energy is imparted.

Therefore, by controlling the regions to which energy is imparted, superior liquid repellency is developed in the regions of the first bonding film 151 which is not in contact with both the substrate 20 and the nozzle plate 10 (second bonding film 152), namely a region of the first bonding film 151 on which the reservoir chambers 21 and the supply chamber 22 are formed.

As a result, when the head 1 included in an industrial ink jet printer using an organic ink which easily corrades resin materials is produced, the head 1 can have superior durability and high reliability.

Among polyorganosiloxane, the constituent material of the first bonding film 151 is preferably constituted of a polymer of octamethyltrisiloxane as a main component thereof. The first bonding film 151 constituted of the polymer of octamethyltrisiloxane as a main component thereof exhibits particularly superior bonding property. Therefore, such a first bonding film 151 is preferably used in the head 1 according to the present invention.

Further, octamethyltrisiloxane is a liquid form at a normal temperature and has appropriate viscosity. Therefore, octamethyltrisiloxane has an advantage in that it can be easily handled.

An average thickness of the first bonding film 151 is preferably in the range of about 1 to 1000 nm and more preferably in the range of about 2 to 800 nm. By setting the thickness of the first bonding film 151 to a value within the above rang, it is possible to firmly bond the substrate 20 and the nozzle plate 10 while preventing dimensional accuracy between the substrate 20 and the nozzle plate 10 from being conspicuously reduced.

In other words, if the thickness of the first bonding film 151 is smaller than the lower limit value noted above, there is a possibility that it is difficult to obtain sufficient bonding strength. On the other hand, if the thickness of the first bonding film 151 exceeds the upper limit value noted above, there is a possibility that the head 1 has conspicuously low dimensional accuracy.

If the thickness of the first bonding film 151 falls within the above noted range, the first bonding film 151 can have a certain degree of shape following property. Therefore, even if the lower surface of the substrate 20, namely the surface of the substrate 20 which is bonded to the first bonding film 151 is uneven, the first bonding film 151 can be bonded to the lower surface of the substrate 20 so as to follow the uneven surface of the substrate 20 through it depends on a degree of the unevenness of the uneven surface.

As a result, the first bonding film 151 can improve the uneven surface of such a substrate 20. Therefore, when the first bonding film 151 provided on the substrate 20 is bonded to the nozzle plate 10 through the second bonding film 152, it is possible to obtain high bonding property of the first bonding film 151 (second bonding film 152) to the nozzle plate 10 due to the improved uneven surface.

The shape following property described above is conspicuously exhibited according to a large thickness of the first bonding film 151. Therefore, in order to sufficiently ensure the shape following property of the first bonding film 151, the thickness of the first bonding film 151 is to be increased.

Such a first bonding film 151 may be produced by any method. Examples of the method of producing the first bonding film 151 include: various kind of gas-phase film formation methods such as a plasma polymerization method, a CVD method, and a PVD method; a method of producing the first bonding film 151 by imparting energy to a film which is obtained by using various kind of liquid-phase film formation methods. Among these methods mentioned above, the plasma polymerization method is preferable.

According to the plasma polymerization method, it is possible to efficiently produce a compact and homogenous first bonding film 151. Therefore, the first bonding film 151 produced by using the plasma polymerization method makes it possible to firmly bond the substrate 20 and the nozzle plate 10.

Further, the first bonding film 151 produced by using the plasma polymerization method can maintain a state activated by imparting energy for a long period of time. Therefore, it is possible to simplify and streamline the producing process of the head 1.

As described above, the description have been made for the first bonding film 151 but the same description can be applied to the second bonding film 152. According to the present embodiment, since the substrate 20 is bonded to the sealing sheet 30 through the first bonding film 251 and the second bonding film 252, bonding property between the substrate 20 and the sealing sheet 30 becomes high. As a result, it is possible to obtain both the reservoir chambers 21 and the supply chamber 22 having extremely high liquid-tight property.

In the present embodiment, since the sealing sheet 30 is bonded to the vibration plate 40 through the first bonding film 351 and the second bonding film 352, bonding property and propagation capability of deformation or strain between the vibration plate 40 and the sealing sheet 30 become high.

As a result, deformation or strain of the piezoelectric elements 50 can be reliably converted to pressure changes of the reservoir chambers 21. That is to say, it is possible to improve responses of displacements of both the vibration plate 40 and the sealing sheet 30.

Further, in the present embodiment, since a part of the upper surface of the vibration plate 40 is bonded to the piezoelectric elements 50 through the first bonding film 451*a* and the second bonding film 452*a*, bonding properties and propagation capabilities of deformation or strain between the vibration plate 40 and the piezoelectric elements 50 become high.

Heretofore, there is a problem in that deformation or strain of piezoelectric elements are allowed to attenuate due to an adhesive agent provided between the piezoelectric elements and a vibration plate before displacement of the vibration plate. However, according to the first bonding film 451*a* and the second bonding film 452*a*, deformation or strain of the piezoelectric elements 50 can be reliably converted to pressure changes of the reservoir chambers 21.

Furthermore, in the present embodiment, the case head 60 is bonded to the upper surface of the vibration plate 40 through the first bonding film 451*b* and the second bonding film 452*b*. That is to say, the case head 60 is bonded to a region of the upper surface of the vibration plate 40 other than the region to which the piezoelectric elements 50 are bonded.

Therefore, bonding property between the vibration plate 40 and the case head 60 becomes high. As a result, the vibration plate 40 is reliably supported by the case head 60, and it is possible to reliably prevent disalignment and warpage of the vibration plate 40, the sealing sheet 30, the substrate 20 and the nozzle plate 10 from being generated.

Hereinafter, descriptions will be made on a method of producing a first bonding film 151 on a base material 20' by using a plasma polymerization method and a method of producing a head 1 which includes the first bonding film 151 produced by the method.

FIGS. 6 to 9 are views (vertical section views) for describing a method of producing the ink jet type recording head (hereinafter simply referred to as "head 1"). In the following description, the upper side in FIGS. 6 to 9 will be referred to as "upper" and the lower side thereof will be referred to as "lower" for convenience of explanation.

The method of producing the head 1 according to the present embodiment includes the following eighteen steps.

Figure 6A:
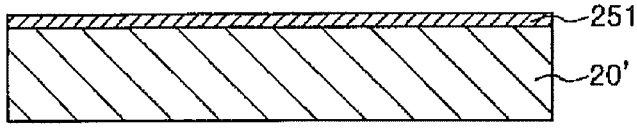
FIGS. 6A to 6F are views (vertical section views) for describing a method of producing the ink jet type recording head.
Figure 6B:
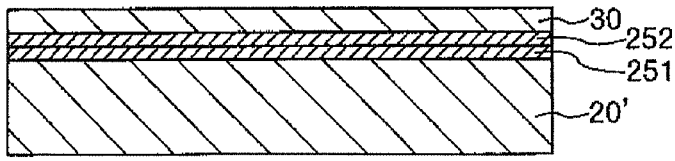

A first step is a step for forming a first bonding film 251 on an upper surface of the base material 20' (FIG. 6A). A second step is a step for forming a second bonding film 252 on a lower surface of a sealing sheet 30. A third step is a step for bonding the base material 20' and the sealing sheet 30 through the first bonding film 251 and the second bonding film 252 (FIG. 6B).

Figure 6C:
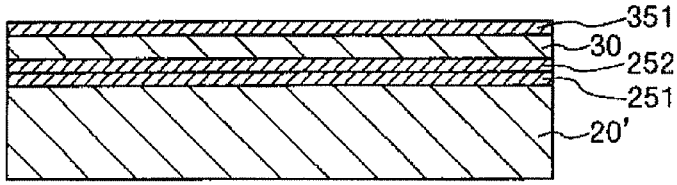
Figure 6D:
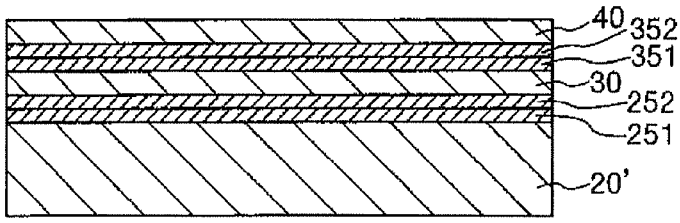

A fourth step is a step for forming a first bonding film 351 on an upper surface of the sealing sheet 30 (FIG. 6C). A fifth step is a step for forming a second bonding film 352 on a lower surface of a vibration plate 40. A sixth step is a step for bonding the sealing sheet 30 and the vibration plate 40 through the first bonding film 351 and the second bonding film 352 (FIG. 6D).

Figure 6E:
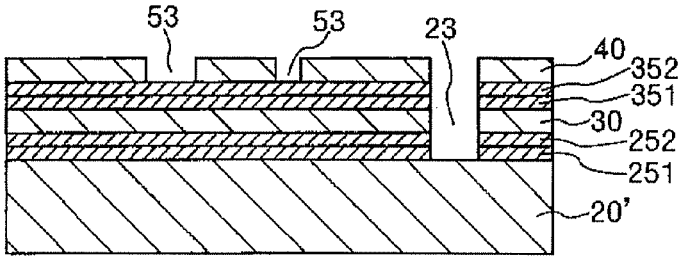
Figure 6F:
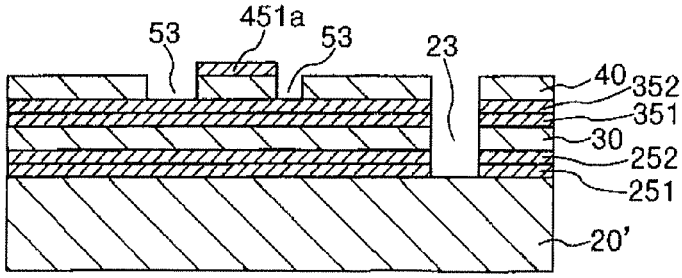

A seventh step is a step for forming a through-hole in corresponding regions of the first bonding film 251, the second bonding film 252, the sealing sheet 30, the first bonding film 351, the second bonding film 352 and the vibration plate 40 (FIG. 6E). An eighth step is a step for forming a concave portion 53 in a part of the vibration plate 40 (FIG. 6E). A ninth step is a step for forming a first bonding film 451*a* on a region of an upper surface of the vibration plate 40, which is surrounded by the concave portion 53 (FIG. 6F).

Figure 7G:
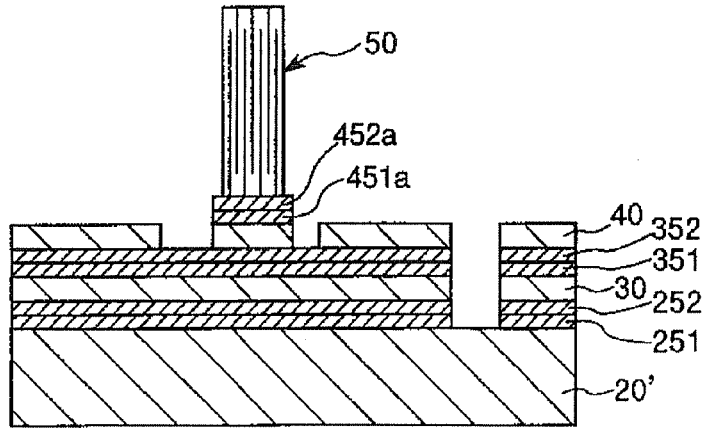
FIGS. 7G to 7I are views (vertical section views continued from FIG. 6F) for describing a method of producing the ink jet type recording head.
Figure 7H:
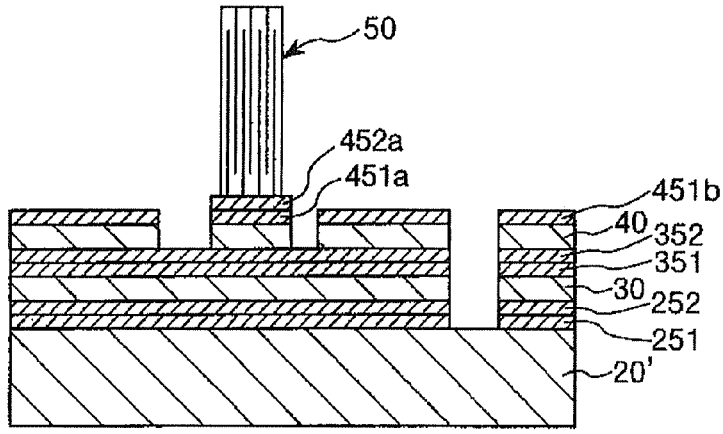

A tenth step is a step for forming a second bonding film 452*a* on lower surfaces of piezoelectric elements 50. A eleventh step is a step for bonding the vibration plate 40 and the piezoelectric elements 50 through the first bonding film 451*a* and the second bonding film 452*a* (FIG. 7G). A twelfth step is a step for forming a first bonding film 451*b* on a region other than the region of the upper surface of the vibration plate 40 (FIG. 7H).

Figure 7I:
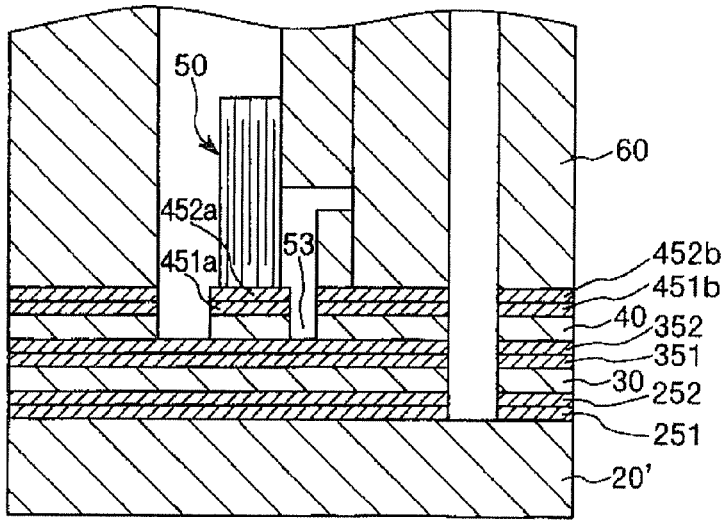
Figure 8J:
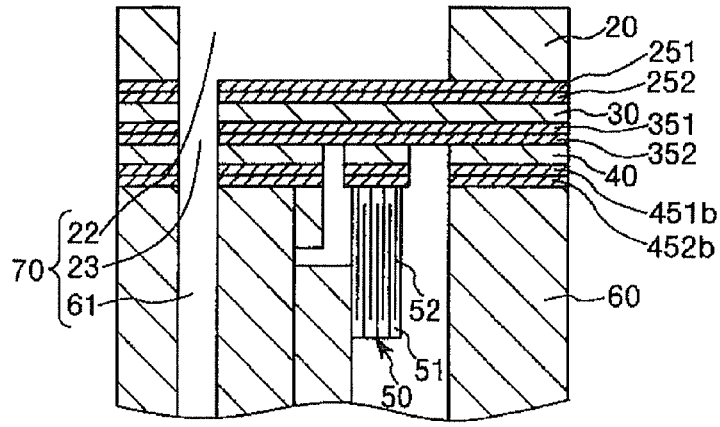
FIGS. 8J to 8L are views (vertical section views continued from FIG. 7I) for describing a method of producing the ink jet type recording head.

A thirteenth step is a step for forming a second bonding film 452*b* on a lower surface of a case head 60. A fourteenth step is a step for bonding the vibration plate 40 and the case head 60 through the first bonding film 451*b* and the second bonding film 452*b* (FIG. 7I). A fifteenth step is a step for forming a substrate 20 by processing the base material 20' (FIG. 8J).

Figure 8K:
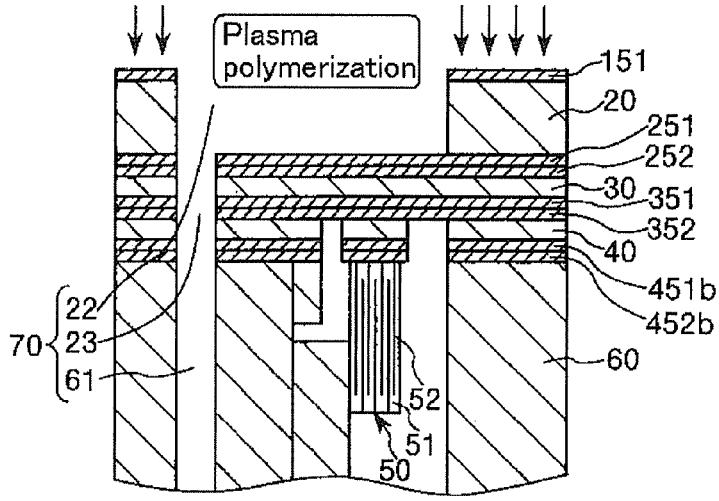
Figure 9M:
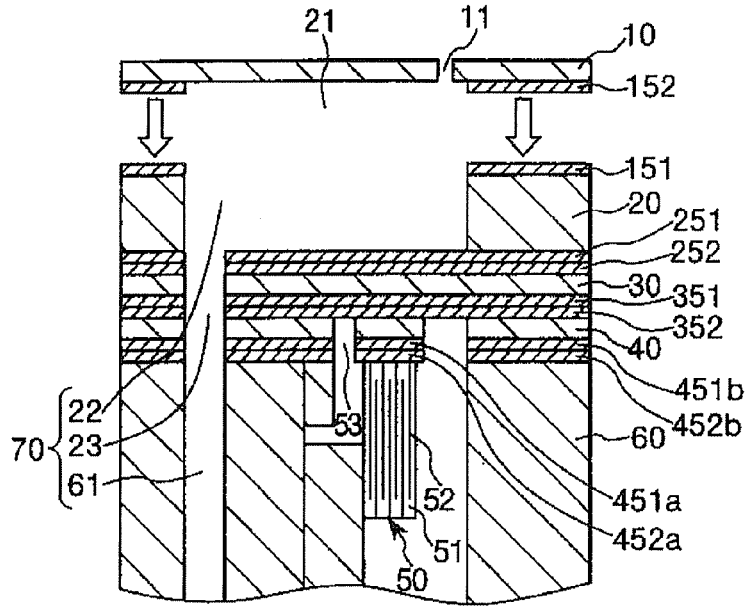
FIGS. 9M and 9N are views (vertical section views continued from FIG. 8L) for describing a method of producing the ink jet type recording head.
Figure 9N:
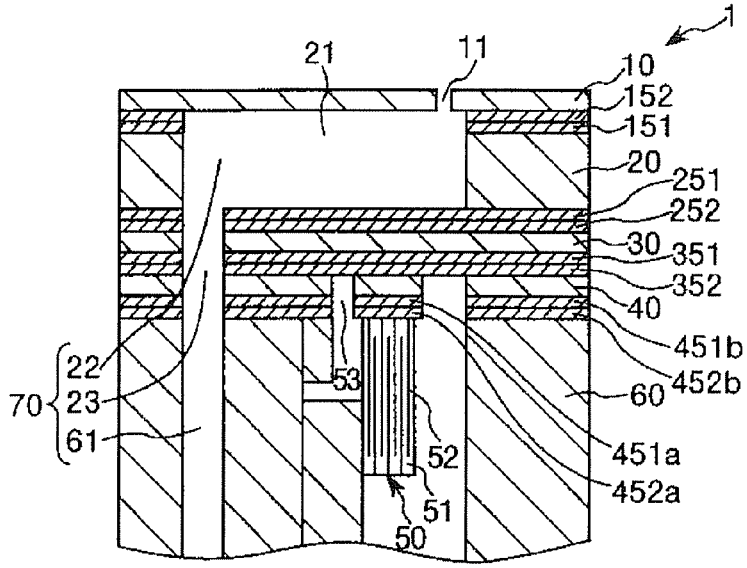

A sixteenth step is a step for forming a first bonding film 151 on an lower surface of the substrate 20 (FIG. 8K). A seventeenth step is a step for forming a second bonding film 152 on an upper surface of a nozzle plate 10 (FIG. 9M). An eighteenth step is a step for bonding the substrate 20 and the nozzle plate 10 through the first bonding film 151 and the second bonding film 152 (FIG. 9M and 9N).

Hereinafter, the steps will be described sequentially.

<1> First, the base material 20' is prepared for producing the substrate 20. The base material 20' is processed in a step described later to obtain the substrate 20.

Next, as shown in FIG. 6A, the first bonding film 251 is formed on the upper surface of the base material 20' (first step). Such a first bonding film 251 is in a state before imparting energy. A method of forming the first bonding film 251 is the same as that of the first bonding film 151 described later.

<2> Next, energy is imparted to the first bonding film 251. By doing so, bonding property is developed in the first bonding film 251. In this regard, it is to be noted that a method of imparting energy to the first bonding film 251 is the same as that to the first bonding film 151 described later.

<3> Next, the sealing sheet 30 is prepared. Then, the second bonding film 252 is formed on the lower surface of the sealing sheet 30 as shown in FIG. 6B (second step). In this regard, it is to be noted that a method of forming of the second bonding film 252 is also the same as that of the first bonding film 151 described later.

Next, energy is imparted to the second bonding film 252. By doing so, bonding property is developed in the second bonding film 252. Then, the sealing sheet 30 is made contact with the base material 20' so as to bond the first bonding film 251 and the second bonding film 252 which have obtained the bonding property. As a result, as shown in FIG. 6B, the base material 20' is bonded to the sealing sheet 30 through the first bonding film 251 and the second bonding film 252 (third step).

<4> Next, as shown in FIG. 6C, the first bonding film 351 is formed on the upper surface of the sealing sheet 30 (fourth step). Such a first bonding film 351 is a state before imparting energy. A method of forming the first bonding film 351 is the same as that of the first bonding film 151 described later.

<5> Next, energy is imparted to the bonding film 35. By doing so, bonding property is developed in the first bonding film 351. In this regard, it is to be noted that a method of imparting energy to the first bonding film 351 is the same as that of the first bonding film 151 described later.

<6> Next, the vibration plate 40 is prepared. Then, the second bonding film 352 is formed on the lower surface of the vibration plate 40 as shown in FIG. 6D (fifth step). In this regard, it is to be noted that a method for forming of the second bonding film 352 is also the same as that of the first bonding film 151 described later. Next, energy is imparted to the second bonding film 352. By doing so, bonding property is developed in the second bonding film 352.

Then, the vibration plate 40 is made contact with the sealing sheet 30 provided on the substrate 20 so as to bond the first bonding film 351 and the second bonding film 352 which have obtained the bonding property. As a result, as shown in FIG. 6D, the sealing sheet 30 is bonded to the vibration plate 40 through the first bonding film 351 and the second bonding film 352 (sixth step). As shown in FIG. 6D, the base material 20', the sealing sheet 30 and the vibration plate 40 are bonded together.

<7> Next, as shown in FIG. 6E, a through-hole 23 is formed in corresponding regions of the first bonding film 251, the second bonding film 252, the sealing sheet 30, the first bonding film 351, the second bonding film 352 and the vibration plate 40 (seventh step). Further, the concave portion 53 is formed in an annular shape on the upper surface of the vibration plate 40 which surrounds a region on which the piezoelectric elements 50 are to be provided (eighth step).

Examples of a method for forming the through-hole 23 and the concave portion 53 include: a physical etching method such as a dry-etching method, a reactive-on-etching method, a beam-etching method and a light-assist-etching method; a chemical etching such as a wet-etching method; and the like. These methods may be used singly or in combination of two or more of them.

<8> Next, as shown in FIG. 6F, the first bonding film 451*a* in a state of imparting no energy is formed on the region of the upper surface of the vibration plate 40 on which the piezoelectric elements 50 are to be provided (ninth step). In this regard, it is to be noted that a method of forming the first bonding film 451*a* is the same as that of the first bonding film 151 described later.

In the case where the first bonding film 451*a* is partially formed on a part of the region of the upper surface of the vibration plate 40, the first bonding film 451*a* may be formed by using a mask having a window portion of the shape corresponding to the shape of the region to which the first bonding film 451*a* is to be formed.

<9> Next, energy is imparted to the first bonding film 451*a*. By doing so, bonding property is developed in the first bonding film 451*a*. In this regard, it is to be noted that a method of imparting energy to the first bonding film 451*a* is the same as that of the first bonding film 151 described later.

<10> Next, the piezoelectric elements 50 are prepared. Then, the second bonding film 452*a* is formed on the lower surface of the piezoelectric elements 50 as shown in FIG. 7G (tenth step). In this regard, it is to be noted that a method for forming of the second bonding film 452*a* is also the same as that of the first bonding film 151 described later.

Next, energy is imparted to the second bonding film 452*a*. By doing so, bonding property is developed in the second bonding film 452*a*.

Then, the piezoelectric elements 50 are made contact with the vibration plate 40 so as to bond the first bonding film 451*a* and the second bonding film 452*a* which have obtained the bonding property. As a result, as shown in FIG. 7G, the piezoelectric elements 50 are bonded to the vibration plate 40 through the first bonding film 451*a* and the second bonding film 452*a* (eleventh step). As shown in FIG. 7G, the base material 20', the sealing sheet 30, the vibration plate 40 and the piezoelectric elements 50 are bonded together.

<11> Next, as shown in FIG. 7H, the first bonding film 451*b* in a state of imparting no energy is formed on a region of the upper surface of the vibration plate 40 on which the case head 60 is to be provided (twelfth step). The region is a region other than the region on which the piezoelectric elements 50 have been provided. In this regard, it is to be noted that a method of forming the first bonding film 451*b* is the same as that of the first bonding film 151 described later.

In the case where the first bonding film 451*b* is partially formed on a part of the region of the vibration plate 40, the first bonding film 451*b* may be formed by using a mask having a window portion of the shape corresponding to the shape of the region to which the first bonding film 451*b* is to be formed.

<12> Next, energy is imparted to the first bonding film 451*b*. By doing so, bonding property to the case head 60 is developed in the first bonding film 451*b*. In this regard, it is to be noted that a method of imparting energy to the first bonding film 451*b* is the same as that of the first bonding film 151 described later.

<13> Next, the case head 60 are prepared. Then, the second bonding film 452*b* is formed on the lower surface of case head 60 as shown in FIG. 7I (thirteenth step). In this regard, it is to be noted that a method for forming of the second bonding film 452*b* is also the same as that of the first bonding film 151 described later.

Next, energy is imparted to the second bonding film 452*b*. By doing so, bonding property is developed in the second bonding film 452*b*.

Then, the case head 60 is made contact with the vibration plate 40 so as to bond the first bonding film 451*b* and the second bonding film 452*b* which have obtained the bonding property. As a result, as shown in FIG. 7I, the case head 60 is bonded to the vibration plate 40 through the first bonding film 451*b* and the second bonding film 452*b* (fourteenth step). As shown in FIG. 7I, the base material 20', the sealing sheet 30, the vibration plate 40, the piezoelectric elements 50 and the case head 60 are bonded together.

<14> Next, the base material 20' provided with the sealing sheet 30, the vibration plate 40, the piezoelectric elements 50 and the case head 60 is turn over as shown in FIG. 8J. An opposite surface of the base material 20' to the sealing sheet 30 is processed to obtain the substrate 20 so that concave portions that serve as the reservoir chambers 21 are formed (FIG. 8J) (fifteenth step). Further, a through-hole that serves as the supply chamber 22 is also formed (FIG. 8J) (fifteenth step).

Further, the supply chamber 22 is communicated with the through-hole 23 which is formed by passing through the first bonding film 251, the second bonding film 252, the sealing sheet 30, the first bonding film 351, the second bonding film 352, the vibration plate 40, the first bonding film 451*b*, and the second bonding film 452*b*, and it is a also communicated with a supply path 61 of the ejection liquid provided in the case head 60, thereby forming a reserve 70.

Examples of a processing method of the base material 20' include various type etching methods as described above. As described above, in the present embodiment, the reservoir chambers 21 and the supply chamber 22 are formed by processing the base material 20' which is provided with the sealing sheet 30, the vibration plate 40, the piezoelectric elements 50 and the case head 60. However, the reservoir chambers 21 and the supply chamber 22 may be preliminarily formed in the base material 20' at the time of the step <1> (first step).

<15> Next, the nozzle plate 10 is bonded on the opposite surface (lower surface) of the substrate 20 to the sealing sheet 30 (eighteenth step). Hereinafter, a description will be made on a method of bonding the substrate 20 and the nozzle plate 10 in detail.

First, the first bonding film 151 in a state of imparting no energy is formed on the opposite surface (lower surface) of the substrate 20 which is provided with the sealing sheet 30, the vibration plate 40, the piezoelectric elements 50 and the case head 60 by a plasma polymerization method as shown in FIG. 8K (sixteenth step).

The plasma polymerization method is a method that a mix gas of a raw gas and a carrier gas is supplied in an intense electric field, molecules contained in the raw gas are polymerized to obtain polymers, and then the polymers are deposited on the substrate 20 to obtain a film.

Hereinafter, a description will be made on a method of producing the first bonding film 151 by using the plasma polymerization method. First, prior to the description of the method of producing the first bonding film 151, a description will be made on a plasma polymerization apparatus used for producing the first bonding film 151 on the substrate 20 by using the plasma polymerization method. Thereafter, the description will be made on the method of producing the first bonding film 151.

Figure 10:
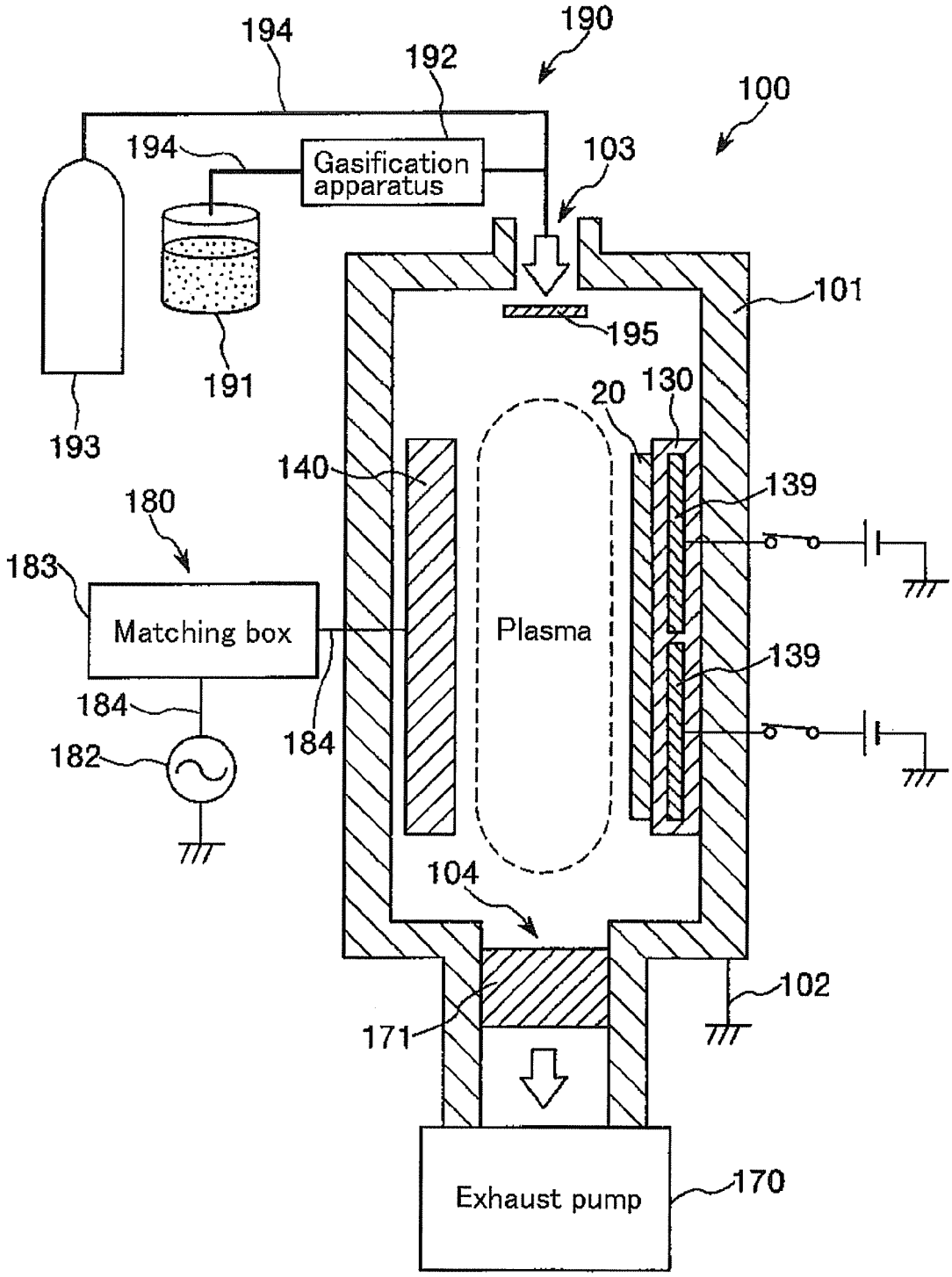
FIG. 10 is a vertical section view schematically showing a plasma polymerization apparatus used for producing the first bonding film and the second bonding film provided in the ink jet type recording head according to the first embodiment.

FIG. 10 is a vertical section view schematically showing a plasma polymerization apparatus used for producing the first bonding film and the second bonding film provided in the ink jet type recording head according to the present embodiment. In the following description, the upper side in FIG. 10 will be referred to as "upper" and the lower side thereof will be referred to as "lower" for convenience of explanation.

The plasma polymerization apparatus shown in FIG. 10 includes a chamber 101, a first electrode 130 formed on an inner surface of the chamber 101, a second electrode 140 facing the first electrode 130, a power circuit 180 for applying a high-frequency voltage between the first electrode 130 and the second electrode 140, a gas supply part 190 for supplying a gas into the chamber 101, and a exhaust pump 170 for exhausting the gas supplied into the chamber 101 by the gas supply part 190.

Among these parts, the first electrode 130 and the second electrode 140 are provided in the chamber 101. Hereinafter, a description will be made on these parts in detail.

The chamber 101 is a vessel that can maintain air-tight condition of an inside thereof. Since the chamber 101 is used in a state of a reduced pressure (vacuum) of the inside thereof, the chamber 101 has pressure resistance property which is property that can withstand a pressure difference between the inside and an outside of the chamber 101.

The chamber 101 shown in FIG. 10 is composed from a chamber body of a substantially cylindrical shape, of which axial line is provided along a vertical direction. A supply opening 103 is provided in an upper side of the chamber 101. An exhaust opening 104 is provided in a lower side of the chamber 101. A gas pipe 194 of the gas supply part 190 is connected to the supply opening 103. The exhaust pump 170 is connected to the exhaust opening 104.

In the present embodiment, the chamber 101 is constituted of a metal material having high conductive property and is electrically grounded through a grounding conductor 102.

The first electrode 130 has a plate shape and supports the substrate 20. In other words, the substrate 20 is provided on the surface of the first electrode 130. The first electrode 130 is provided on the inner surface of the chamber 101 along a vertical direction. In this way, the first electrode 130 is electrically grounded through the chamber 101 and the grounding conductor 102. In this regard, it is to be noted that the first electrode 130 is formed in a concentric manner as the chamber body.

An electrostatic chuck (attraction mechanism) 139 is provided in the first electrode 130. As shown in FIG. 10, the substrate 20 can be attracted by the electrostatic chuck 139 along a vertical direction. With this structure, even if some warpage have been formed to the substrate 20, the substrate 20 can be subjected to a plasma treatment in a state that the warpage is corrected by attracting the substrate 20 to the electrostatic chuck 139.

The second electrode 140 is provided in facing the first electrode 130 through the substrate 20. In this regard, it is to be noted that the second electrode 140 is provided in a spaced-apart relationship (a state of insulating) with the inner surface of the chamber 101.

A high-frequency power 182 is connected to the second electrode 140 through a wire 184 and a matching box 183. The matching box 183 is provided on the way of wire 184 which is provided between the second electrode 140 and the high-frequency power 182. The power circuit 180 is composed from the wire 184, the high-frequency power 182 and the matching box 183.

According to the power circuit 180, a high-frequency voltage is applied between the first electrode 130 and the second electrode 140 due to ground of the first electrode 130. Therefore, an electric field in which a movement direction of an electronic charge carrier is alternated in high frequency is formed between the first electrode 130 and the second electrode 140.

The gas supply part 190 supplies a predetermined gas into the chamber 101. The gas supply part 190 shown in FIG. 10 has a liquid reservoir part 191 for reserving a film material in a liquid form (raw liquid), a gasification apparatus 192 for changing the film material in the liquid form to the film material in a gas form, and a gas cylinder 193 for reserving a carrier gas.

The liquid reservoir part 191, the gasification apparatus 192, the gas cylinder 193 and the supply part 103 of the chamber 101 are connected with a wire 194. A mixture gas of the film material in the gas form and the carrier gas are supplied from the supply part 103 into the chamber 101.

The film material in the liquid form reserved in the liquid reservoir part 191 is a raw material that is polymerized by using the plasma polymerization apparatus 100 so that a polymerization film is formed on the surface of the substrate 20. Such a film material in the liquid form is gasified by the gasification apparatus 192, thereby changing to the film material in the gas form (raw gas). Then, the film material in the gas form is supplied into the chamber 101. In this regard, the raw gas will be described later in detail.

The carrier gas reserved in the gas cylinder 193 is discharged in the electric field and supplied in the chamber 101 in order to maintain the discharge. Examples of such a carrier gas include Ar gas, He gas and the like. A diffuser plate 195 is provided near the supply part 103 of the inside of the chamber 101.

The diffuser plate 195 has a function of accelerating diffusion of the mixture gas supplied into the chamber 101. This makes it possible to uniformly diffuse the mixture gas in the chamber 101.

The exhaust pump 170 exhausts the mixture gas in the chamber 101 and is composed from a oil-sealed rotary pump, a turbo-molecular pump or the like. By exhausting an air and reducing pressure in the chamber 101, it is possible to easily change the mixture gas to plasma.

Further, it is also possible to prevent the substrate 20 from being contaminated or oxidized by contacting with the atmosphere. Furthermore, it is also possible to efficiently remove reaction products obtained by subjecting the substrate 20 to plasma polymerization apparatus 100 from the inside of the chamber 101.

A pressure control mechanism 171 for adjusting the pressure in the chamber 101 is provided in the exhaust opening 104. This makes it possible to appropriately set the pressure in the chamber 101 depending on a supply amount of the mixture gas.

Next, a description will be made on a method of forming the first bonding film 151 on the substrate 20 on which the sealing sheet 30, the vibration plate 40, the piezoelectric elements 50 and the case head 60 are provided (hereinafter simply referred to as "substrate 20").

<15-1> First, the substrate 20 is placed in the chamber 101 of the plasma polymerization apparatus 100 so that the case head 60 provided on the substrate 20 is in contact with the first electrode 130 of the plasma polymerization apparatus 100. Then, the chamber 101 is sealed. Thereafter, the pressure inside the chamber 101 is reduced by activating the exhaust pump 170.

Next, the mixture gas of the raw gas and the carrier gas is supplied into the chamber 101 by activating the gas supply part 190, thereby the chamber 101 is filled with the supplied mixture gas.

A ratio (mix ratio) of the raw gas in the mixture gas is preferably set in the range of about 20 to 70% and more preferably in the range of about 30 to 60%, though the ratio is slightly different depending on a kind of raw gas or carrier gas and an intended deposition speed. This makes it possible to optimize conditions for forming (depositing) the polymerization film (that is, the first bonding film 151).

A flow rate of the supplying mixture gas, namely each of the raw gas and the carrier gas, is appropriately decided depending on a kind of raw gas or carrier gas, an intended deposition speed, a thickness of a film to be formed or the like. The flow rate is not particularly limited but normally is preferably set in the range of about 1 to 100 ccm and more preferably in the range of about 10 to 60 ccm.

Next, the high-frequency voltage is applied between the first electrode 130 and the second electrode 140 by activating the power circuit 180. In this way, molecules contained in the raw gas which exists between the first electrode 130 and the second electrode 140 are allowed to ionize, thereby generating plasma. Then, the molecules contained in the raw gas are polymerized by plasma energy to obtain polymers, thereafter the obtained polymers are allowed to adhere and are deposited. As a result, as shown in FIG. 8K, the first bonding film 151 which is constituted of a plasma polymerization film is formed on the one surface of the substrate 20 (sixteenth step).

In this regard, the one surface of the substrate 20 is activated and cleared by the action of the plasma. Therefore, the polymers of the molecules contained in the raw gas are easily deposited on the one surface of the substrate 20. As a result, it is possible to reliably form a first bonding film 151 stably. According to the plasma polymerization method, it is possible to obtain high bonding strength between the substrate 20 and the first bonding film 151 despite of a constituent material of the substrate 20.

Examples of the raw gas to be contained in the mixture gas include organosiloxane such as methyl siloxane, octamethyl trisiloxane, decamethyl tetrasilixane, decamethyl cyclopentasiloxane, octamethyl cyclotetrasiloxane, and methylphenylsiloxane and the like.

The plasma polymerization film obtained by using such a raw gas, namely the first bonding film 151 (polymers) is obtained by polymerizing the raw materials thereof. That is to say, the first bonding film 151 is constituted of polyorganosiloxane.

In the plasma polymerization, a frequency of the high-frequency voltage applied between the first electrode 130 and the second electrode 140 is not particularly limited to a specific value, but is preferably in the range of about 1 kHz to 100 MHz and more preferably in the range of about 10 to 60 MHz.

An output density of the high-frequency voltage is not particularly limited to a specific value, but is preferably in the range of about 0.01 to 100 W/cm$^2$, more preferably in the range of about 0.1 to 50 W/cm$^2$ and even more preferably in the range of about 1 to 40 W/cm$^2$.

By setting the output density of the high-frequency voltage to a value within the above range, it is possible to reliably form the Si-skeleton 301 of which constituent atoms are randomly bonded to each other while preventing excessive plasma energy from being imparted to the raw gas due to too high output density of the high-frequency voltage.

If the output density of the high-frequency voltage is smaller than the lower limit value noted above, the molecules contained in the raw gas can not be polymerized. Therefore, there is a possibility that the first bonding film 151 can not be formed.

On the other hand, if the output density of the high-frequency voltage exceeds the upper limit value noted above, the molecules contained in the raw gas is decomposed and the elimination groups 303 are eliminated from the silicon atoms of Si-skeleton 301 of the molecules contained in the raw gas. As a result, there are possibilities that a content of the elimination group 303 contained in the Si-skeleton 301 constituting the first bonding film 151 is greatly lowered and it is difficult to randomly bond the constituent atoms of the Si-skeleton 301.

An inside pressure of the chamber 101 during the deposition is preferably in the range of about $133.3\times10^{-5}$ to 1333 Pa ($1\times10^{-5}$ to 10 Torr) and more preferably in the range of about $133.3\times10^{-4}$ to 133.3 Pa ($1\times10^{-4}$ to 1 Torr).

A flow rate of the raw gas is preferably in the range of about 0.5 to 200 sccm and more preferably in the range of about 1 to 100 sccm. A flow rate of the carrier gas is preferably in the range of about 5 to 750 sccm and more preferably in the range of about 10 to 500 sccm.

A time required for the deposition is preferably in the range of about 1 to 10 minuets and more preferably in the range of about 4 to 7 minuets. A thickness of the deposited first bonding film 151 is proportional to the time required for the deposition. Therefore, it is possible to easily adjust the thickness of the first bonding film 151 by only adjusting the time required for the deposition.

Heretofore, in the case where a substrate is bonded to a nozzle plate by using an adhesive agent, a thickness of the adhesive agent can not be strictly controlled. However, according to the first bonding film 151 of this embodiment, since the thickness of the first bonding film 151 can be strictly controlled, it is possible to strictly control a distance between the substrate 20 and the nozzle plate 10.

A temperature of the substrate 20 is preferably 25° C. or higher and more preferably in the range of about 25 to 100° C.

As described above, the first bonding film 151 can be obtained. In the case where the first bonding film 151 is partially formed in only a region of the surface of the substrate 20 to which the nozzle plate 10 is to be bonded, the first bonding film 151 may be deposited (formed) by using a mask having a window in the shape which corresponds to the shape of the region of the substrate 20 on which the first bonding film 151 is to be formed.

<15-2> Next, energy is imparted to the first bonding film 151 which is formed on the substrate 20.

As shown in FIG. 4, the elimination groups 302 are eliminated form the silicon atoms of the Si-skeleton 301 constituting the first bonding film 151 by imparting energy. After elimination of the elimination groups 302, the active hands 304 are generated in an upper side and inside of the Si-skeleton 301 constituting the first bonding film 151 as shown in FIG. 5. As a result, bonding property is developed in the surface of the first bonding film 151 due to the active hands 304.

A method of imparting energy to the first bonding film 151 is not particularly limited but examples of such a method include: (I) a method of imparting energy beam to the first bonding film 151; (II) a method of heating the first bonding film 151; (III) a method of compressing the first bonding film 151 (imparting physical energy to the first bonding film 151); (IV) a method of exposing the first bonding film 151 to plasma (imparting plasma energy to the first bonding film 151); (V) a method of exposing the first bonding film 151 to ozone gas (imparting chemical energy to the first bonding film 151); and the like.

Among these methods mentioned above, the method of imparting energy to the first bonding film 151 is preferably at least the method (I), the method (II) and the method (III) described above. According to these methods, energy is relatively easily and sufficiently imparted to the first bonding film 151.

Hereinafter, a description will be made on the method (I), the method (II) and the method (III) described above.

Method (I)

Examples of the energy beam include: a ray such as an ultraviolet ray and a laser beam; a particle beam such as a X-ray, a γ-ray, an electron beam and an ion beam; and combinations of two or more kinds of these energy beams.

Figure 8L:
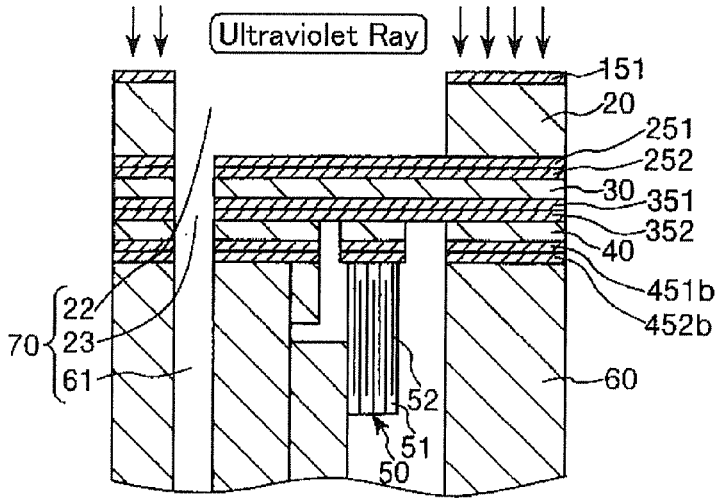

Among these energy beams mentioned above, it is particularly preferred that a wavelength of the ultraviolet ray is in the range of about 150 to 300 nm (see FIG. 8L). Use of the ultraviolet ray having such a wavelength makes it possible to optimize an amount of the energy to be imparted to the first bonding film 151.

As a result, the elimination groups 303 bonded to the silicon atoms contained in the Si-skeleton 301 can be reliably eliminated therefrom while preventing the Si-skeleton 301 constituting the first bonding film 151 from being destroyed more than necessary. This makes it possible for the first bonding film 151 to develop bonding property, while preventing characteristics thereof such as mechanical characteristics or chemical characteristics from being reduced.

Further, the use of the ultraviolet ray makes it possible to process a wide area of the surface of the first bonding film 151 without unevenness in a short period of time. Therefore, the removal (elimination) of the elimination groups 303 can be efficiently performed.

Moreover, such an ultraviolet ray has, for example, an advantage that it can be generated by simple equipment such as an UV lamp. In this regard, it is to be noted that the wavelength of the ultraviolet ray is more preferably in the range of about 160 to 200 nm.

In the case where the UV lamp is used, power of the UV lamp is preferably in the range of about 1 $mW/cm^2$ to 1 $W/cm^2$ and more preferably in the range of about 5 to 50 $mW/cm^2$, although being different depending on an area of the surface of the first bonding film 151. In this case, a distance between the UV lamp and the first bonding film 151 is preferably in the range of about 3 to 3000 mm and more preferably in the range of about 10 to 1000 mm.

Further, a time for irradiating the ultraviolet ray is preferably set to a time enough for eliminating the elimination groups 303 from the vicinity of the surface of the first bonding film 151, i.e., a time enough for preventing a large amount of the elimination groups 303 from being eliminated from the silicon atoms of the Si-skeleton 301.

Specifically, the time is preferably in the range of about 0.5 to 30 minutes and more preferably in the range of about 1 to 10 minutes, although being slightly different depending on an amount of the ultraviolet ray, a constituent material of the first bonding film 151 and the like. The ultraviolet ray may be irradiated temporally continuously or intermittently (in a pulse-like manner).

On the other hand, examples of the laser beam include: an excimer laser (femtosecond laser), an Nd-YAG laser, an Ar laser, a $CO_2$ laser, a He—Ne laser and the like.

Further, the irradiation of the energy beam on the first bonding film 151 may be performed in any atmosphere. Specifically, examples of the atmosphere include: an oxidizing gas atmosphere such as atmosphere (air) and an oxygen gas; a reducing gas atmosphere such as a hydrogen gas; an inert gas atmosphere such as a nitrogen gas and an argon gas; a decompressed (vacuum) atmosphere obtained by decompressing these atmospheres; and the like.

Among these atmospheres mentioned above, the irradiation is particularly preferably performed in the atmosphere. As a result, it becomes unnecessary to spend labor hour and cost for controlling the atmosphere. This makes it possible to easily perform (carry out) the irradiation of the energy beam.

In this way, according to the method of irradiating the energy beam, the energy can be easily imparted to the surface of the first bonding film 151 selectively. Therefore, it is possible to prevent, for example, alteration and deterioration of the substrate 20 by imparting the energy.

Further, according to the method of irradiating the energy beam, a degree of the energy to be imparted can be accurately and easily controlled. Therefore, it is possible to adjust the number of the elimination groups 303 to be eliminated from the silicon atoms contained in the first bonding film 151. By adjusting the number of the elimination groups 303 to be eliminated from the silicon atoms contained in the first bonding film 151 in this way, it is possible to easily control bonding strength between the first bonding film 151 and the nozzle plate 10.

In other words, by increasing the number of the elimination groups 303 to be eliminated, since a large number of active hands 304 are generated in the vicinity of the surface and inside of the first bonding film 151, it is possible to further improve bonding property developed in the first bonding film 151.

In order to adjust magnitude of the imparted energy, for example, conditions such as the kind of the energy beam, the power of the energy beam, and the irradiation time of the energy beam only have to be controlled. Moreover, according to the method of irradiating the energy beam, since large energy can be imparted in a short period of time, it is possible to more efficiently impart energy on the first bonding film 151.

Method (II)

A heating temperature is preferably in the range of about 25 to 100° C. and more preferably in the range of about 50 to 100° C. By heating the first bonding film 151 at such a heating temperature within the above range, the first bonding film 151 can be reliably activated while reliably preventing the substrate 20 and the like from being alterated or deteriorated by the heat.

A heating time may be enough time for capable of cutting molecular bonds of the Si-skeleton 301 contained in the first bonding film 151. Specifically, if the heating temperature falls within the above noted range, the heating time is preferably in the range of about 1 to 30 minutes.

Further, the first bonding film 151 may be heated by any methods. Examples of such a method include various kinds of heating methods such as a method of using a heater, a method of irradiating an infrared ray, a method of contacting with a flame and the like.

In the case where a coefficient of thermal expansion of the substrate 20 is the same as that of the nozzle plate 10, the first bonding film 151 may be heated by the conditions described above. On the other hand, in the case where the coefficient of thermal expansion of the substrate 20 is different from that of the nozzle plate 10, it is preferred that the bonding is carried out at a temperature as low as possible. By doing so, it is possible to reliably reduce thermal stress which would be generated on an interfacial surface between the first bonding film 151 and the second bonding film 152.

Method (III)

In the present embodiment, the description is made on the case in which energy is imparted to the first bonding film 151 before bonding the substrate 20 and the nozzle plate 10 together. Such energy may be imparted after bonding the substrate 20 and the nozzle plate 10.

In other words, after the first bonding film 151 is formed on the surface of the substrate 20 and before energy is imparted, the first bonding film 151 provided on the substrate 20 may be in contact with the second bonding film 152 provided on the nozzle plate 10 so as to bond the first bonding film 151 and the second bonding film 152 to obtain a pre-bonding body.

Then, by imparting energy to the first bonding film 151 and the second bonding film 152 contained in the pre-bonding body, bonding property is developed in the first bonding film 151 and the second bonding film 152. As a result, the substrate 20 is bonded to the nozzle plate 10 through the first bonding film 151 and the second bonding film 152.

In this case, a method of imparting energy to the first bonding film 151 and the second bonding film 152 may be used in any methods (I) to (III) described above. A compressing force to be used in the method (III) is preferably in the range of about 0.2 to 10 MPa and more preferably in the range of about 1 to 5 MPa in a direction in which the substrate 20 and the nozzle plate 10 are approached to each other.

This makes it possible to easily impart appropriate energy to the first bonding film 151 and the second bonding film 152 by only compression, thereby developing sufficient bonding property in the first bonding film 151 and the second bonding film 152. In this regard, if the compressing force exceeds the upper limit value noted above, there is a possibility that the substrate 20 and nozzle plate 10 are damaged.

A compressing time is not particularly limited to a specific value, but is preferably in the range of about 10 seconds to 30 minutes. The compressing time may be appropriately changed depending on a quantity of the compressing force. Specifically, the larger the compressing force is, the shorter the compressing time is.

In a state of the pre-bonding body, the substrate 20 is not bonded to the nozzle plate 10. Therefore, it is possible to easily adjust a relative position between the substrate 20 and the nozzle plate 10. As a result, by finely adjusting the relative position between the substrate 20 and the nozzle plate 10 after the pre-bonding body is obtained, it is possible to reliably obtain high accuracy (dimensional accuracy) for producing the finally obtained head 1.

By the method (I), the method (II) and the method (III) as described above, energy can be imparted to the first bonding film 151 and the second bonding film 152. Such energy may be imparted on the whole surfaces of the first bonding film 151 and the second bonding film 152 but a part of the surfaces thereof.

By doing so, it is possible to control regions of the surfaces of the first bonding film 151 and the second bonding film 152 in which bonding property is developed. Further, by appropriately adjusting areas and shapes of the regions, it is possible to prevent a stress occurring in the interfacial surface between the first bonding film 151 and the second bonding film 152 from being locally centralized.

Even if a difference between the coefficient of thermal expansion of the substrate 20 and the coefficient of thermal expansion of the nozzle plate 10 is large, it is possible to reliably bond the substrate 20 and the nozzle plate 10 together through the first bonding film 151 and the second bonding film 152.

As described above, the first bonding film 151 in a sate before energy is imparted has the Si-skeleton 301 and the elimination groups 303 as shown in FIG. 4. When energy is imparted on the surface of the first bonding film 151, the elimination groups 303 (methyl groups in the present embodiment) are eliminated from the silicon atoms of the Si-skeleton 301.

In this way, the active hands 304 are generated in the vicinity of the surface of the first bonding film 151, namely in the silicon atoms (in the present embodiment), thereby being activated. As a result, bonding property is developed in the vicinity of the surface of the first bonding film 151.

In this regard, it is to be noted that the phrase "the first bonding film 151 is activated" means any one of the following states. The first state is a state that the elimination groups 303 bonded to the silicon atoms in the surface and inside of the first bonding film 151 are eliminated, thereby generating bonding hands not to be end-capped in the silicon atoms of the Si-skeleton 301 (hereinafter simply referred to as "non-bonding hands" or "dangling-bond").

The second state is a state that the bonding hands are end-capped by hydroxyl groups (OH groups). The third state is a state that the first state and the second state are co-existed.

Therefore, the active hands 304 mean the non-bonding hands (dangling-bond) or hands in which the bonding hands are end-capped by hydroxyl groups. According to such active hands 304, it is possible to firmly bond the first bonding film 151 against the nozzle plate 10. In this regard, the second state can be easily obtained by irradiating energy beam to the surface of the first bonding film 151 in the atmosphere and then end-capping the non-bonding hands with the hydroxyl groups of moisture contained in the air.

<15-3> Next, the nozzle plate 10 is prepared.

Next, the second bonding film 152 is formed on the lower surface of the nozzle plate 10 (FIG. 9M) (seventeenth step), that is, on the upper surface of the nozzle plate 20 in FIG. 2. A method of forming the second bonding film 152 is also the same as that of the first bonding film 151 described above. Next, energy is imparted to the second bonding film 152. As a result, bonding property is developed in the second bonding film 152.

As shown in FIG. 9M, the nozzle plate 10 is made contact with the substrate 20 so that the first bonding film 151 and the second bonding film 152 which have developed the bonding property (eighteenth step) are bonded together. This makes it possible to bond the substrate 20 and the nozzle plate 10 through the first bonding film 151 and the second bonding film 152 as shown in FIG. 9N.

It is preferred that the coefficient of thermal expansion of the substrate 20 is substantially equal to that of the nozzle plate 10. If the coefficient of thermal expansion of the substrate 20 is substantially equal to that of the nozzle plate 10, it becomes difficult that stress in the interfacial surface between the first bonding film 151 and the second bonding film 152 occurs when they are in contact with each other. As a result, it is possible to reliably prevent defects such as peeling from occurring in the finally obtained head 1.

Further, even if the coefficient of thermal expansion of the substrate 20 is different from that of the nozzle plate 10, it is possible to firmly bond the substrate 20 and the nozzle plate 10 together through the first bonding film 151 and the second bonding film 152 in high dimensional accuracy by optimizing the following conditions when the substrate 20 is bonded to the nozzle plate 10.

That is to say, in the case where the coefficient of thermal expansion of the substrate 20 is different from that of the nozzle plate 10, it is preferred that the substrate 20 is bonded to the nozzle plate 10 at a temperature as low as possible. By bonding the substrate 20 and the nozzle plate 10 at the low temperature, it is possible to further reduce thermal stress which would be generated on the interfacial surface between the first bonding film 151 and the second bonding film 152.

Specifically, the substrate 20 and the nozzle plate 10 are bonded in a state that each of the substrate 20 and the nozzle plate 10 is heated preferably at a temperature in the range of about 25 to 50° C. and more preferably at a temperature in the range of about 25 to 40° C., although being different depending on the difference between the thermal expansion coefficients thereof.

In such a temperature range, even if the difference between the thermal expansion coefficients of the substrate 20 and the nozzle plate 10 is relatively large, it is possible to sufficiently reduce thermal stress which would be generated on the interfacial surface between the first bonding film 151 and the second bonding film 152. As a result, it is possible to reliably suppress or prevent occurrence of warp, peeling or the like in the head 1.

Especially, in the case where the difference between the thermal expansion coefficients of the substrate 20 and the nozzle plate 10 is equal to or larger than $5\times10^{-5}$/K, it is particularly recommended that the substrate 20 and the nozzle plate 10 are bonded at a temperature as low as possible as described above.

In this regard, the substrate 20 can be firmly bonded to the nozzle plate 10 at the low temperature described above by using the first bonding film 151 and the second bonding film 152.

Further, it is preferred that the substrate 20 and the nozzle plate 10 have a difference in their rigidities. This makes it possible to more firmly bond the substrate 20 and the nozzle plate 10 together.

Before the substrate 20 and the nozzle plate 10 are bonded together, it is preferred that a predetermined region of the surface of the substrate 20 to which the first bonding film 151 is to be bonded has been, in advance, subjected to a surface treatment for obtaining high bonding property between the substrate 20 and the first bonding film 151.

By subjecting the region of the surface of the substrate 20 to the surface treatment, it is possible to further improve bonding strength between the substrate 20 and the first bonding film 151. As a result, it is also possible to improve bonding strength between the substrate 20 and the nozzle plate 10.

Examples of such a surface treatment include: a physical surface treatment such as a sputtering treatment and a blast treatment; a chemical surface treatment such as a plasma treatment which includes an oxygen plasma treatment and a nitrogen plasma treatment, a corona discharge treatment, an etching treatment, an electron irradiation treatment, an ultraviolet-ray irradiation treatment, and an ozone exposing treatment; a treatment combined these methods; and the like.

By subjecting the surface of the substrate 20 to such a surface treatment, it is possible to activate the region of the surface of the substrate 20 on which the first bonding film 151 is to be formed while cleaning the region.

Use of the plasma treatment among these treatments makes it possible to especially optimize the surface of the substrate 20 on which the first bonding film 151 is to be formed. In the case where the substrate 20 to be subjected to the surface treatment is constituted of a resin material (polymer material), the corona discharge treatment or the nitrogen plasma treatment is preferably used.

Among the constitute materials of the substrate 20 mentioned above, there are the constituent materials which can obtain the first bonding film 151 having sufficient high bonding strength without subjecting the surface of the substrate 20 to any surface treatment as described above. Examples of the constituent materials of the substrate 20 that can obtain such an effect include various kinds of metal-based materials, various kinds of silicon-based materials, various kinds of glass-based materials and the like.

The surface of the substrate 20 constituted of such materials is covered with an oxide film having a surface in which hydroxyl groups having relatively high activation are existed. Therefore, the substrate 20 constituted of such materials makes it possible to firmly bond the substrate 20 and the first bonding film 151 together without the surface treatment as described above.

In this case, the whole of the substrate 20 may not be constituted of the constitute materials described above. At least the vicinity of the region of the surface of the substrate 20, on which the first bonding film 151 is to be formed, may be constituted of the constitute materials described above.

If the following groups and substances exist in the region of the surface of the substrate 20 to which the first bonding film 151 is to be bonded, the bonding strength between the substrate 20 and the first bonding film 151 can become sufficiently high even if the region is not subjected to the surface treatment described above.

Examples of such groups and substances include at least one group or substance selected from a group comprising: a functional group such as a hydroxyl group, a thiol group, a carboxyl group, an amino group, a nitro group and an imidazole group; a radical; an open circular molecule; an unsaturated bond such as a double bond and a triple bond; a halogen atom such as a fluorine atom, a chlorine atom, a bromine atom and an iodine atom; and peroxide.

By appropriately performing one selected from various surface treatments described above, the surface having such groups and substances can be obtained.

Instead of the surface treatment, an intermediate layer (first intermediate layer) may have been, in advance, provided on the region of the surface of the substrate 20 to which the first bonding film 151 is to be bonded. The intermediate layer may have various kinds of functions, but preferably have a function of improving bonding property between the substrate 20 and the first bonding film 151, a function of buffering the substrate 20 and the first bonding film 151 (cushion property), and a function of reducing stress that would be generated in a part of an interfacial surface between the substrate 20 and the first bonding film 151.

By bonding the first bonding film 151 on the substrate 20 through such an intermediate layer, it is possible to improve bonding strength between the first bonding film 151 and the substrate 20. As a result, a bonding body having high reliability, namely the head 1 having high reliability can be obtained.

Examples of a constitute material of such an intermediate layer include: a metal-based material such as aluminum and titanium; an oxide-based material such as metal oxide and silicon oxide; a nitride-based material such as metal nitride and silicon nitride; a carbon-based material such as graphite and carbon like diamond; a self-immobilized film material such as a silane coupling agent, a thiol-based compound, a metal alkoxide and a metal-halogen compound; and the like. These materials may be used singly or in combination of two or more of them.

Among the intermediate layer constituted of these materials mentioned above, the intermediate layer constituted of the oxide-based material can improve bonding strength between the substrate 20 and the first bonding film 151.

On the other hand, it is also preferred that a predetermined region of the surface of the nozzle plate 10 to which the second bonding film 152 is to be bonded has been, in advance, subjected to a surface treatment for obtaining high bonding property between the second bonding film 152 and the nozzle plate 10.

By subjecting the region of the surface of the nozzle plate 10 to the surface treatment, it is possible to further improve bonding strength between the nozzle plate 10 and the second bonding film 152. In this regard, it is to be noted that the same surface treatment as that used for the surface of the substrate 20 can be applied to the surface of the nozzle plate 10 as described above.

Instead of the surface treatment, an intermediate layer (second intermediate layer) may have been, in advance, provided on the region of the surface of the nozzle plate 10 to which the second bonding film 152 is to be bonded. The intermediate layer has a function of improving bonding property between the nozzle plate 10 and the second bonding film 152.

By bonding the second bonding film 152 to the nozzle plate 10 through such an intermediate layer, it is possible to improve bonding strength between the second bonding film 152 and the nozzle plate 10. As a constituent material of such an intermediate layer, it is possible to use the same material as that used for the intermediate layer which is formed on the substrate 20 described above.

The same surface treatments that are used for the surfaces of the substrate 20 and the nozzle plate 10 may be performed on the surfaces of the sealing sheet 30, the vibration plate 40, the piezoelectric elements 50 and the case head 60. Further, the same intermediate layers that are formed on the surfaces of the substrate 20 and the nozzle plate 10 may be formed on the surfaces of the sealing sheet 30, the vibration plate 40, the piezoelectric elements 50 and the case head 60.

The surface treatments and the intermediate layers can improve bonding strength between the parts, that is the sealing sheet 30, the vibration plate 40, the piezoelectric elements 50 and the case head 60 of the head 1.

In this step, a description will be made on a mechanism in which the nozzle plate 10 provided with the second bonding film 152 is bonded to the substrate 20 provided with the first bonding film 151. In other words, the description will be made on the mechanism in which the first bonding film 151 is bonded to the second bonding film 152.

It is supposed that the mechanism is based on at least one of the following mechanisms (I) and (II).

Mechanism (I)

Hereinafter, a description will be representatively offered regarding a case that the hydroxyl groups are exposed in the regions of the surfaces of the first bonding film 151 and the second bonding film 152 to which the substrate 20 and the nozzle plate 10 are bonded, respectively.

In this process, when the substrate 20 and the nozzle plate 10 are laminated together so that the first bonding film 151 makes contact with the second bonding film 152, the hydroxyl groups existing on the surface of the first bonding film 151 and the hydroxyl groups existing on the surface of the second bonding film 152 are attracted to each other by hydrogen bonds.

As a result, attracting force is generated between the attracted hydroxyl groups. It is considered that the generation of such attracting force makes it possible to bond the nozzle plate 10 to the substrate 20 through the first bonding film 151 and the second bonding film 152.

Depending on conditions such as a temperature and the like, the hydroxyl groups attracted by the hydrogen bonds are dehydrated and condensed, so that the hydroxyl groups and/or water molecules are removed from the bonding surface (the contact surface) between the first bonding film 151 and the second bonding film 152.

As a result, two atoms, to which the hydroxyl groups had been bonded, are bonded together directly or via an oxygen atom. In this way, it is considered that the first bonding film 151 and the second bonding film 152 are firmly bonded together.

Mechanism (II)

When the substrate 20 provided with the first bonding film 151 and the nozzle plate 10 provided with the second bonding film 152 are laminated together, the bonding hands (non-bonding hands) existing on the surface and the inside of the first bonding film 151 and existing on the surface and the inside of the second bonding film 152, which are not end-capped, are bonded to each other.

The bonding is complicatedly carried out so that the bonding hands overlap (entwine) each other between the first bonding film 151 and the second bonding film 152. Therefore, bonds in a network-shape are formed in the interfacial surface between the first bonding film 151 and the second bonding film 152.

This makes it possible to directly bond a base material (Si-skeleton 301) constituting the first bonding film 151 and a base material (Si-skeleton 301) constituting the second bonding film 152, thereby bonding (integrating) the first bonding film 151 and the second bonding film 152 together.

By the mechanisms (I) and (II) described above, the substrate 20 is bonded to the nozzle plate 10.

In this regard, an activated state that the surfaces of the first bonding film 151 and the second bonding film 152 are activated in the step <15-2> is reduced with the laps of time.

Therefore, it is preferred that this step <15-3> is started as early as possible after the step <15-2>. Specifically, this step <15-3> is preferably started within 60 minutes and more preferably started within 5 minutes after the step <15-2>.

If the step <15-3> is started within such a time, since the surfaces of the first bonding film 151 and the second bonding film 152 maintain a sufficient activated state, when the nozzle plate 10 provided with the second bonding film 152 is bonded to the substrate 20 provided with the first bonding film 151, they can be bonded together with sufficient high bonding strength therebetween.

A bonding strength between the substrate 20 and the nozzle plate 10 is preferably equal to or larger than 5 MPa (50 kgf/cm$^2$) and more preferably equal to or larger than 10 MPa (100 kgf/cm$^2$). Therefore, such a bonding strength makes it possible to reliably prevent peeling of the substrate 20 and the nozzle plate 10. As a result, it is possible to obtain a head 1 having high reliability. By these steps described above, the head 1 can be produced.

After the head 1 has been obtained, if necessary, at least one step (a step of improving bonding strength between parts of the head 1) of two steps (steps <16A> and <16B>) described below may be carried out to the head 1. This makes it possible to further improve the bonding strength between these parts, namely the nozzle plate 10, the substrate 20, the sealing sheet 30, the vibration plate 40, the piezoelectric elements 50 and the case head 60 of the head 1.

<16A> The nozzle plate 10, the substrate 20, the sealing sheet 30, the vibration plate 40 and the case head 60 are then pressed to a direction in which they approach to each other so as to compress the obtained head 1.

As a result, the surfaces of these parts come closer to the adjacent surfaces of the first bonding film 151, 251, 351, 451*a* and 451*b* or the second bonding film 152, 252, 352, 452*a* and 452*b*. It is possible to further improve the bonding strength between the parts (e.g., between the substrate 20 and the nozzle plate 10, between the substrate 20 and the sealing sheet 30, between the sealing sheet 30 and the vibration plate 40, between the case head 60 and the vibration plate 40) in the head 1.

Further, by pressing the parts of the head 1, spaces remaining between the adjacent parts (the interfacial surfaces between the adjacent parts) in the head 1 can be crashed to further increase bonding strength (in a contact area) therebetween. This makes it possible to further improve bonding strength between the respective parts in the head 1.

At this time, it is preferred that a pressure in pressing the head 1 is as high as possible within a range in which the head 1 is not damaged. This makes it possible to increase bonding strength between the respective parts in the head 1 according to an increased degree of this pressure.

In this regard, it is to be noted that this pressure can be appropriately adjusted, depending on the constituent materials and thicknesses of the parts of the head 1, conditions of a bonding apparatus, and the like.

Specifically, the pressure is preferably in the range of about 0.2 to 10 MPa and more preferably in the range of about 1 to 5 MPa, although being slightly different depending on the constituent materials and thicknesses of the parts of the head 1, the conditions of the bonding apparatus and the like.

By setting the pressure to the above range, it is possible to reliably improve bonding strength between the parts in the head 1. Further, although the pressure may exceed the above upper limit value, there is a fear that damages and the like occur in each part of the head 1, depending on the constituent materials thereof.

A time for pressing the head 1 is not particularly limited to a specific value, but is preferably for a length of time from about 10 seconds to 30 minutes. The pressing time can be appropriately changed, depending on the pressure for pressing the head 1. Specifically, in the case where the pressure in pressing the head 1 is higher, it is possible to improve bonding strength between the parts in the head 1 even if the pressing time becomes short.

<16B> In this step, the obtained head 1 is heated.

This makes it possible to improve bonding strength between the respective parts in the head 1. A temperature in heating the head 1 is not particularly limited to a specific value, as long as the temperature is higher than room temperature and lower than a heat resistant temperature of the head 1.

Specifically, the temperature is preferably in the range of about 25 to 100° C. and more preferably in the range of about 50 to 100° C. If the head 1 is heated at the temperature of the above range, it is possible to reliably improve bonding strength between the parts in the head 1 while reliably preventing them from being thermally altered and deteriorated.

Further, a heating time is not particularly limited to a specific value, but is preferably for a length of time from about 1 to 30 minutes.

In the case where both steps <16A> and <16B> are performed, the steps are preferably performed simultaneously. In other words, the head 1 is preferably heated while being pressed. By doing so, an effect by pressing and an effect by heating are exhibited synergistically. Therefore, it is possible to particularly improve bonding strength between the parts in the head 1.

By the steps as described above, it is possible to further improve the bonding strength between the parts in the head 1.

Second Embodiment

Next, a description will be made on a second embodiment of the case where the droplet ejection head according to the present invention is applied to an ink jet type recording head.

Figure 11:
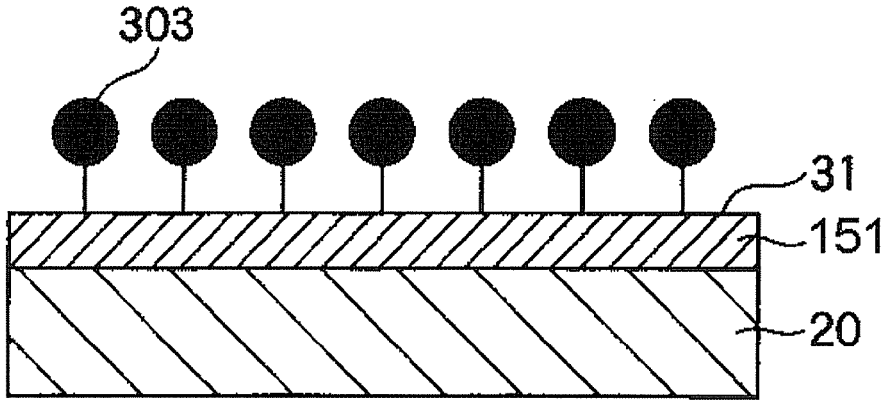
FIG. 11 is a partially enlarged view showing a state before energy is imparted to the first bonding film which is provided in the ink jet type recording head according to the second embodiment.
Figure 12:
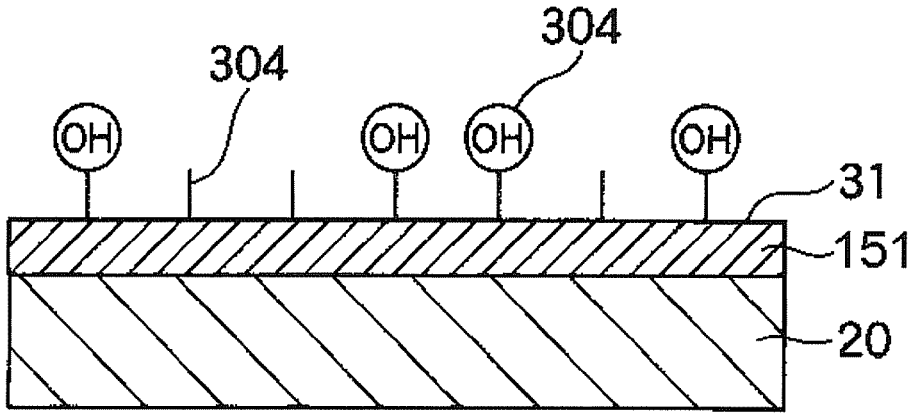
FIG. 12 is a partially enlarged view showing a state after energy is imparted to the first bonding film which is provided in the ink jet type recording head according to the second embodiment.

FIG. 11 is a partially enlarged view showing a state before energy is imparted to the first bonding film which is provided in the ink jet type recording head according to the second embodiment. FIG. 12 is a partially enlarged view showing a state after energy is imparted to the first bonding film which is provided in the ink jet type recording head according to the second embodiment. In the following description, the upper side in FIGS. 11 and 12 will be referred to as "upper" and the lower side thereof will be referred to as "lower" for convenience of explanation.

In the following description, a description will be made on an ink jet type recording head according to the second embodiment. However, the description will be made by focusing on different points from the ink jet type recording head according to the first embodiment and an explanation on the common points is omitted.

The ink jet type recording head according to the second embodiment is the same as that of the first embodiment except that chemical structures of a first bonding film and a second bonding film contained in the ink jet type recording head according to the second embodiment are different from that of the first embodiment.

In the ink jet type recording head according to the present embodiment, each of a first bonding film 151, 251, 351, 451*a* and 451*b* and a second bonding film 152, 252, 352, 452*a* and 452*b* contains metal atoms, oxygen atoms bonded to the metal atoms and elimination groups 303 bonded to at least one of the metal atoms and the oxygen atoms in a state before energy is imparted to each first bonding film 151, 251, 351, 451*a* and 451*b* and the second bonding film 152, 252, 352, 452*a* and 452*b*.

In other words, each of the first bonding film 151, 251, 351, 451*a* and 451*b* and the second bonding film 152, 252, 352, 452*a* and 452*b* in the state before energy is imparted is a film in which the elimination groups 303 are bonded to metal atoms or oxygen atoms contained in a metal oxide film which is constituted of a metal oxide.

In such first bonding films 151, 251, 351, 451*a* and 451*b* and second bonding films 152, 252, 352, 452*a* and 452*b*, when energy is imparted to the first bonding films 151, 251, 351, 451*a* and 451*b* and the second bonding films 152, 252, 352, 452*a* and 452*b*, the elimination groups 303 contained therein are eliminated from at least one of the metal atoms or the oxygen atoms.

Therefore, active hands 304 are generated in at least the vicinity of the surface of each of the first bonding film 151, 251, 351, 451*a* and 451*b* and the second bonding film 152, 252, 352, 452*a* and 452*b*. This makes it possible to develop bonding property in the same manner as the first embodiment.

Hereinafter, a description will be made on the first bonding films 151, 251, 351, 451*a* and 451*b* and the second bonding films 152, 252, 352, 452*a* and 452*b*. However, the description will be made on the first bonding film 151 as a representative due to a common configuration thereof.

Since the first bonding film 151 is constituted of the metal atoms, the oxygen atoms bonded to the metal atoms and the elimination groups 303 bonded to the metal atoms or the oxygen atoms, it becomes a strong film which is hardly deformed. Therefore, the first bonding film 151 in itself has high dimensional accuracy. This also makes it possible to obtain a head 1 having high dimensional accuracy.

Further, the first bonding film 151 is in the form of a solid having no fluidity. Therefore, a thickness and a shape of a bonding layer (the first bonding film 151) are hardly changed as compared to a conventional adhesive layer formed of an aquiform or muciform (semisolid) adhesive agent having fluidity.

Therefore, dimensional accuracy of the first bonding film 151 obtained by bonding the substrate 20 and the nozzle plate 10 together becomes extremely high as compared to a conventional head obtained by using the adhesive layer (the adhesive). In addition, since it is not necessary to wait until the adhesive is hardened, it is possible to firmly bond the nozzle plate 10 to the substrate 20 in a short period of time as compared to the conventional head.

Further, in the present invention, it is preferred that the first bonding film 151 has conductive property. This makes it possible to suppress or prevent unintended charge. As a result, it is possible to reliably control a direction of ejecting an ink.

Furthermore, in the case where the first bonding film 151 has conductive property, a resistivity of the first bonding film 151 is different depending on a composition of a constituent material of the first bonding film 151, but is preferably equal to or smaller than $1\times10^{-3}$ Ω·cm and more preferably equal to or smaller than $1\times10^{-4}$ Ω·cm.

In this regard, it is to be noted that the elimination groups 303 may exist in almost all of the first bonding film 151, or be unevenly distributed in the vicinity of the surface 31 of the first bonding film 151, as long as the elimination groups 303 exist at least in the vicinity of the surface 31 of the first bonding film 151.

In the case where the elimination groups 303 are unevenly distributed in the vicinity of the surface 31 of the first bonding film 151, the first bonding film 151 can appropriately exhibit a function of the metal oxide film. That is to say, the first bonding film 151 can exhibit a function (property) of the metal oxide film such as excellent conductive property or high transparency in addition to the function of the bonding film in itself.

In other words, characteristics such as the conductive property or the high transparency of the first bonding film 151 are not be reliably prevented by the elimination groups 303.

In the above described first bonding film 151, the metal atoms contained in the first bonding film 151 are selected so as to appropriately exhibit the function thereof.

Specifically, the metal atoms are not particularly limited to specific atoms, but examples of the metal atoms include Li, Be, B, Na, Mg, Al, K, Ca, Sc, V, Cr, Mn, Fe, Co, Ni, Cu, Zn, Ga, Rb, Sr, Y, Zr, Nb, Mo, Cd, In, Sn, Sb, Cs, Ba, La, Hf, Ta, W, Ti, Pb and the like.

Among these atoms, one kind selected from a group comprising In (indium), Sn (tin), Zn (zinc), Ti (titanium) and Sb (antimony) or two or more kinds selected from the above group may be preferably used. In the case where the first bonding film 151 is constituted of a metal oxide containing these metal atoms and contains the elimination groups 303 bonding to the metal atoms or oxygen atoms of the metal oxide, the first bonding film 151 can exhibit excellent conductive property and high transparency.

More specifically, examples of the metal oxide include indium tin oxide (ITO), indium zinc oxide (IZO), antimony tin oxide (ATO), indium tin oxide containing fluorine atoms (FTO), zinc oxide (ZnO), titanium dioxide ($TiO_2$), and the like.

In this regard, it is to be noted that in the case where the indium tin oxide (ITO) is used as the metal oxide, an atomic ratio of the indium atoms to the tin atoms is preferably in the range of 99/1 to 80/20 and more preferably in the range of 97/3 to 85/15. This makes it possible to conspicuously exhibit the above effects.

Further, an abundance ratio of the metal atoms to the oxygen atoms contained in the first bonding film 151 is preferably in the range of about 3:7 to 7:3 and more preferably in the range of about 4:6 to 6:4. By setting the abundance ratio of the metal atoms to the oxygen atoms to the above range, stability of the first bonding film 151 becomes high, and thus it becomes possible to firmly bond the substrate 20 and the nozzle plate 10 together.

As described above, the active hands 304 are generated in the first bonding film 151 due to the removal (elimination) of the elimination groups 303 from at least one of the metal atoms and the oxygen atoms. Therefore, in each of the elimination groups 303, such a group of the type as mentioned below is preferably selected, that is, a group satisfying conditions in that it is relatively easily and uniformly eliminated from the metal atoms and/or the oxygen atoms contained in the first bonding film 151 when energy is imparted thereto, whereas reliably bonded to the first bonding film 151 so as not to be eliminated therefrom when the energy is not imparted.

From such a viewpoint, as the elimination groups 303, at least one kind selected from a group comprising a hydrogen atom, a carbon atom, a nitrogen atom, a phosphorus atom, a sulfur atom, a halogen atom and an atomic group constituted of these atoms is preferably used.

Such elimination groups 303 have excellent selectivity in bonding to and eliminating from the metal atoms or the oxygen atoms contained in the first bonding film 151 when imparting the energy thereto. Therefore, the elimination groups 303 can sufficiently satisfy the above mentioned conditions, which make it possible to improve bonding property between the substrate 20 and the nozzle plate 10.

In this regard, it is to be noted that examples of the atomic group constituted of these atoms include: an alkyl group such as a methyl group and an ethyl group; an alkoxy group such as a methoxy group and an ethoxy group; a carboxyl group; an amino group; a sulfonic group; and the like.

Among the above atoms and atomic groups, it is preferred that each of the elimination groups 303 is a hydrogen atom. Since the elimination groups 303 each constituted of the hydrogen atom exhibit high chemical stability, the first bonding film 151 having the hydrogen atoms as the elimination groups 303 can have excellent weather resistance and chemical resistance.

Considering the above matters, it is preferred that the first bonding film 151 is constituted of the metal oxide such as the indium tin oxide (ITO), the indium zinc oxide (IZO), the antimony tin oxide (ATO), the indium tin oxide containing fluorine atoms (FTO), the zinc oxide (ZnO) and the titanium dioxide ($TiO_2$), and the hydrogen atoms introduced into the metal oxide as the elimination groups 303.

If the first bonding film 151 has such a structure, the first bonding film 151 in itself has excellent mechanical property. Further, the first bonding film 151 exhibits especially high bonding property to various kinds of materials. Therefore, such a first bonding film 151 is especially firmly bonded to the substrate 20. Further, such a first bonding film 151 also exhibits especially high bonding property with respect to the nozzle plate 10. As a result, the substrate 20 and the nozzle plate 10 are firmly bonded together through the first bonding film 151 and the second bonding film 152.

Further, an average thickness of the first bonding film 151 is preferably in the range of about 1 to 1000 nm and more preferably in the range of about 2 to 800 nm. By setting the thickness of the first bonding film 151 to a value within the above rang, it is possible to firmly bond the substrate 20 and the nozzle plate 10 through the first bonding film 151 and the second bonding film 152 while preventing dimensional accuracy of the obtained head 1 from being conspicuously reduced.

In other words, if the thickness of the first bonding film 151 is smaller than the lower limit value noted above, there is a possibility that it is difficult to obtain sufficient bonding strength. On the other hand, if the thickness of the first bonding film 151 exceeds the upper limit value noted above, there is a possibility that the head 1 has conspicuously low dimensional accuracy.

If the thickness of the first bonding film 151 falls within the above noted range, the first bonding film 151 can have a certain degree of shape following property. Therefore, even if the lower surface of the substrate 20, namely the surface of the substrate 20 which is bonded to the first bonding film 151 is uneven, the first bonding film 151 can be bonded to the surface of the substrate 20 so as to follow the uneven surface of the substrate 20 through it depends on a degree of the unevenness of the uneven surface.

As a result, the first bonding film 151 can improve an uneven surface of such a substrate 20. Therefore, when the first bonding film 151 provided on the substrate 20 is bonded to the nozzle plate 10 through the second bonding film 152, it is possible to obtain high bonding property of the first bonding film 151 to the nozzle plate 10 due to the improved uneven surface.

The shape following property described above is conspicuously exhibited according to a large thickness of the first bonding film 151. Therefore, in order to sufficiently ensure the shape following property of the first bonding film 151, the thickness of the first bonding film 151 is to be increased.

In the case where the elimination groups 303 are distributed in almost all of the first bonding film 151, such a first bonding film 151 can be formed by a method A in which a metal oxide material containing the metal atoms and the oxygen atoms is deposited on the surface of the substrate 20 by using a physical vapor deposition method under an atmosphere containing atomic components constituting the elimination groups 303.

On the other hand, in the case where the elimination groups 303 are unevenly distributed in the vicinity of the surface 31 of the first bonding film 151, such a first bonding film 151 can be formed by a method B in which a metal oxide film containing the metal atoms and the oxygen atoms is formed, and then the elimination groups 303 are introduced (bonded) into at least one of the metal atoms and the oxygen atoms which exist the vicinity of the surface 31 of the first bonding film 151.

Hereinafter, cases that the first bonding film 151 is formed on the surface of the substrate 20 by using the method A and the method B will be described in detail.

Method A

In this method, as described above, the first bonding film 151 is formed by depositing the metal oxide material containing the metal atoms and the oxygen atoms on the surface 31 of the first bonding film 151 by using the physical vapor deposition method (PVD method) under the atmosphere containing the atomic components constituting the elimination groups 303.

By using such a PVD method, when the metal oxide material comes flying toward the surface of the substrate 20, the elimination groups 303 are relatively easily introduced into at least one of the metal atoms and the oxygen atoms. Therefore, the elimination groups 303 can be distributed in almost all of the first bonding film 151 reliably.

In addition, according to the PVD method, it is possible to efficiently form a compact and homogeneous first bonding film 151. The first bonding film 151 formed by using the PVD method can be especially firmly bonded to the nozzle plate 10 through the second bonding film 152. Further, the first bonding film 151 formed by using the PVD method can maintain an active state generated by imparting energy for a relatively long period of time. This makes it possible to simplify and efficiently improve a producing process of the head 1.

Further, examples of the PVD method include a vacuum deposition method, a sputtering method, an ion plating method, a laser ablation method, and the like. Among these methods, it is preferred that the sputtering method is used. By using the sputtering method, particles constituted of the metal oxide material can be sputtered into the atmosphere containing the atomic components constituting the elimination groups 303 without breaking bonds between the metal atoms and the oxygen atoms.

At this time, the sputtered particles can make contact with gas containing the atomic components constituting the elimination groups 303. This makes it possible to more effectively introduce (bond) the elimination groups 303 into the metal oxide material, namely the metal atoms and the oxygen atoms of the metal oxide material.

Hereinafter, a description will be representatively made on a method of forming the first bonding film 151 by using the sputtering method (the ion beam sputtering method) as the method of forming the first bonding film 151 by using the PVD method.

First, prior to the description of the method of forming the first bonding film 151, a description will be made on a film forming apparatus 200 to be used for forming the first bonding film 151 on the substrate 20 by using the ion beam sputtering method.

Figure 13:
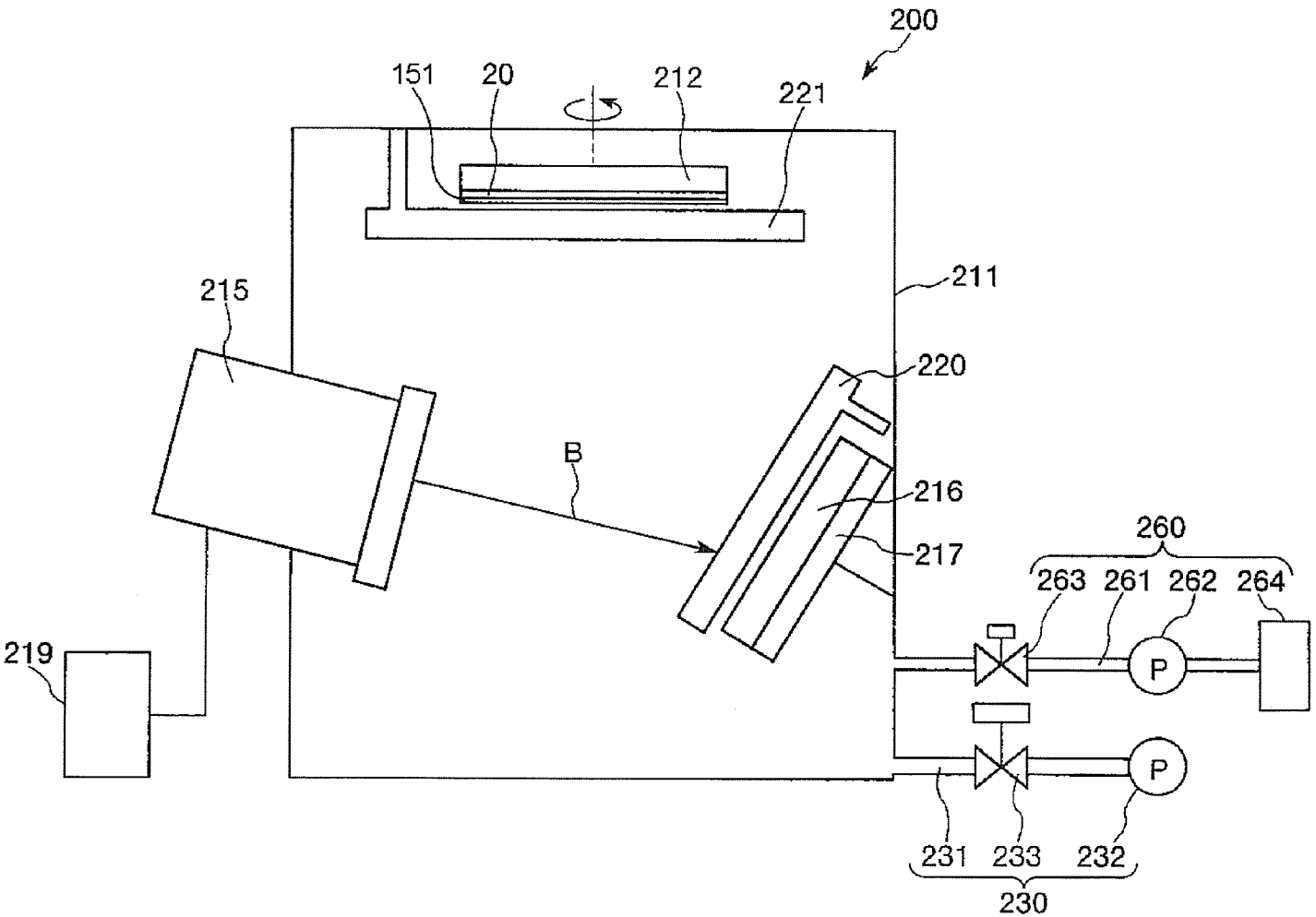
FIG. 13 is a vertical section view schematically showing a film forming apparatus used for forming a first bonding film and a second bonding film provided in an ink jet type recording head according to a second embodiment.
Figure 14:
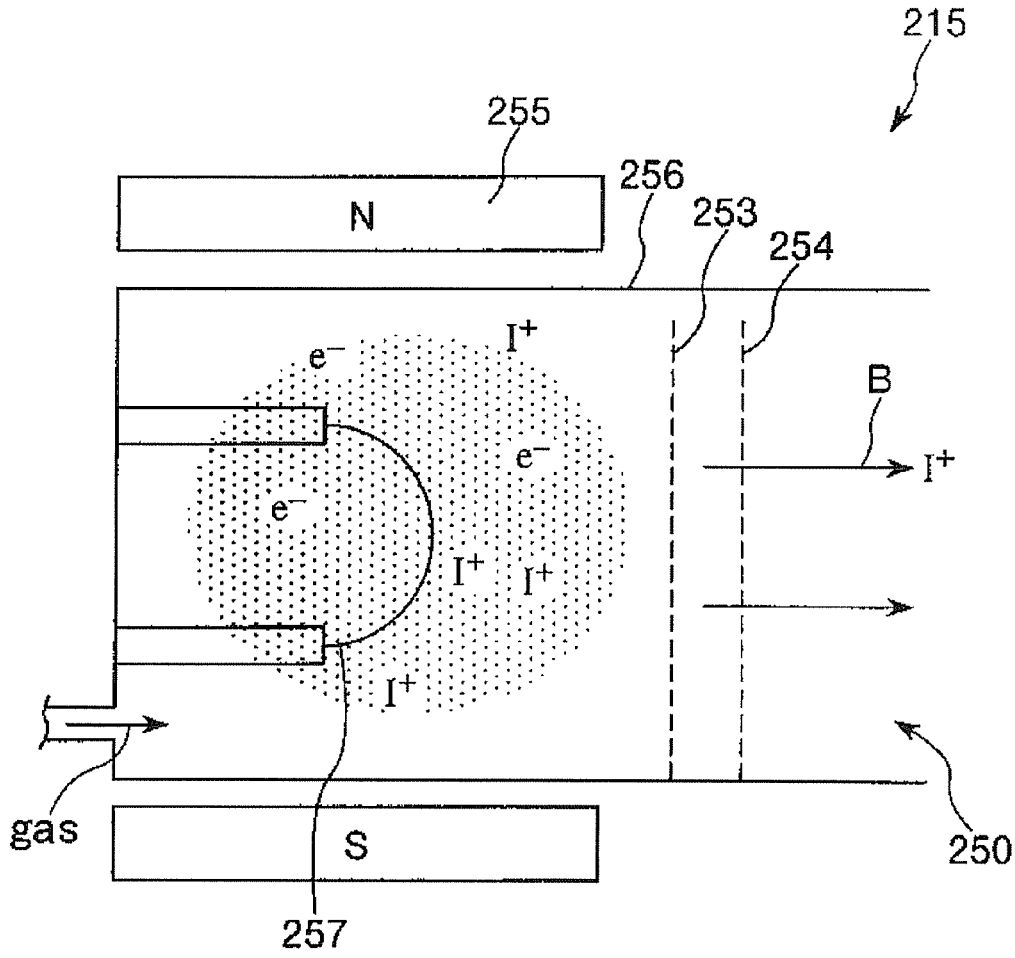
FIG. 14 is a view schematically showing a structure of an ion source provided in the film forming apparatus shown in FIG. 13.

FIG. 13 is a vertical section view schematically showing a film forming apparatus used for forming a first bonding film and a second bonding film according to the present embodiment. FIG. 14 is a view schematically showing a structure of an ion source provided in the film forming apparatus shown in FIG. 13. In the following description, the upper side in FIG. 13 will be referred to as "upper" and the lower side thereof will be referred to as "lower" for convenience of explanation.

The film forming apparatus 200 shown in FIG. 13 is configured so that the first bonding film 151 can be formed by using the ion beam sputtering method in a chamber provided therein.

Specifically, the film forming apparatus 200 includes a chamber (a vacuum chamber) 211, a substrate holder (a film formation object holding unit) 212 that is provided in the chamber 211 and holds the substrate 20 (a film formation object), an ion source (an ion supplying unit) 215 that irradiates an ion beam B toward the inside of the chamber 211, and a target holder (a target holding unit) 217 that holds a target 216 to be used for generating the metal oxide material (e.g., ITO) containing the metal atoms and the oxygen atoms due to the irradiation of the ion beam B.

Further, connected to the chamber 211 are gas supplying means 260 that supplies gas (e.g., a hydrogen gas) containing the atomic components constituting the elimination groups 303 into the chamber 211 and evacuating means 230 that evacuates the gas contained in the inside of the chamber 211 and controls pressure of the inside thereof.

In this regard, it is to be noted that in this embodiment, the substrate holder 212 is attached to a ceiling section of the chamber 211 so that it is pivotable. This makes it possible to form a first bonding film 151 having homogeneity and an uniform thickness on the substrate 20.

As shown in FIG. 14, the ions source (an ion gun) 215 includes an ion generation chamber 256 in which an opening (an irradiation opening) 250 is formed, a filament 257 and grids 253 and 254 each provided in the inside of the ion generation chamber 256, and a magnet 255 set on the outside of the ion generation chamber 256.

Further, as shown in FIG. 13, a gas supply source 219 that supplies a gas (sputtering gas) into the ion generation chamber 256 is connected to the ion generation chamber 256.

In the ion source 215, when the filament 257 is heated by electrifying it in a state that the gas is supplied into the ion generation chamber 256 from the gas supply source 219, electrons are discharged from the filament 257. The discharged electrons are moved by a magnetic field of the magnet 255 and collide with gas molecules supplied into the ion generation chamber 256.

As a result, the gas molecules are ionized to produce ions $I^+$ thereof. The ions $I^+$ are drawn out of the ion generation chamber 256 while being accelerated by a voltage gradient between the grid 253 and the grid 254, and then discharged (irradiated) from the ion source 215 as the ion beam B through the opening 250.

The ion beam B irradiated from the ion source 215 collides with a surface of the target 216. Particles (sputtered particles) are sputtered from the surface of the target 216. The target 216 is constituted of the metal oxide material described above.

In the film forming apparatus 200, the ion source 215 is fixed (provided) in a sidewall of the chamber 211 so that the opening 250 thereof is located in the chamber 211. The ion source 215 may be arranged in a position spaced apart from the chamber 211 and connected to the chamber 211 through a connecting section. However, by adapting the configuration of this embodiment, the film forming apparatus 200 can be reduced in size.

The ion source 215 is provided so that the opening 250 thereof faces a direction different from a direction of the substrate holder 212, i.e., in this embodiment, a bottom side of the chamber 211. The number of the ion source 215 is not limited to one and may be plural. It is possible to further increase film formation speed of the first bonding film 151 by providing a plurality of the ion sources 215.

Further, a first shutter 220 and a second shutter 221 that can cover the target holder 217 and the substrate holder 212, respectively, are provided near the same. The first shutter 220 and the second shutter 221 prevent the target 216, the substrate 20, and the first bonding film 151 from being exposed to an unnecessary atmosphere and the like.

The evacuating means 230 includes a pump 232, an evacuating line 231 that communicates the pump 232 and the chamber 211 with each other, and a valve 233 that is provided at a middle of the evacuating line 231. The evacuating means 230 can decompress the inside of the chamber 211 to a desired pressure.

The gas supplying means 260 includes a gas cylinder 264 that reserves gas (e.g., a hydrogen gas) containing the atomic components constituting the elimination groups 303, a gas supply line 261 that introduces the gas from the gas cylinder 264 into the chamber 211, and a pump 262 and a valve 263 that are provided at a middle of the gas supply line 261. The gas supplying means 260 can supply the gas containing the atomic components constituting the elimination groups 303 into the chamber 211.

In the film forming apparatus 200 having the configuration described above, the first bonding film 151 can be formed on substrate 20 as described below. Here, a description will be made on a method of forming the first bonding film 151 on the substrate 20.

First, the substrate 20 is prepared. The substrate 20 is conveyed into the chamber 211 of the film forming apparatus 200 and mounted (set) on the substrate holder 212.

Next, the inside of the chamber 211 is decompressed by opening the valve 233 in a state that the evacuating means 230 is actuated, i.e., the pump 232 is actuated. A degree of the decompression (a degree of vacuum) is not particularly limited to a specific value, but is preferably in the range of about $1\times10^{-7}$ to $1\times10^{-4}$ Torr and more preferably in the range of about $1\times10^{-6}$ to $1\times10^{-5}$ Torr.

The gas containing the atomic components constituting the elimination groups 303 is supplied into the chamber 211 by opening the valve 263 in a state that the gas supplying means 260 is actuated, i.e., the pump 262 is actuated. As a result, the inside of the chamber 211 can be set to an atmosphere containing such a gas (a hydrogen gas atmosphere).

A flow rate of the gas containing the atomic components constituting the elimination groups 303 is preferably in the range of about 1 to 100 ccm and more preferably in the range of about 10 to 60 ccm. This makes it possible to reliably introduce the elimination groups 303 into at least one of the metal atoms and the oxygen atoms.

A temperature within the chamber 211 only has to be equal to or higher than 25° C., but is preferably in the range of about 25 to 100° C. By setting the temperature to the above range, reaction of the metal atoms or the oxygen atoms and the gas containing the atomic components is efficiently performed. As a result, the gas containing the atomic components can be reliably introduced into the metal atoms and/or the oxygen atoms as the elimination groups 303.

Next, the second shutter 221 is opened and the first shutter 220 is further opened. In this state, gas is introduced into the ion generation chamber 256 of the ion source 215 and heated by electrifying the filament 257. As a result, electrons are discharged from the filament 257 and the discharged electrons and gas molecules collide with each other, whereby the gas molecules are ionized to produce ions $I^+$ thereof.

The Ions $I^+$ are accelerated by the grids 253 and 254, discharged from the ion source 215, and collide with the target 216 constituted of the metal oxide material. Consequently, particles of the metal oxide material (e.g., ITO) are sputtered from the target 216. At this time, the inside of the chamber 211 is set to the atmosphere containing the gas containing the atomic components constituting the elimination groups 303 (e.g., a hydrogen gas atmosphere).

Therefore, the elimination groups 303 are introduced into the metal atoms and/or the oxygen atoms contained in the particles sputtered into the chamber 211. The metal oxide material into which the elimination groups 303 are introduced is deposited onto the substrate 20, whereby the first bonding film 151 is formed.

In this regard, it is to be noted that in the ion beam sputtering method described in this embodiment, electrical discharge is performed in the ion generation chamber 256 of the ion source 215 and electrons e are generated. However, the electrons $e^-$ are blocked by the grid 253 and prevented from being discharged into the chamber 211.

In addition, the irradiation direction of the ion beam B (the opening 250 of the ion source 215) faces the target 216 (a direction different from the bottom side of the chamber 211). Therefore, an ultraviolet ray generated in the ion generation chamber 256 is more reliably prevented from being irradiated on the formed first bonding film 151.

This makes it possible to reliably prevent the elimination groups 303 introduced during the formation of the first bonding film 151 from being removed (eliminated) from the metal atoms and/or the oxygen atoms of the first bonding film 151.

As described above, it is possible to form a first bonding film 151 in which the elimination groups 303 are distributed in almost all of a thickness direction thereof.

Method B

In this method, a first bonding film 151 is obtained by forming a metal oxide film containing the metal atoms and the oxygen atoms, and then introducing the elimination groups 303 into at least one of the metal atoms and the oxygen atoms existing in the vicinity of a surface of the metal oxide film.

According to this method, the introduced elimination groups 303 can be unevenly distributed in the vicinity of the surface of the metal oxide film in a relative simple step. Therefore, it is possible to form a first bonding film 151 having excellent characteristics of both a bonding film and the metal oxide film.

In this regard, the metal oxide film may be formed by any method. Examples of the method include various kinds of vapor phase film-formation methods such as a PVD method (physical vapor deposition method), a CVD method (chemical vapor deposition method) and a plasma polymerization method, various kinds of liquid phase film-formation methods, and the like. Among these methods, the metal oxide film is preferably formed by using the PVD method. Use of the PVD method makes it possible to efficiently form a compact and uniform metal oxide film.

Further, examples of the PVD method include a vacuum deposition method, a sputtering method, an ion plating method, a laser ablation method, and the like. Among these methods, it is preferred that the sputtering method is used.

By using the sputtering method, particles of the metal oxide material can be sputtered into an atmosphere performing the formation of the metal oxide film without breaking bonds between the metal atoms and the oxygen atoms, and supplied onto the substrate 20. As a result, it is possible to form a metal oxide film having improved properties.

Furthermore, various kinds of methods can be used as the method of introducing the elimination groups 303 into the vicinity of the surface of the metal oxide film. Examples of such methods include: a method B1 in which the metal oxide film is subjected to a heat treatment, that is, the metal oxide film is annealed under the atmosphere containing the atomic components constituting the elimination groups 303; a method B2 which is referred to as an ion implantation method; and the like.

Among these methods, it is preferred that the method B1 is used. Use of the method B1 makes it possible to selectively introduce the elimination groups 303 into the vicinity of the surface of the metal oxide film. Further, by setting conditions such as an atmosphere temperature and a processing time to adequate conditions during the heat treatment, it is possible to control an amount of (the number of) the elimination groups 303 to be introduced into the metal oxide film, and a thickness of the metal oxide film into which the elimination groups 303 are introduced.

Hereinafter, a description will be representatively made on a case that the first bonding film 151 is obtained by forming the metal oxide film using the sputtering method (the ion beam sputtering method), and then subjecting the thus obtained metal oxide film to the heat treatment (annealing) under the atmosphere containing the atomic components constituting the elimination groups 303.

In this regard, in the case where the first bonding film 151 is formed by using the method B, used is a film forming apparatus having the same configuration as that of the film forming apparatus 200 used in the formation of the first bonding film 151 using the method A. Therefore, the description regarding the film forming apparatus is omitted.

<i> First, the substrate 20 is prepared. The substrate 20 is conveyed into the chamber 211 of the film forming apparatus 200 and mounted (set) on the substrate holder 212.

<ii> Next, the inside of the chamber 211 is decompressed by opening the valve 233 in a state that the evacuating means 230 is actuated, i.e., the pump 232 is actuated. A degree of the decompression (a degree of vacuum) is not particularly limited to a specific value, but is preferably in the range of about $1\times10^{-7}$ to $1\times10^{-4}$ Torr and more preferably in the range of about $1\times10^{-6}$ to $1\times10^{-5}$ Torr.

Further, at this time, the inside of the chamber 211 is heated by actuating a heating means (not shown). A temperature within the chamber 211 only has to be equal to or higher than 25° C., but is preferably in the range of about 25 to 100° C. By setting the temperature to the above range, it is possible to form a metal oxide film having high density.

<iii> Next, the second shutter 221 is opened and the first shutter 220 is further opened. In this state, gas is introduced into the ion generation chamber 256 of the ion source 215 and heated by electrifying the filament 257. As a result, electrons are discharged from the filament 257 and the discharged electrons and gas molecules collide with each other, whereby the gas molecules are ionized to produce ions $I^+$ thereof.

The Ions $I^+$ are accelerated by the grids 253 and 254, are discharged from the ion source 215, and collide with the target 216 constituted of the metal oxide material. Consequently, particles of the metal oxide (e.g., ITO) are sputtered from the target 216 and deposited onto the substrate 20, whereby the metal oxide film containing the metal atoms and the oxygen atoms bonded to the metal atoms is formed.

In this regard, it is to be noted that in the ion beam sputtering method described in this embodiment, electrical discharge is performed in the ion generation chamber 256 of the ion source 215 and electrons e are generated. However, the electrons $e^-$ are blocked by the grid 253 and prevented from being discharged into the chamber 211.

In addition, the irradiation direction of the ion beam B (the opening 250 of the ion source 215) faces the target 216 (a direction different from the bottom side of the chamber 211). Therefore, an ultraviolet ray generated in the ion generation chamber 256 is more reliably prevented from being irradiated on the formed first bonding film 151. This makes it possible to reliably prevent the elimination groups 303 introduced into the first bonding film 151 from being eliminated.

In the other words, this makes it possible to prevent the metal oxide film from being altered and deteriorated, and to suppress an introduction efficiency of the elimination groups 303 into a surface of the metal oxide film from being reduced in the subsequent step.

<iv> Next, the first shutter 220 is closed while maintaining the open state of the second shutter 221. In this state, the inside of the chamber 211 is heated by actuating the heating means. The temperature within the chamber 211 is set to a value that the elimination groups 303 can be efficiently introduced into the metal oxide film.

Specifically, the temperature is preferably in the range of about 100 to 600° C. and more preferably in the range of about 150 to 300° C. This makes it possible to prevent the substrate 20 and the metal oxide film from being altered and deteriorated and to efficiently introduce the elimination groups 303 into a surface of the metal oxide film in the next step <v>.

<v> Next, the gas containing the atomic components constituting the elimination groups 303 is supplied into the chamber 211 by opening the valve 263 in a state that the gas supplying means 260 is actuated, i.e., the pump 262 is actuated. As a result, the inside of the chamber 211 can be set to an atmosphere containing such a gas (a hydrogen gas atmosphere).

In this way, when the inside of the chamber 211 is set to the atmosphere containing the atomic components constituting the elimination groups 303 (e.g., the hydrogen gas atmosphere) in the state that the inside of the chamber 211 is heated in the step <iv>, the elimination groups 303 are introduced into at least one of the metal atoms and the oxygen atoms existing in the vicinity of the surface of the metal oxide film to thereby form the first bonding film 151.

A flow rate of the gas containing the atomic components constituting the elimination groups 303 is preferably in the range of about 1 to 100 ccm and more preferably in the range of about 10 to 60 ccm. This makes it possible to reliably introduce the elimination groups 303 into at least one of the metal atoms and the oxygen atoms.

In this regard, it is preferred that the decompression state of the inside of the chamber 211, that is the decompression state adjusted by actuating the evacuating means 230 in the step <ii>, is maintained. This makes it possible to more effectively introduce the elimination groups 303 into the vicinity of the surface of the metal oxide film.

Further, in the case where the inside of the chamber 211 is decompressed in this step from the decompression state that adjusted in the step <ii>, labor hour, in which the inside of the chamber 211 is decompressed from the beginning, can be omitted. Therefore, merits such as reduce of a time, a cost or the like for forming the first bonding film 151 can be obtained.

In this case, a degree of the decompression (a degree of vacuum) is not particularly limited to a specific value, but is preferably in the range of about $1\times10^{-7}$ to $1\times10^{-4}$ Torr and more preferably in the range of about $1\times10^{-6}$ to $1\times10^{-5}$ Torr. A processing time for subjecting to the heat treatment is preferably for a length of time from about 15 to 120 minutes, and more preferably for a length of time from about 30 to 60 minutes.

By setting conditions (the temperature within the chamber 211, the degree of vacuum thereof, the flow rate of the gas and the processing time) during the heat treatment to the above ranges, the elimination groups 303 can be selectively introduced into the vicinity of the surface of the metal oxide film, although being different depending on kinds and the like thereof.

As described above, it is possible to form a first bonding film 151 in which the elimination groups 303 are unevenly distributed in the vicinity of the surface 31 thereof.

The ink jet type recording head 1 according to the second embodiment as described above can obtain the same functions and effects as those of the ink jet type recording head 1 according to the first embodiment.

Third Embodiment

Next, a description will be made on a third embodiment of the case where the droplet ejection head according to the present invention is applied to an ink jet type recording head.

In the following description, a description will be made on an ink jet type recording head according to the third embodiment. However, the description will be made by focusing on different points from the ink jet type recording heads according to the first embodiment and the second embodiment and an explanation on the common points is omitted.

The ink jet type recording head according to the third embodiment is the same as that of the first embodiment except that a chemical structure constituting each of a first bonding film and a second bonding film contained in the ink jet type recording head according to the third embodiment is different from that of the first embodiment.

In the ink jet type recording head according to the present embodiment, each of a first bonding film 151, 251, 351, 451*a* and 451*b* and a second bonding film 152, 252, 352, 452*a* and 452*b* contains metal atoms and elimination groups 303 constituted of an organic component in a state before energy is imparted to the first bonding films 151, 251, 351, 451*a* and 451*b* and the second bonding films 152, 252, 352, 452*a* and 452*b*.

In such first bonding films 151, 251, 351, 451*a* and 451*b* and a second bonding films 152, 252, 352, 452*a* and 452*b*, when energy is imparted to the first bonding films 151, 251, 351, 451*a* and 451*b* and the second bonding films 152, 252, 352, 452*a* and 452*b*, the elimination groups 303 contained therein are eliminated from the metal atoms contained in the first bonding films 151, 251, 351, 451*a* and 451*b* and the second bonding films 152, 252, 352, 452*a* and 452*b*.

Thereafter, active hands 304 are generated in at least the vicinity of a surface of each of the first bonding film 151, 251, 351, 451*a* and 451*b* and the second bonding film 152, 252, 352, 452*a* and 452*b*. This makes it possible to develop bonding property in the same manner as the second embodiment.

Hereinafter, a description will be made on the first bonding films 151, 251, 351, 451*a* and 451*b* and the second bonding films 152, 252, 352, 452*a* and 452*b* according the present embodiment. However, the description will be made on the first bonding film 151 as a representative due to a common configuration thereof.

The first bonding film 151 is provide on the substrate 20 and contains the metal atoms and the elimination groups 303 constituted of the organic component.

When energy is imparted to such a first bonding film 151, the elimination groups 303, which exist at least in the vicinity of the surface 31 of the first bonding film 151, are eliminated therefrom to generate active hands 304 at least in the vicinity of the surface 31 of the first bonding film 151 as shown in FIG. 12. As a result, the surface 31 of the first bonding film 151 develops bonding property.

In the case where the bonding property is developed in the surface 31 of the first bonding film 151, the substrate 20 provided with the first bonding film 151 can be firmly and efficiently bonded to the second bonding film 152 with high dimensional accuracy through the first bonding film 151 thereof.

Further, since the first bonding film 151 includes the metal atoms and the elimination groups 303 each constituted of the organic component, that is, the first bonding film 151 is formed from an organic metal film, it becomes a strong film which is relatively hardly deformed. Therefore, the first bonding film 151 in itself has high dimensional accuracy. This also makes it possible to obtain a head 1 having high dimensional accuracy as described below.

Furthermore, such a first bonding film 151 is in the form of a solid having no fluidity. Therefore, a thickness and a shape of a bonding layer (the first bonding film 151) are hardly changed as compared to a conventional adhesive layer formed of an aquiform or muciform (semisolid) adhesive agent having fluidity.

Therefore, dimensional accuracy of the head 1 obtained by using such a first bonding film 151 becomes extremely high as compared to a conventional head obtained using the adhesive layer (the adhesive). In addition, since it is not necessary to wait until the adhesive is hardened, it is possible to firmly bond the nozzle plate 10 to the substrate 20 in a short period of time as compared to the conventional head.

Further, in the present invention, it is preferred that the first bonding film 151 has conductive property. This makes it possible to suppress or prevent unintended charge in the head 1 described below. As a result, it is possible to reliably control a direction of ejecting an ink.

In the above described first bonding film 151, the metal atoms and the elimination groups 303 contained in the first bonding film 151 are selected so as to appropriately exhibit the function thereof.

Specifically, examples of the metal atoms include transition metal elements such as Sc, Ti, V, Cr, Mn, Fe, Co, Ni, Cu, Y, Zr, Nb, Mo, Tc, Ru, Rh, Pd, Ag, Hf, Ta, W, Re, Os, Ir, Pt, Au, various kinds of lanthanoid elements and various kinds of actinoid elements, typical metal elements such as Li, Be, Na, Mg, Al, K, Ca, Zn, Ga, Rb, Sr, Cd, In, Sn, Sb, Cs, Ba, Tl, Pd, Bi and Po, and the like.

Here, since a difference between the transition metal elements is only the number of electrons existing in an outermost electron shell thereof, physical properties of the transition metal elements are similar with each other. In general, each transition metal has strong hardness, a high melting point, and excellent electrical and thermal conductivities.

Therefore, in the case where the transition metal elements are used as the metal atoms, it is possible to further improve bonding property to be developed in the first bonding film 151, and conductive property of the first bonding film 151.

Further, in the case where one kind selected from a group comprising Cu, Al, Zn and Fe or two or more kinds selected from the above group are used in combination as the metal atoms, the first bonding film 151 can exhibit excellent conductive property. Furthermore, in the case of use of a metal organic chemical vapor deposition method as described below, it is possible to relatively easily form a first bonding film 151 having an uniform thickness by using a metal complex containing the above metals or the like as a raw material.

As described above, the active hands 304 are generated in the first bonding film 151 due to the elimination of the elimination groups 303 therefrom. Therefore, in each of the elimination groups 303, such a group of the type as mentioned below is preferably selected, that is, a group satisfying conditions in that it is relatively easily and uniformly eliminated from the metal atoms of the first bonding film 151 when the energy is imparted thereto, whereas reliably bonded to the first bonding film 151 so as not to be eliminated therefrom when the energy is not imparted.

Specifically, as each of the elimination groups 303, a group constituted of an atomic group containing a carbon atom as an essential element and at least one kind selected from the group comprising a hydrogen atom, a nitrogen atom, a phosphorus atom, a sulfur atom and a halogen atom is preferably selected.

Such elimination groups 303 have excellent selectivity in bonding to and eliminating from the metal atoms of the first bonding film 151 when imparting the energy thereto. Therefore, the elimination groups 303 can satisfy the above mentioned conditions sufficiently, which makes it possible to improve bonding property of the first bonding film 151.

More specifically, examples of the atomic group include: an alkyl group such as a methyl group or an ethyl group; an alkoxy group such as a methoxy group or an ethoxy group; a carboxyl group; the other group such as an alkyl group having an isocyanate group, an amino group or a sulfonic acid group at the end thereof; and the like.

Among the above mentioned atomic groups, the alkyl group is preferably selected as each of the elimination groups 303. Since the elimination groups 303 each constituted of the alkyl group exhibit high chemical stability, the first bonding film 151 having the alkyl groups as the elimination groups 303 can have excellent weather resistance and chemical resistance.

Further, in the first bonding film 151 having such a structure, an abundance ratio of the metal atoms to the carbon atoms contained in the first bonding film 151 is preferably in the range of about 3:7 to 7:3, and more preferably in the range of about 4:6 to 6:4. By setting the abundance ratio of the metal atoms to the carbon atoms to the above range, stability of the first bonding film 151 becomes high, and therefore it becomes possible to firmly bond the substrate 20 and the nozzle plate 10 together through the first bonding film 151 and the second bonding film 152. Further, the first bonding film 151 can exhibit excellent conductive property.

Further, an average thickness of the first bonding film 151 is preferably in the range of about 1 to 1000 nm and more preferably in the range of about 50 to 800 nm. By setting the average thickness of the first bonding film 151 to the above range, it is possible to prevent dimensional accuracy of the head 1 obtained from being significantly reduced, thereby enabling to firmly bond substrate 20 and the nozzle plate 10 together through the first bonding film 151 and the second bonding film 152.

In other words, if the average thickness of the first bonding film 151 is lower than the above lower limit value, there is a case that the head 1 having sufficient bonding strength between the substrate 20 and the nozzle plate 10 cannot be obtained. In contrast, if the average thickness of first bonding film 151 exceeds the above upper limit value, there is a fear that dimensional accuracy of the head 1 is reduced significantly.

If the thickness of the first bonding film 151 falls within the above noted range, the first bonding film 151 can have a certain degree of shape following property. Therefore, even if the lower surface of the substrate 20, namely the surface of the substrate 20 which is bonded to the first bonding film 151 is uneven, the first bonding film 151 can be bonded to the surface of the substrate 20 so as to follow the uneven surface of the substrate 20 through it depends on a degree of the unevenness of the uneven surface.

As a result, the first bonding film 151 can improve an uneven surface of such a substrate 20. Therefore, when the first bonding film 151 provided on the substrate 20 is bonded to the nozzle plate 10, it is possible to obtain high bonding property of the first bonding film 151 with respect to the nozzle plate 10 due to the improved uneven surface.

The shape following property described above is conspicuously exhibited depending on a large thickness of the first bonding film 151. Therefore, in order to sufficiently ensure the shape following property of the first bonding film 151, the thickness of the first bonding film 151 is to be increased.

The above mentioned first bonding film 151 may be formed by any method. Examples of such a method of forming the first bonding film 151 include: a method II-A in which an organic compound containing the elimination groups 303 (an organic component) is applied (chemically modified) to almost all or the vicinity of a surface of a metal film made of metal atoms; a method II-B in which an organic metal material comprising metal atoms and an organic compound containing the elimination groups 303 (the organic component) as a raw material is applied to almost all or the vicinity of a surface of a metal film made of metal atoms by using a metal organic chemical vapor deposition method; a method II-C in which an organic metal material comprising metal atoms and an organic compound containing the elimination groups 303 as a raw material is dissolved to appropriate solvent to obtain a solution and then the solution is applied to almost all or the vicinity of a surface of a metal film made of metal atoms by using a spin coat method or the like; and the like.

Among the above methods, it is preferred that the first bonding film 151 is formed by using the method II-B. Use of the method II-B makes it possible to form a first bonding film 151 having an uniform thickness in a relatively simple step.

Hereinafter, a description will be representatively offered regarding a case (that is, the method II-B) that the first bonding film 151 is obtained by applying the organic metal material comprising the metal atoms and the organic compound containing the elimination groups 303 as the raw material to almost all or the vicinity of the surface of the metal film by using the metal organic chemical vapor deposition method.

First, prior to the description of the method of forming the first bonding film 151, a description will be made on a film forming apparatus 500 to be used for forming the first bonding film 151.

Figure 15:
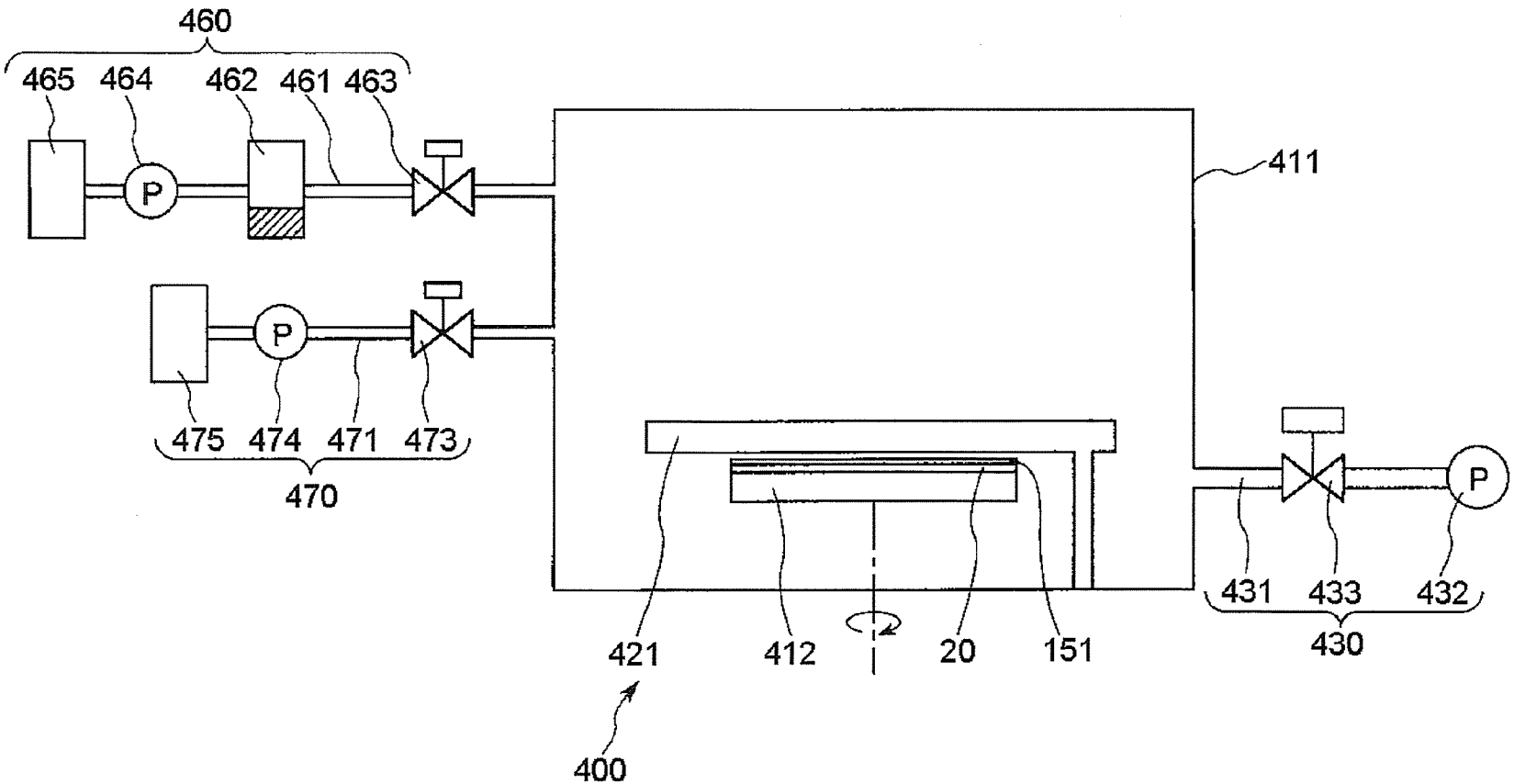
FIG. 15 is a vertical section view schematically showing a film forming apparatus used for forming a first bonding film and a second bonding film provided in an ink jet type recording head according to a third embodiment.

FIG. 15 is a vertical section view schematically showing a film forming apparatus used for forming a first bonding film and a second bonding film according to the present embodiment. In the following description, the upper side in FIG. 15 will be referred to as "upper" and the lower side thereof will be referred to as "lower" for convenience of explanation.

The film forming apparatus 400 shown in FIG. 15 is configured so that the first bonding film 151 is formed by the metal organic chemical vapor deposition method (hereinafter, referred to as "a MOCVD method") in the chamber 411 provided therein.

Specifically, the film forming apparatus 400 includes a chamber (a vacuum chamber) 411, a substrate holder (a film formation object holding unit) 412 that is provided in the chamber 411 and holds the substrate 20 (a film formation object), organic metal material supplying means 460 that supplies a vaporized or atomized organic metal material into the chamber 411, gas supplying means 470 that supplies gas for setting the inside of the chamber 411 to a low reducing atmosphere, evacuating means 430 that evacuates the gas in the chamber 411 and controls pressure therein, and heating means (not shown) that heats the substrate holder 412.

In this embodiment, the substrate holder 412 is attached to a bottom of the chamber 411. The substrate holder 412 is pivotable by actuating a motor. This makes it possible to form a first bonding film 151 having homogeneity and an uniform thickness on the substrate 20.

Further, a shutter 421 that can cover the substrate holder 412 is provided near the same. The shutter 421 prevents the substrate 20 and the first bonding film 151 from being exposed to an unnecessary atmosphere and the like.

The organic metal material supplying means 460 is connected to the chamber 411. The organic metal material supplying means 460 includes a storage tank 462 that stores a solid organic metal material, a gas cylinder 465 that stores a carrier gas for supplying the vaporized or atomized organic metal material into the chamber 411, a gas supply line 461 that leads the carrier gas and the vaporized or atomized organic metal material into the chamber 411, and a pump 464 and a valve 463 provided at a middle of the gas supply line 461.

In the organic metal material supplying means 460 having such a configuration, the storage tank 462 has heating means, and the solid organic metal material can be heated by actuating the heating means so that it is vaporized or atomized.

Therefore, when the pump 464 is actuated to supply the carrier gas from the gas cylinder 465 to the storage tank 462 in a state that the valve 463 is opened, the vaporized or atomized organic metal material is supplied into the chamber 411 through the supply line 461 together with the carrier gas.

The carrier gas is not particularly limited to a specific kind. As the carrier gas, a nitrogen gas, an argon gas, a helium gas, and the like may be preferably used.

Further, in this embodiment, the gas supplying means 470 is connected to the chamber 411. The gas supplying means 470 includes a gas cylinder 475 that stores gas for setting the inside of the chamber 411 to a low reducing atmosphere, a gas supply line 471 that leads the gas into the gas chamber 411, and a pump 474 and a valve 473 provided at a middle of the gas supply line 471.

In the gas supplying means 470 having such a configuration, when the pump 474 is actuated in a state that the valve 473 is opened, the gas for setting the inside of the chamber 411 to the low reducing atmosphere is supplied from the gas bomb 475 into the chamber 411 through the supply line 471. By configuring the gas supplying means 470 as described above, it is possible to reliably set the inside of the chamber 411 to the low reducing atmosphere with respect to the organic metal material.

As a result, in the case where the first bonding film 151 is formed from the organic metal material by using the MOCVD method, the first bonding film 151 is formed in a state that at least a part of an organic compound contained in the organic metal material remains as the elimination groups 303 (the organic component).

The gas for setting the inside of the chamber 411 to the low reducing atmosphere is not particularly limited to a specific kind. Examples of the gas include: a nitrogen gas; rare gas such as helium, argon and xenon; nitrogen monoxide; dinitrogen monoxide; and the like. Any one kind of the above gases may be used singly, or two or more kinds of the above gases may be used in combination.

In the case where a metal containing oxygen atoms in a molecule structure such as 2,4-pentadionato copper(II) or [cu(hfac) (VTMS)] described later is used as the organic metal material, a hydrogen gas is preferably added to the gas for setting the inside of the chamber 411 to the low reducing atmosphere.

This makes it possible to improve reducing property with respect to the oxygen atoms and to form the first bonding film 151 without remaining excessive oxygen atoms therein. As a result, the first bonding film 151 has a low abundance ratio of metal oxide therein so that it can exhibit excellent conductive property.

Further, in the case where at least one kind of the nitrogen gas, the argon gas and the helium gas described above is used as the carrier gas, the carrier gas also can serve as the gas for setting the inside of the chamber 411 to the low reducing atmosphere.

The evacuating means 430 includes a pump 432, an evacuating line 431 that communicates the pump 432 and the chamber 411 with each other, and a valve 433 provided at a middle of the evacuating line 431. The evacuating means 430 can decompress the inside of the chamber 411 to a desired pressure.

In the film forming apparatus 400 having the configuration described above, the first bonding film 151 can be formed on the substrate 20 by using the MOCVD method as described below.

<i> First, the substrate 20 is prepared. The substrate 20 is conveyed into the chamber 411 of the film forming apparatus 400 and mounted (set) on the substrate holder 412.

<ii> Next, the inside of the chamber 411 is decompressed by opening the valve 433 in a state that the evacuating means 430 is actuated, i.e., the pump 432 is actuated. A degree of the decompression (a degree of vacuum) is not particularly limited to a specific value, but is preferably in the range of about $1\times10^{-7}$ to $1\times10^{-4}$ Torr and more preferably in the range of about $1\times10^{-6}$ to $1\times10^{-5}$ Torr.

Further, the gas for setting the inside of the chamber 411 to the low reducing atmosphere is supplied into the chamber 411 by opening the valve 473 in a state that the gas supplying means 470 is actuated, i.e., the pump 474 is actuated. As a result, the inside of the chamber 411 is set to the low reducing atmosphere.

A flow rate of the gas in the gas supplying means 470 is not particularly limited to a specific value, but is preferably in the range of about 0.1 to 10 sccm and more preferably in the range of about 0.5 to 5 sccm.

Further, at this time, the heating means is actuated to heat the substrate holder 412. A temperature of the substrate holder 412 is preferably in the range of about 80 to 600° C., more preferably in the range of about 100 to 450° C. and even more preferably in the range of about 200 to 300° C., although being slightly different depending on kind of the first bonding film 151, that is, kind of a raw material to be used for forming the first bonding film 151. By setting the temperature to the above range, it is possible to form the first bonding film 151 having excellent bonding property by using the organic metal material described later.

<iii> Next, the shutter 421 is opened. The solid organic metal material stored in the storage tank 462 is heated by actuating the heating means provided in the storage tank 462 to thereby vaporize or atomize it. In this state, the vaporized or atomized organic metal material is supplied into the chamber 411 together with the carrier gas by actuating the pump 464 and opening the valve 463.

In this way, when the vaporized or atomized organic metal material is supplied into the chamber 411 in a state that the substrate holder 412 is heated in the step <ii>, the vaporized or atomized organic metal material is heated on the substrate 20. This makes it possible to form the first bonding film 151 on the substrate 20 so that a part of an organic compound contained in the organic metal material remains therein.

In other words, according to the MOCVD method, it is possible to form a film containing metal atoms so as to remain a part of the organic compound contained in the organic metal material in the film. Therefore, it is possible to obtain the first bonding film 151 in which a part of the organic compound serves as the elimination groups 303 on the substrate 20.

The organic metal material to be used for such a MOCVD method is not particularly limited to a specific kind. Examples of the organic metal material include: a metal complex of an amido type containing various transition metal elements, an acetylacetonato type, an alkoxy type, a silyl type containing silicon or a carbonyl type containing a carboxyl group, such as 2,4-pentadionato copper(II), tris(8-quinolinolato)aluminum ($Alq_3$), tris(4-methyl-8-quinolinolato)aluminum(III) ($Almq_3$), (8-hydroxyquinoline)Zinc ($Znq_2$), copper phthalocyanine, Cu hexafluoroacetylacetonato (vinyltrimethylsilane) (Cu(hfac)(VTMS)), Cu hexafluoroacetylacetonato(2-methyl-1-hexene-3-en) (Cu(hfac)(MHY)), Cu perfluoroacetylacetonato(vinyltrimethylsilane) (Cu(pfac)(VTMS)), and Cu perfluoroacetylacetonato(2-methyl-1-hexene-3-en) (Cu(pfac)(MHY)); alkylmetal such as trimethylgallium, trimethylaluminum and diethyl zinc; derivatives thereof; and the like.

Among these materials, it is preferred that the metal complex is used as the organic metal material. By using the metal complex, it is possible to reliably form the first bonding film 151 in which a part of the organic compound contained in the metal complex remains therein.

Further, in this embodiment, the inside of the chamber 411 is set to the low reducing atmosphere by actuating the gas supplying means 470. Setting the inside of the chamber 411 to such an atmosphere makes it possible to effectively prevent or suppress reduction of the organic metal material such as the metal complex.

As a result, it is possible to form the first bonding film 151 in which a part of the organic compound contained in the organic metal material remains therein on the substrate 20, which is more advantageous than the structure in which a pure metal film containing no organic compound is directly provided on the substrate 20. In other words, it is possible to form the first bonding film 151 having excellent properties of both a bonding film and a metal film.

A flow rate of the vaporized or atomized organic metal material is preferably in the range of about 0.1 to 100 ccm and more preferably in the range of about 0.5 to 60 ccm. This makes it possible to form the first bonding film 151 having an uniform thickness, in which a part of the organic compound contained in the organic metal material remains therein.

As described above, in this embodiment, residue remaining in the first bonding film 151 when forming it is used as the elimination groups 303. Therefore, it is unnecessary to form, in advance, a film such as a metal film into which the elimination groups 303 have been introduced. This makes it possible to form the first bonding film 151 in a relatively simple step.

In this regard, it is to be noted that a part of the organic compound remained in the first bonding film 151 formed by using the organic metal material may entirely serve as the elimination groups 303 or may partially serve as the elimination groups 303.

As described above, it is possible to form the first bonding film 151 on the substrate 20. The ink jet type recording head 1 according to the third embodiment as described above can also obtain the same functions and effects as those of the ink jet type recording heads 1 according to the first embodiment and the second embodiment.

Although the droplet ejection head and the droplet ejection apparatus according to the present invention have been described above based on the embodiments illustrated in the drawings, the present invention is not limited thereto.

A method of producing the droplet ejection head according to the present invention is not limited to above embodiments, and the steps may not be carried out in the order as described above. Further, one or more arbitrary step may be added in the method, and unnecessary steps may be omitted.

The method of bonding each part of the droplet ejection head described above by using the first bonding film and the second bonding film described above may be applied to bonding of parts other than each part of the droplet ejection head.

EXAMPLES

Next, a description will be made on concrete examples of the present invention.

1. Production of Ink Jet Type Recording Head

Example 1

<1> First, the following parts were prepared: a nozzle plate made of a stainless steel, a plate-shaped base material made of monocrystal silicon, a sealing sheet made of a polyphenylenesulfide resin (PPS), a vibration plate made of a stainless steel, piezoelectric elements constituted from a layered body which is formed from piezoelectric layers constituted of a sintered body of lead zirconate and electric films formed by sintering paste-shaped Ag, a case head made of the PPS.

Next, the base material was set on the first electrode provided in the chamber of the plasma polymerization apparatus shown in FIG. 10. Then, one surface of the base material was subjected to a surface treatment by using oxygen plasma.

Next, a plasma polymerization film (first bonding film) having an average thickness of 200 nm was formed on the one surface of the base material. In this regard, it is to be noted that the film forming conditions were as follows.

Film Forming Conditions

A composition of a raw gas is octamethyltrisiloxane, a flow rate of the raw gas is 10 sccm, a composition of a carrier gas is argon, a flow rate of the carrier gas is 10 sccm, an output of a high-frequency electricity is 100 W, a density of the high-frequency electricity is 25 W/cm$^2$, a pressure within a chamber is 1 Pa (low vacuum), a time of forming a film is 15 minutes, and a temperature of the base material is 20° C.

The plasma polymerization film formed as described above was constituted of a polymer of octamethyltrisiloxane (raw gas). The polymer contained siloxane bonds, a Si-skeleton of which constituent atoms were randomly bonded, and alkyl groups (elimination groups) in a chemical structure thereof. Likewise, a plasma polymerization film was also formed on one surface of the sealing sheet.

Then, an ultraviolet ray was irradiated to surfaces the obtained plasma polymerization films under the following conditions.

Ultraviolet Ray Irradiation Conditions

A composition of an atmospheric gas is an atmosphere (air), a temperature of the atmospheric gas is 20° C., a pressure of the atmospheric gas is an atmospheric pressure (100 kPa), a wavelength of an ultraviolet ray is 172 nm, and an irradiation time of the ultraviolet ray is 5 minutes.

Next, after 1 minute of the ultraviolet ray irradiation, the base material was laminated to the sealing sheet so that the surface of the plasma polymerization film formed on the one surface of the base material, to which the ultraviolet ray had been irradiated, was in contact with the surface of the plasma polymerization film formed on the one surface of the sealing sheet, to which the ultraviolet ray had been irradiated. As a result, a first bonding body of the base material and the sealing sheet was obtained.

<2> Next, plasma polymerization films were formed on the other surface of the sealing sheet of the first bonding body and one surface of the vibration plate in the same manner as the above step <1>, respectively. Then, the ultraviolet ray was irradiated to surfaces of the thus obtained plasma polymerization films.

Next, after 1 minute of the ultraviolet ray irradiation, the vibration plate was laminated to the first bonding body so that the surface of the plasma polymerization film formed on the other surface of the sealing sheet, to which the ultraviolet ray had been irradiated, was in contact with the surface of the plasma polymerization film formed on the one surface of the vibration plate, to which the ultraviolet ray had been irradiated. As a result, a second bonding body of the base material, the sealing sheet and the vibration plate was obtained.

<3> Next, a through-hole was formed at positions to form a reserve in the sealing sheet, vibration plate and plasma polymerization films provided between the sealing sheet and the vibration plate. Further, another through-hole was formed to an annular region to surround regions to provide the piezoelectric elements on the vibration plate. In this regard, it is to be noted that these through-holes were formed by using an etching method.

<4> Next, a plasma polymerization film was formed on a region to provide the piezoelectric elements (an inside region of the annular region) in the other surface of the vibration plate of the second bonding body and one surfaces of the piezoelectric elements in the same manner as the above step <1>, respectively.

Then, the ultraviolet ray was irradiated to surfaces of the thus obtained plasma polymerization films in the same manner as the above step <1>.

Next, after 1 minute of the ultraviolet ray irradiation, the piezoelectric elements were laminated to the second bonding body so that the surface of the plasma polymerization film formed on the other surface of the vibration plate, to which the ultraviolet ray had been irradiated, was in contact with the surfaces of the plasma polymerization film formed on the one surfaces of the piezoelectric elements, to which the ultraviolet ray had been irradiated. As a result, a third bonding body of the base material, the sealing sheet, the vibration plate and the piezoelectric elements was obtained.

<5> Next, plasma polymerization films were formed on a region to provide the case head in the other surface of the vibration plate of the third bonding body and one surface of the case head in the same manner as the above step <1>, respectively.

Then, the ultraviolet ray was irradiated to surfaces of the thus obtained plasma polymerization films in the same manner as the above step <1>.

Next, after 1 minute of the ultraviolet ray irradiation, the case head was laminated to the third bonding body so that the surface of the plasma polymerization film formed on the other surface of the vibration plate, to which the ultraviolet ray had been irradiated, was in contact with the surface of the plasma polymerizations film formed on the one surface of the case head, to which the ultraviolet ray had been irradiated. As a result, a fourth bonding body of the base material, the sealing sheet, the vibration plate, the piezoelectric elements and the case head was obtained.

<6> Next, the obtained fourth bonding body was turn over. Then, the other surface of the base material was subjected to a treatment by using an etching method. Concave portions to be served as reservoir chambers and a through-hole to be served as a supply chamber were formed in the base material to obtain a substrate for forming the reservoir chambers.

<7> Next, plasma polymerization films were formed on the other surface of the substrate and one surface of a nozzle plate in the same manner as the above step <1>, respectively. Then, the ultraviolet ray was irradiated to surfaces of the thus obtained plasma polymerization films in the same manner as the above step <1>.

Next, after 1 minute of the ultraviolet ray irradiation, the nozzle plate was laminated to the substrate so that the surface of the plasma polymerization film formed on the other surface of the base material (substrate), to which the ultraviolet ray had been irradiated, was in contact with the surface of the plasma polymerizations film formed on the one surface of the nozzle plate, to which the ultraviolet ray had been irradiated. As a result, a fifth bonding body of the nozzle plate, the base material, the sealing sheet, the vibration plate, the piezoelectric elements and the case head, namely an ink jet type recording head was obtained.

<8> Next, the thus obtained ink jet type recording head is compressed at a pressure of 3 MPa for 15 minuets while heating at a temperature of 80° C. By doing so, bonding strength of each part (the nozzle plate, the base material, the sealing sheet, the vibration plate, the piezoelectric elements and the case head) in the ink jet type recording head was improved.

Example 2

An ink jet type recording head was produced in the same manner as in the Example 1 except that an epoxy resin was used in bonding parts other than a bonding part between a nozzle plate and a substrate for forming reservoir chambers, respectively. In other words, a base material and a sealing sheet, the sealing sheet and a vibration plate, the vibration plate and piezoelectric elements, and the vibration plate and a case head were bonded by the epoxy resin, respectively.

Example 3

<1> First, the following parts were prepared: a nozzle plate made of a stainless steel, a plate-shaped base material made of monocrystal silicon, a sealing sheet made of a polyphenylenesulfide resin (PPS), a vibration plate made of a stainless steel, piezoelectric elements constituted from a layered body which was formed from piezoelectric layers constituted of a sintered body of lead zirconate and electric films formed by sintering paste-shaped Ag, and a case head made of the PPS.

Next, the base material was set on the target holder provided in the chamber of the film forming apparatus shown in FIG. 13. Then, one surface of the base material was subjected to a surface treatment by using oxygen plasma.

Next, a first bonding film in which hydrogen atoms were introduced in ITO (an average thickness was 100 nm) was formed on the one surface of the base material by using an ion beam sputtering method. In this regard, it is to be noted that the film forming conditions were as follows.

Film Forming Conditions for Ion Beam Sputtering Method

A target is ITO, an ultimate vacuum within chamber is $2\times10^{-6}$ Torr, a pressure within chamber during a film formation is $1\times10^{-3}$ Torr, a flow rate of a hydrogen gas is 60 sccm, a temperature within the chamber is 20° C., an acceleration voltage of an ion beam is 600 V, an applied voltage to an ion generation chamber side grid is +400 V, an applied voltage to chamber side grid is −200 V, an ion beam current is 200 mA, a kind of gas supplied to the ion generation chamber is a Kr gas, and a processing time is 20 minutes.

The first bonding film formed as described above was constituted of a compound in which hydrogen atoms were introduced in ITO. The first bonding film contained metal atoms (indium and tin), oxygen atoms bonded to the metal atoms, and elimination groups (hydrogen atoms) bonded to at least one of the metal atoms and the oxygen atoms. Likewise, a second bonding film was also formed on one surface of the sealing sheet.

Then, an ultraviolet ray was irradiated to surfaces the obtained first bonding film and second bonding film under the following conditions.

Ultraviolet Ray Irradiation Conditions

A composition of an atmospheric gas is an nitrogen gas, a temperature of the atmospheric gas is 20° C., a pressure of the atmospheric gas is an atmospheric pressure (100 kPa), a wavelength of an ultraviolet ray is 172 nm, and an irradiation time of the ultraviolet ray is 5 minutes.

Next, after 1 minute of the ultraviolet ray irradiation, the sealing sheet was laminated to the base material so that the surface of the first bonding film formed on the one surface of the base material, to which the ultraviolet ray had been irradiated, was in contact with the surface of the second bonding film formed on the one surface of the sealing sheet, to which the ultraviolet ray had been irradiated. As a result, a first bonding body of the base material and the sealing sheet was obtained.

<2> Next, a first bonding film was formed on the other surface of the sealing sheet of the first bonding body. A second bonding film was formed on one surface of the vibration plate. The first bonding film and the second bonding film were formed in the same manner as the above step <1>, respectively. Then, the ultraviolet ray was irradiated to surfaces of the thus obtained first bonding film and second bonding film.

Next, after 1 minute of the ultraviolet ray irradiation, the vibration plate was laminated to the first bonding body so that the surface of the first bonding film formed on the other surface of the sealing sheet, to which the ultraviolet ray had been irradiated, was in contact with the surface of the second bonding film formed on the one surface of the vibration plate, to which the ultraviolet ray had been irradiated. As a result, a second bonding body of the base material, the sealing sheet and the vibration plate was obtained.

<3> Next, a through-hole was formed at positions to form a reserve in the sealing sheet, vibration plate and the first bonding film and the second bonding film provided between the sealing sheet and the vibration plate. Further, another through-hole was formed to an annular region to surround regions to provide the piezoelectric elements on the vibration plate. In this regard, it is to be noted that these through-holes were formed by using an etching method.

<4> Next, a first bonding film was formed on a region to provide the piezoelectric elements (an inside region of the annular region) in the other surface of the vibration plate of the second bonding body. A second bonding film was formed on one surface of the piezoelectric elements. The first bonding film and the second bonding film were formed in the same manner as the above step <1>, respectively.

Then, the ultraviolet ray was irradiated to surfaces of the thus obtained first bonding film and second bonding film in the same manner as the above step <1>.

Next, after 1 minute of the ultraviolet ray irradiation, the piezoelectric elements were laminated to the second bonding body so that the surface of the first bonding film formed on the other surface of the vibration plate, to which the ultraviolet ray had been irradiated, was in contact with the surface of the second bonding film formed on the one surfaces of the piezoelectric elements, to which the ultraviolet ray had been irradiated. As a result, a third bonding body of the base material, the sealing sheet, the vibration plate and the piezoelectric elements was obtained.

<5> Next, a first bonding film was formed on the other region to provide the case head in the other surface of the vibration plate of the third bonding body. Further, a second bonding film was formed on one surface of the case head. The first bonding film and the second bonding film are formed in the same manner as the above step <1>, respectively.

Then, the ultraviolet ray was irradiated to surfaces of the thus obtained first and second bonding films in the same manner as the above step <1>.

Next, after 1 minute of the ultraviolet ray irradiation, the case head was laminated to the third bonding body so that the surface of the first bonding film formed on the other surface of the vibration plate, to which the ultraviolet ray had been irradiated, was in contact with the surface of the second bonding film formed on the one surface of the case head, to which the ultraviolet ray had been irradiated. As a result, a fourth bonding body of the base material, the sealing sheet, the vibration plate, the piezoelectric elements and the case head was obtained.

<6> Next, the obtained fourth bonding body was turn over. Then, the other surface of the base material was subjected to a treatment by using an etching method. Concave portions to be served as reservoir chambers and a through-hole to be served as a supply chamber were formed in the base material to obtain a substrate for forming the reservoir chambers.

<7> Next, a first bonding film was formed on the other surface of the base material (substrate) and a second bonding film was formed on one surface of a nozzle plate in the same manner as the above step <1>, respectively. Then, the ultraviolet ray was irradiated to surfaces of the thus obtained first and second bonding films in the same manner as the above step <1>.

Next, after 1 minute of the ultraviolet ray irradiation, the nozzle plate was laminated to the substrate so that the surface of the first bonding film formed on the other surface of the base material (substrate), to which the ultraviolet ray had been irradiated, was in contact with the surface of the second bonding film formed on the one surface of the nozzle plate, to which the ultraviolet ray had been irradiated. As a result, a fifth bonding body of the nozzle plate, the base material, the sealing sheet, the vibration plate, the piezoelectric elements and the case head, namely an ink jet type recording head was obtained.

<8> Next, the thus obtained ink jet type recording head is compressed at a pressure of 3 MPa for 15 minuets while heating at a temperature of 80° C. By doing so, bonding strength of each part (the nozzle plate, the base material, the sealing sheet, the vibration plate, the piezoelectric elements and the case head) in the ink jet type recording head was improved.

Example 4

An ink jet type recording head was produced in the same manner as in the Example 3 except that a first bonding film and a second bonding film were formed under the following conditions.

A base material was set on the substrate holder provided in the chamber of the film forming apparatus shown in FIG. 15. Then, one surface of the base material was subjected to a surface treatment by using an oxygen plasma.

Next, a first bonding film having an average thickness of 100 nm was formed on the one surface of the base material by using an MOCVD method. 2,4-pentadionato copper(II) was used as a raw material for forming the first bonding film and a second bonding film. In this regard, it is to be noted that the film forming conditions were as follows.

Film Forming Conditions

An atmosphere within a chamber is a nitrogen gas and a hydrogen gas, an organic metal material (raw material) is 2,4-pentadionato copper(II), a flow rate of a atomized organic metal material is 1 sccm, a carrier gas is a nitrogen gas, a flow rate of the carrier gas is 0.2 sccm, an ultimate vacuum within the chamber is $2\times10^{-6}$ Torr, a pressure within the chamber during the film formation is $1\times10^{-3}$ Torr, a temperature of a substrate holder is 275° C., and a processing time is 10 minutes.

The first bonding film and the second bonding film formed in this way contained Cu atoms as metal atoms. In the first bonding film and the second bonding film, a part of an organic compound contained in the 2,4-pentadionato copper(II) remained as elimination groups.

Then, the thus obtained ink jet type recording head is compressed at a pressure of 10 MPa for 15 minuets while heating at a temperature of 120° C. By doing so, bonding strength of each part (the nozzle plate, the base material, the sealing sheet, the vibration plate, the piezoelectric elements and the case head) in the ink jet type recording head was improved.

Comparative Example

An ink jet type recording head was produced in the same manner as in the Example 1 except that all bonding parts, that is, a nozzle plate and a substrate for forming reservoir chambers, a base material and a sealing sheet, the sealing sheet and a vibration plate, the vibration plate and piezoelectric elements, and the vibration plate and a case head were bonded by an epoxy resin, respectively.

2. Evaluation of Ink Jet Type Recording Head 2.1 Evaluation of Dimensional Accuracy Dimensional accuracy was measured for each of the ink jet type recording heads obtained in the Examples 1 to 4 and the Comparative Example.

As a result, the dimensional accuracy of each of the ink jet type recording heads obtained in the Examples 1 to 4 was higher than the dimensional accuracy of the ink jet type recording head obtained in the Comparative Example.

Further, ink jet printers were produced by using the ink jet type recording heads obtained in the Examples 1 to 4 and the Comparative Example. Then, print sheets were printed by each of the ink jet printers. As a result, each of the ink jet printers produced by using the ink jet type recording heads obtained in the Examples 1 to 4 exhibited superior print quality as compared to the ink jet printer produced by using the ink jet type recording head obtained in the Comparative Example.

2.2 Evaluation of Chemical Resistance

An ink for an ink jet printer (produced by Seiko Epson Corporation), which was maintained at a temperature of 80° C. for three weeks, was filled into each of the ink jet type recording heads, that is reservoir chambers and supply chambers, obtained in the Examples 1 to 4 and the Comparative Example.

Thereafter, a state of each of the ink jet type recording heads was observed. Then, it was checked whether the ink penetrated into the first and second bonding films provided in the ink jet type recording head or not. The results of the check were evaluated.

As a result, in each of the ink jet type recording heads obtained in the Examples 1 to 4, the ink hardly penetrated into each bonding part (in particular, the first bonding film and the second bonding film). In contrast, in the ink jet type recording head obtained in the Comparative Example, the ink penetrated into each bonding part (epoxy resin).

What is claimed is:

1. A droplet ejection head, comprising:

a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof;

a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate;

a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid;

wherein each of the first bonding film and the second bonding film contains an Si-skeleton constituted of constituent atoms containing silicon atoms, and the Si-skeleton has siloxane (Si—O) bonds and elimination groups bonded to the silicon atoms, wherein the constituent atoms are randomly bonded to each other, and the elimination groups exist in the vicinity of a surface of each of the first bonding film and the second bonding film, and wherein the nozzle plate is bonded to the substrate together through the first bonding film and the second bonding film since the elimination groups are eliminated from the silicon atoms contained in the constituent atoms constituting the Si-skeleton in each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

2. The droplet ejection head as claimed in claim 1, wherein the constituent atoms have hydrogen atoms and oxygen atoms, a sum of a content of the silicon atoms and a content of the oxygen atoms in the constituent atoms other than the hydrogen atoms is in the range of 10 to 90 atom % in at least one of the first bonding film and the second bonding film.

3. The droplet ejection head as claimed in claim 1, wherein an abundance ratio of the silicon atoms and the oxygen atoms is in the range of 3:7 to 7:3 in at least one of the first bonding film and the second bonding film.

4. The droplet ejection head as claimed in claim 1, wherein a crystallinity degree of the Si-skeleton is equal to or lower than 45%.

5. The droplet ejection head as claimed in claim 1, wherein the Si-skeleton of at least one of the first bonding film and the second bonding film contains Si—H bonds.

6. The droplet ejection head as claimed in claim 5, wherein in the case where the at least one of the first bonding film and the second bonding film containing the Si-skeleton containing the Si—H bonds is subjected to an infrared absorption measurement by an infrared adsorption measurement apparatus to obtain an infrared absorption spectrum having peaks, when an intensity of the peak derived from the siloxane bond in the infrared absorption spectrum is defined as "1", an intensity of the peak derived from the Si—H bond in the infrared absorption spectrum is in the range of 0.001 to 0.2.

7. The droplet ejection head as claimed in claim 1, wherein the elimination groups are constituted of at least one selected from a group consisting of a hydrogen atom, a boron atom, a carbon atom, a nitrogen atom, an oxygen atom, a phosphorus atom, a sulfur atom, a halogen-based atom and an atom group which is arranged so that these atoms are bonded to the Si-skeleton.

8. The droplet ejection head as claimed in claim 7, wherein the elimination groups are an alkyl group containing a methyl group.

9. The droplet ejection head as claimed in claim 8, wherein in the case where at least one of the first bonding film and the second bonding film containing the Si-skeleton having the methyl groups as the elimination groups is subjected to an infrared absorption measurement by an infrared absorption measurement apparatus to obtain an infrared absorption spectrum having peaks, when an intensity of the peak derived from the siloxane bond in the infrared absorption spectrum is defined as "1", an intensity of the peak derived from the methyl group in the infrared absorption spectrum is in the range of 0.05 to 0.45.

10. The droplet ejection head as claimed in claim 1, wherein at least one of the first bonding film and the second bonding film is formed by using a plasma polymerization method.

11. The droplet ejection head as claimed in claim 10, wherein the at least one of the first bonding film and the second bonding film is constituted of polyorganosiloxane as a main component thereof.

12. The droplet ejection head as claimed in claim 11, wherein the polyorganosiloxane is constituted of a polymer of octamethyltrisiloxane as a main component thereof.

13. The droplet ejection head as claimed in claim 10, wherein the plasma polymerization method includes a high frequency applying process and a plasma generation process, a power density of the high frequency during the plasma generation process is in the range of 0.01 to 100 $W/cm^2$.

14. The droplet ejection head as claimed in claim 1, wherein an average thickness of at least one of the first bonding film and the second bonding film is in the range of 1 to 1000 nm.

15. The droplet ejection head as claimed in claim 1, wherein at least one of the first bonding film and the second bonding film is a solid-state film having no fluidity.

16. The droplet ejection head as claimed in claim 1, wherein the substrate is constituted of a silicon material or a stainless steel as a main component thereof.

17. The droplet ejection head as claimed in claim 1, wherein the nozzle plate is constituted of a silicon material or a stainless steel as a main component thereof.

18. The droplet ejection head as claimed in claim 1, wherein the one surface of the substrate is preliminarily subjected to a surface treatment for obtaining high bonding property to the first bonding film.

19. The droplet ejection head as claimed in claim 18, wherein the surface treatment includes a plasma treatment.

20. The droplet ejection head as claimed in claim 1, wherein the one surface of the nozzle plate is preliminarily subjected to a surface treatment for obtaining high bonding property to the second bonding film.

21. The droplet ejection head as claimed in claim 1 further comprising a first intermediate layer formed between the one surface of the substrate and the first bonding film.

22. The droplet ejection head as claimed in claim 21, wherein the first intermediate layer is constituted of an oxide-based material as a main component thereof.

23. The droplet ejection head as claimed in claim 1 further comprising a second intermediate layer formed between the one surface of the nozzle plate and the second bonding film.

24. The droplet ejection head as claimed in claim 1, wherein the energy is imparted by using at least one method of a method of irradiating an energy beam on the surface of the first bonding film and the surface of the second bonding film, a method of heating the first bonding film and the second bonding film and a method of applying a compressive force to the first bonding film and the second bonding film.

25. The droplet ejection head as claimed in claim 24, wherein a wavelength of the energy beam is in the range of 150 to 300 nm.

26. The droplet ejection head as claimed in claim 24, wherein a temperature of the heating is in the range of 25 to 100° C.

27. The droplet ejection head as claimed in claim 24, wherein the compressive force is in the range of 0.2 to 10 MPa.

28. The droplet ejection head as claimed in claim 1 further comprising a third bonding film between the sealing plate and the other surface of the substrate, wherein the third bonding film includes one bonding film constituted in the same manner as the first bonding film and the other bonding film constituted of the same manner as the second bonding film, and the sealing plate is bonded to the other surface of the substrate through the other bonding film and the one bonding film.

29. The droplet ejection head as claimed in claim 28, wherein the sealing plate is constituted from a laminated body formed by laminating layers, wherein the laminated layers include a sealing sheet being in contact with the third bonding film, at least one bonding film constituted in the same manner as the first bonding film, at least the other bonding film constituted in the same manner as the second bonding film and a vibration plate being in contact with the other bonding film, and the one bonding film being in contact with the sealing sheet, wherein the sealing sheet and the vibration plate are bonded to each other through the one bonding film and the other bonding film.

30. The droplet ejection head as claimed in claim 1 further comprising a fourth bonding film between the other surface of the sealing plate and the piezoelectric means, wherein the fourth bonding film includes one bonding film constituted in the same manner as the first bonding film and the other bonding film constituted of the same manner as the second bonding film, and the piezoelectric means is bonded to the sealing plate through the other bonding film and the one bonding film.

31. The droplet ejection head as claimed in claim 30, wherein the piezoelectric means is composed from piezoelectric elements.

32. The droplet ejection head as claimed in claim 1 further comprising a case head provided on the other surface of the sealing plate so as to cover the piezoelectric means, wherein the fourth bonding film includes one bonding film constituted in the same manner as the first bonding film and the other bonding film constituted of the same manner as the second bonding film, and the case head is bonded to the sealing plate through the other bonding film and the one bonding film.

33. A droplet ejection apparatus provided with the droplet ejection head defined in claim 1.

34. A droplet ejection head, comprising:

a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof;

a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate;

a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid;

wherein each of the first bonding film and the second bonding film is constituted of constituent atoms containing metal atoms and oxygen atoms bonded to the metal atoms, and has elimination groups bonded to at least one of the metal atoms and the oxygen atoms, wherein the elimination groups exist in the vicinity of a surface of each of the first bonding film and the second bonding film, and wherein the nozzle plate is bonded to the substrate together through the first bonding film and the second bonding film since the elimination groups are eliminated from the at least one of the metal atoms and the oxygen atoms contained in the constituent atoms of each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

35. A droplet ejection head, comprising:

a substrate having first through-holes that serves as reservoir chambers for reserving an ejection liquid and a second through-hole that serves as a supply chamber for supplying the ejection liquid to the reservoir chambers, the substrate having one surface on which a first bonding film is formed and the other surface opposite to the one surface thereof;

a nozzle plate having nozzles for ejecting the ejection liquid as droplets, the nozzle plate having one surface on which a second bonding film is formed and the other surface opposite to the one surface thereof, wherein the nozzle plate is bonded to the substrate together through the first bonding film and the second bonding film so as to cover the first through-holes and the second through-hole of the substrate;

a sealing plate provided on the other surface of the substrate so as to cover the first through-holes, the sealing plate having one surface being in contact with the other surface of the substrate and the other surface opposite to the one surface thereof; and piezoelectric means provided on a part of the other surface of the sealing plate for driving the droplet ejection head to eject the ejection liquid;

wherein each of the first bonding film and the second bonding film contains metal atoms and elimination groups constituted of an organic component, and the elimination groups exist in the vicinity of a surface of each of the first bonding film and the second bonding film, and wherein the nozzle plate is bonded to the substrate together through the first bonding film and the second bonding film since the elimination groups are eliminated from the vicinity of the surface of each of the first bonding film and the second bonding film by imparting energy to at least a part thereof to develop bonding property in the vicinity of the surface of each of the first bonding film and the second bonding film so that the first bonding film and the second bonding film are firmly bonded together by the developed bonding property.

* * * * *